US007184677B2

(12) United States Patent
Tanaka et al.

(10) Patent No.: US 7,184,677 B2
(45) Date of Patent: Feb. 27, 2007

(54) IMAGE FORMING APPARATUS FOR TRANSFERRING RESPECTIVE TONER COLORS ON A TRANSFER MEDIUM

(75) Inventors: Kuniaki Tanaka, Nagano-ken (JP); Nozomu Inoue, Nagano-ken (JP); Yoshio Nakazawa, Nagano-ken (JP); Tsuyoshi Kowari, Nagano-ken (JP); Keiichi Taguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 142 days.

(21) Appl. No.: 10/953,057

(22) Filed: Sep. 30, 2004

(65) Prior Publication Data

US 2005/0053389 A1 Mar. 10, 2005

Related U.S. Application Data

(62) Division of application No. 10/632,907, filed on Aug. 4, 2003, now Pat. No. 6,832,060, which is a division of application No. 09/868,892, filed as application No. PCT/JP00/07909 on Nov. 9, 2000, now Pat. No. 6,633,737.

(51) Int. Cl.
*G03G 15/16* (2006.01)

(52) U.S. Cl. ..... 399/66; 399/301

(58) Field of Classification Search ..... 399/66, 399/101, 301, 302; 347/116, 234, 248
See application file for complete search history.

(56) References Cited

U.S. PATENT DOCUMENTS

| | | | | |
|---|---|---|---|---|
| 5,254,915 | A | 10/1993 | Komatsu et al. | 318/369 |
| 5,444,525 | A | 8/1995 | Takahashi et al. | |
| 5,471,292 | A | 11/1995 | Okazawa | |
| 5,634,171 | A | 5/1997 | Muto | |
| 5,946,537 | A | 8/1999 | Nakayasu et al. | |
| 6,021,258 | A | 2/2000 | Ishizu et al. | |
| 6,064,849 | A | 5/2000 | Honda et al. | |
| 6,336,024 | B1 | 1/2002 | Kanaya et al. | |
| 6,633,737 | B1 * | 10/2003 | Tanaka et al. | 399/66 |
| 6,832,060 | B2 * | 12/2004 | Tanaka et al. | 399/66 |

FOREIGN PATENT DOCUMENTS

| | | |
|---|---|---|
| DE | 69420877 | 2/2000 |
| EP | 0 919 882 | 6/1999 |
| JP | 5-22970 | 1/1993 |
| JP | 5-257360 | 10/1993 |
| JP | 7-52455 | 2/1995 |
| JP | 7-84451 | 3/1995 |

(Continued)

*Primary Examiner*—Robert Beatty
(74) *Attorney, Agent, or Firm*—Oblon, Spivak, McClelland, Maier & Neustadt, P.C.

(57) ABSTRACT

An image forming apparatus which repeats image create/transfer processing while rotating a photosensitive member and a transfer medium in a sub scanning direction and thereafter transferring the toner image onto the transfer medium, for a plurality of toner colors which are different from each other, to thereby lay toner images in respective toner colors over each other on the transfer medium and accordingly form a color image. The apparatus corrects transfer start positions of toner image in at least one or more toner colors out of the plurality of toner colors based on a registration control amount which is necessary to correct relative registration deviations among toner images on the transfer medium.

6 Claims, 56 Drawing Sheets

FOREIGN PATENT DOCUMENTS

| | | | |
|---|---|---|---|
| JP | 7-181822 | | 7/1995 |
| JP | 7-225544 | | 8/1995 |
| JP | 7-271266 | | 10/1995 |
| JP | 8-88748 | | 4/1996 |
| JP | 8-137179 | | 5/1996 |
| JP | 8-190244 | | 7/1996 |
| JP | 8-224912 | | 9/1996 |
| JP | 8-248730 | | 9/1996 |
| JP | 9-15927 | | 1/1997 |
| JP | 0 616 266 | | 3/1997 |
| JP | 9-80853 | | 3/1997 |
| JP | 9-110264 | | 4/1997 |
| JP | 9-146438 | | 6/1997 |
| JP | 9-185192 | | 7/1997 |
| JP | 9-185214 | | 7/1997 |
| JP | 9-274396 | | 10/1997 |
| JP | 10-10830 | | 1/1998 |
| JP | 10-20220 | | 1/1998 |
| JP | 10-20614 | | 1/1998 |
| JP | 10-104970 | | 4/1998 |
| JP | 10-153896 | | 6/1998 |
| JP | 10-213938 | | 8/1998 |
| JP | 10-232532 | | 9/1998 |
| JP | 10-307446 | | 11/1998 |
| JP | 10-319667 | | 12/1998 |
| JP | 10-333391 | | 12/1998 |
| JP | 11-65204 | | 3/1999 |
| JP | 11-65209 | | 3/1999 |
| JP | 11-95628 | | 4/1999 |
| JP | 11-157134 | | 6/1999 |
| JP | 11-202588 | | 7/1999 |
| JP | 11-219037 | | 8/1999 |
| JP | 11-231599 | | 8/1999 |
| JP | 11-2218994 | | 8/1999 |
| JP | 11231599 | A * | 8/1999 |
| JP | 11-258878 | | 9/1999 |
| JP | 11-295954 | | 10/1999 |
| JP | 11-301032 | | 11/1999 |
| JP | 2000-66475 | | 3/2000 |
| JP | 2000-75586 | | 3/2000 |
| JP | 2000-298389 | | 10/2000 |
| JP | 2000-305335 | | 11/2000 |

* cited by examiner

IMAGE FORMING APPARATUS FOR TRANSFERRING RESPECTIVE TONER COLORS ON A TRANSFER MEDIUM

FIELD OF THE INVENTION

The present invention relates to an image forming apparatus and an image forming method which repeat image create/transfer processing for a plurality of toner colors which are different from each other so that toner images in the respective toner colors are laid one atop the other on a transfer medium, such as a transfer drum and a transfer belt, and a color image is accordingly formed. As herein described, the "image create/transfer processing" refers to a series of processes that after forming a toner image on a photosensitive member while rotating the photosensitive member and a transfer medium in a sub scanning direction, the toner image is transferred onto the transfer medium.

BACKGROUND ART

An image forming apparatus of this type is as that shown in FIG. 59, for example. This image forming apparatus allows to form toner images in a plurality of colors which are different from each other, e.g., four colors of yellow (Y), cyan (C), magenta (M) and black (K), on a photosensitive member 21 which is driven to rotate. The respective toner images are primarily transferred onto a transfer medium 41, such as a transfer belt and a transfer drum, which rotates in synchronization with the photosensitive member 21. The image forming apparatus comprises a drive source 81, such as a dynamotor and a pulse motor, in order to drive the photosensitive member 21 and the transfer medium 41 into rotation. Rotational drive force generated by the drive source 81 is applied to the photosensitive member 21 and the transfer medium 41 through a power transmission unit 9 which comprises power transmission members 91, such as a plurality of gears and a belt, and drives the photosensitive member 21 and the transfer medium 41 into rotation in mutual synchronization.

In this image forming apparatus, toner images in the respective colors are laid one atop the other on the transfer medium 41 through repeated image create/transfer processing for the plurality of colors, and a color image is formed on the transfer medium 41. Following this, the color image is secondarily transferred onto a sheet member S, such as a copy paper, a transfer paper, a paper and a transparent sheet for an overhead projector, which is fed from a cassette or manual-feed tray.

In order to obtain an excellent color image, it is necessary to lay toner images in the plurality of colors one atop the other while registering the toner images with each other. To this end, in the image forming apparatus described above, a sensor 40 for detecting a reference position of the transfer medium 41, for instance, is disposed in the vicinity of the transfer medium 41, and a signal which is outputted from the sensor 40 for every rotation of the transfer medium 41 is used as a reference signal for the image create/transfer processing. More specifically, after a toner image is created on the photosensitive member 21 at predetermined timing for every outputting of the reference signal, the toner images are primarily transferred onto the transfer medium 41 which rotates at a constant speed in synchronization with the photosensitive member 21. As a result, the toner images in the plurality of colors are laid over with each other accurately. Hence, the transfer medium 41 needs be driven to rotate at a constant speed in synchronization with the photosensitive member 21 until the primary transfer completes since outputting of the reference signal from the sensor 40.

However, abutting means 400, such as a secondary transfer roller for secondary transfer onto the transfer medium 41 and a cleaning part for cleaning of the transfer medium 41, sometimes temporarily comes into contact at proper timing, thereby changing loads upon the transfer medium 41, the power transmission members 91, etc. In other words, the contact could hamper the drive rotation of the transfer medium 41, elastically stretch the transfer medium 41, elastically bend the power transmission members 91 in a similar manner, or further, change a load upon a driving part (not shown) which drives the transfer medium 41 into rotation. The contact and separation could prevent the transfer medium 41 from rotating at a constant speed.

In an image forming apparatus of this type, in particular, in order to accurately transmit rotational drive force from the drive source 81 to the photosensitive member 21 and the transfer medium 41, gears formed by a resin material, such as polyacetal (POM), polycarbonate (PC), polyphenylene sulfide (PPS), polybutylene terephthalate (PBT) and polyimide (PI), are often used, and therefore, the gears are elastically deformed as such loads described above change, which is one of main causes of a registration deviation. Further, where the transfer medium 41 is a transfer belt, stretching and shrinking of the transfer medium 41 caused by a change in the loads described above is one of main causes of a registration deviation. A registration deviation which is caused as the abutting means 400 contacts and moves away from the transfer medium 41 will be described in detail in the sections "A-3. Analysis of Causes of Registration Deviation" and "B-3. Analysis of Causes of Registration Deviation" later.

Causes of a registration deviation are not limited to these. A registration deviation may be caused by the following as well. That is, in an image forming apparatus of this type, the photosensitive member 21 and the transfer medium 41 are driven into rotation in mutual synchronization in a sub scanning direction. As the sensor 40 outputs a vertical synchronizing signal using this as a reference, a light beam scans over the photosensitive member 21 in a main scanning direction, which is approximately perpendicular to the sub scanning direction, based on an image signal which is supplied from an external apparatus such as a host computer, whereby an electrostatic latent image which corresponds to the image signal is formed on the photosensitive member 21.

Further, after the electrostatic latent image is developed by a developer with toner and a toner image is formed, the toner image is transferred onto the transfer medium 41 which is driven into rotation in synchronization with the photosensitive member 21 in the sub scanning direction. Such image create/transfer processing is executed for the respective toner colors (yellow, cyan, magenta and black), so that the respective toner images are laid one atop the other and a color image is created on the transfer medium 41.

However, in an image forming apparatus of this type, scan timing of the light beam is not synchronous to the vertical synchronizing signal in many cases, sometimes leading to a synchronization error between the vertical synchronizing signal and the scan timing. In this case, a transfer position on the transfer medium 41 becomes deviated by an amount corresponding to the synchronization error. Since synchronization errors become different among the respective toner colors, the toner images become deviated from each other among the respective toner colors, that is, a registration deviation which degrades an image quality is developed.

The present invention has been made in view of the problem above, and accordingly, aims at providing an image forming apparatus and an image forming method with which it is possible to suppress a registration deviation on a transfer medium and form a high-quality image.

SUMMARY OF THE INVENTION

According to the present invention, based on a registration control amount which is needed to correct registration deviations which are caused as image create/transfer processing is repeated for a plurality of toner colors which are different from each other and toner images in the respective toner colors are laid one atop the other on a transfer medium, transfer start positions for toner images in at least one or more of the toner colors are corrected. This eliminates or suppresses relative registration deviations among the toner images on the transfer medium and improves an image quality.

One of causes of registration deviations is thought to be contact and separation of abutting means to and from the transfer medium. Noting this, according to the present invention, the abutting means is allowed to contact and move away from the transfer medium during repeated image create/transfer processing and transfer start positions for toner images are corrected using, as a registration control amount, a control amount which is needed to correct relative registration deviations among toner images on the transfer medium which are caused as the abutting means contacts and moves away from the transfer medium. This eliminates or suppresses registration deviations which are created as the abutting means contacts and moves away from the transfer medium and improves an image quality.

Further, according to the present invention, registration control amount establish processing is executed before forming a color image, in order to obtain a registration control amount which is needed to correct registration deviations which are created as the abutting means contacts and moves away from the transfer medium. The registration control amount establish processing may be to obtain a registration control amount with the abutting means contacting and moving away from the transfer medium which is rotating in a dedicated sequence which is different from a printing sequence which is used to form a color image, for instance. In this manner, it is possible to accurately identify a registration control amount which is essential to highly precise registration control.

Alternatively, the present invention further comprises abutting means which temporarily contacts a transfer medium during repeated image create/transfer processing in a sequence which corresponds to an operation state of the apparatus among a plurality of sequences which are different from each other; and memory means which stores in advance a plurality of registration control amounts which are necessary to correct relative registration deviations among toner images on the transfer medium which are caused as the abutting means contacts and moves away from the transfer medium. A registration control amount which corresponds to one sequence is read from the memory means and a transfer start position of a toner images is corrected for each toner color based on the registration control amount. Hence, it is not necessary to newly identify a registration control amount every time the sequence changes, and therefore, excellent controllability is achieved.

Alternatively, according to the present invention, registration control amount correction is executed after a color image is created based on a registration control amount at least once or more times, so that the registration control amount is corrected. While an operating environment, such as a temperature and a humidity level inside the apparatus, usually changes as color image generation proceeds thereby causing the registration control amount to deviate from an optimal value, since the registration control amount is corrected by means of execution of the registration control amount correction in the present invention, the registration control amount is optimized in accordance with an operating environment, etc. Hence, a color image is obtained more stably.

Other cause of the registration deviations is thought to be asynchronous control of the vertical synchronizing signal and the scan timing. Noting this, according to the present invention, driving means is controlled in accordance with a synchronization error period between the vertical synchronizing signal and the scan timing to thereby temporarily control acceleration/deceleration of at least the transfer medium and correct registration deviations which are attributed to the synchronization error period. This eliminates or suppresses registration deviations which are induced by the asynchronous control, and improves an image quality.

Further, according to the present invention, the image create/transfer processing is executed in response to the vertical synchronizing signal outputted from vertical synchronizing signal detecting means, and transfer start positions for toner images for the respective toner colors are corrected based on a first registration control amount, which is necessary to correct relative registration deviations among toner images on the transfer medium which are caused as the abutting means contacts and moves away from the transfer medium since the vertical synchronizing signal is outputted until the image create/transfer processing corresponding to this vertical synchronizing signal completes, and a second registration control amount, which is necessary to correct relative registration deviations among toner images on the transfer medium which are attributed to a synchronization error between the vertical synchronizing signal and the scan timing. The registration deviations of the two types described above are therefore suppressed at the same time, which in turn allows to obtain a color image having a higher quality.

Alternatively, for the purpose of eliminating registration deviations, the present invention further comprises driving means which drives a photosensitive member and a transfer medium into rotation in a sub scanning direction in synchronization with each other. During the correction, the photosensitive member and the transfer medium are accelerated/decelerated temporarily to a second driving speed from a first driving speed, and a position at which toner images are to be formed on the photosensitive member is shifted by a registration control amount in the sub scanning direction, whereby transfer start positions for toner images on the transfer medium are corrected in the sub scanning direction.

Alternatively, for the purpose of eliminating registration deviations, the present invention further comprises photosensitive member driving means which drives the photosensitive member into rotation in the sub scanning direction at the predetermined first driving speed and transfer medium driving means which drives the transfer medium into rotation in the sub scanning direction. During the correction, the transfer medium is accelerated/decelerated temporarily to the second driving speed from the first driving speed, whereby transfer start positions for toner images on the transfer medium are corrected in the sub scanning direction.

Alternatively, according to the present invention, the registration control amount establish processing is executed before forming a color image and a registration control amount, which is necessary to correct relative registration deviations among toner images on the transfer medium which are caused as the abutting means contacts and moves away from the transfer medium, is obtained from data which are acquired during the registration control amount establish processing, while when suspension of the registration control amount establish processing is removed, a registration control amount is obtained from data which are stored in a memory part without executing the registration control amount establish processing once again to thereby correct transfer start positions for toner images for the respective toner colors in accordance with the registration control amount. This realizes the following functions and effects. That is, the registration control amount establish processing (step) is interrupted in the presence of a cause of interruption, such as a cover of the apparatus getting open and a power source of the apparatus getting turned off. As the cause of interruption is eliminated and the interruption is resolved later, images are formed as usual immediately after this. Hence, as compared with where the registration control amount establish processing is to be executed once again after the interruption is resolved, the apparatus performs better. In addition, although the registration control amount establish processing (step) is not executed again after the interruption is resolved, since the registration control amount has been already calculated from the data acquired prior to the interruption, the transfer start positions of toner images are corrected for the respective toner colors in accordance with the registration control amount. Hence, a high-quality color image is obtained while suppressing registration deviations.

Further, it is possible to change a registration control amount in accordance with a necessity. Hence, it is possible to suppress a registration deviation while meeting a request from a user, by means of a proper change in registration control amount in response to the user's request.

Further, the present invention makes it possible to selectively execute a registration control mode and a registration priority mode so that the abutting means contacts and moves away from the transfer medium under control in the selected mode. The registration priority mode as herein referred to is an operation mode which requires to rotate the transfer medium idle at least once or more times between first processing which is the image create/transfer processing in the last toner color and second processing which is the image create/transfer processing to form the next toner image and to cause the abutting means to temporarily contact the transfer medium during the idle rotation. Hence, when the registration priority mode is selected, registration deviations are prevented without fail in a manner which will be described in the section "R. Eighteenth Preferred Embodiment" later. Meanwhile, when the registration control mode is selected, since the abutting means is allowed to contact and move away from the transfer medium during repeated image create/transfer processing, a processing efficiency is more excellent and a throughput is higher than in the above-mentioned registration priority mode. Conversely, as described above, while registration deviations are created as the image create/transfer processing is executed with the transfer medium staying instable, the registration deviations are corrected in a manner similar to that in the invention described above and a high-quality image is obtained.

BEST MODE FOR IMPLEMENTING THE INVENTION

A. First Preferred Embodiment

In the following, an image forming apparatus according to a first preferred embodiment of the present invention will be described in detail with reference to the associated drawings. The image forming apparatus according to the first preferred embodiment uses a transfer drum as a transfer medium.

A-1. Structure of Apparatus

Figure 1:
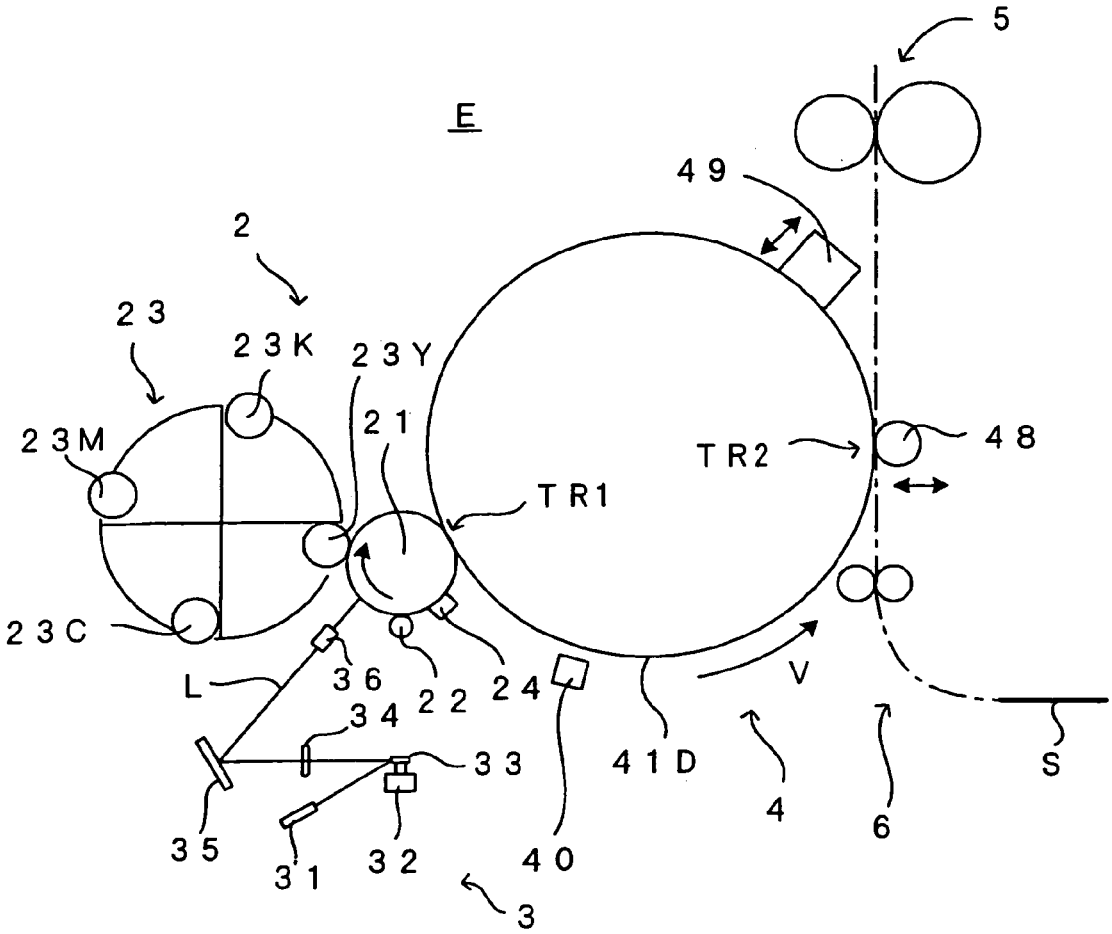
FIG. 1 is a drawing showing an image forming apparatus according to a first preferred embodiment of the present invention.
Figure 2:
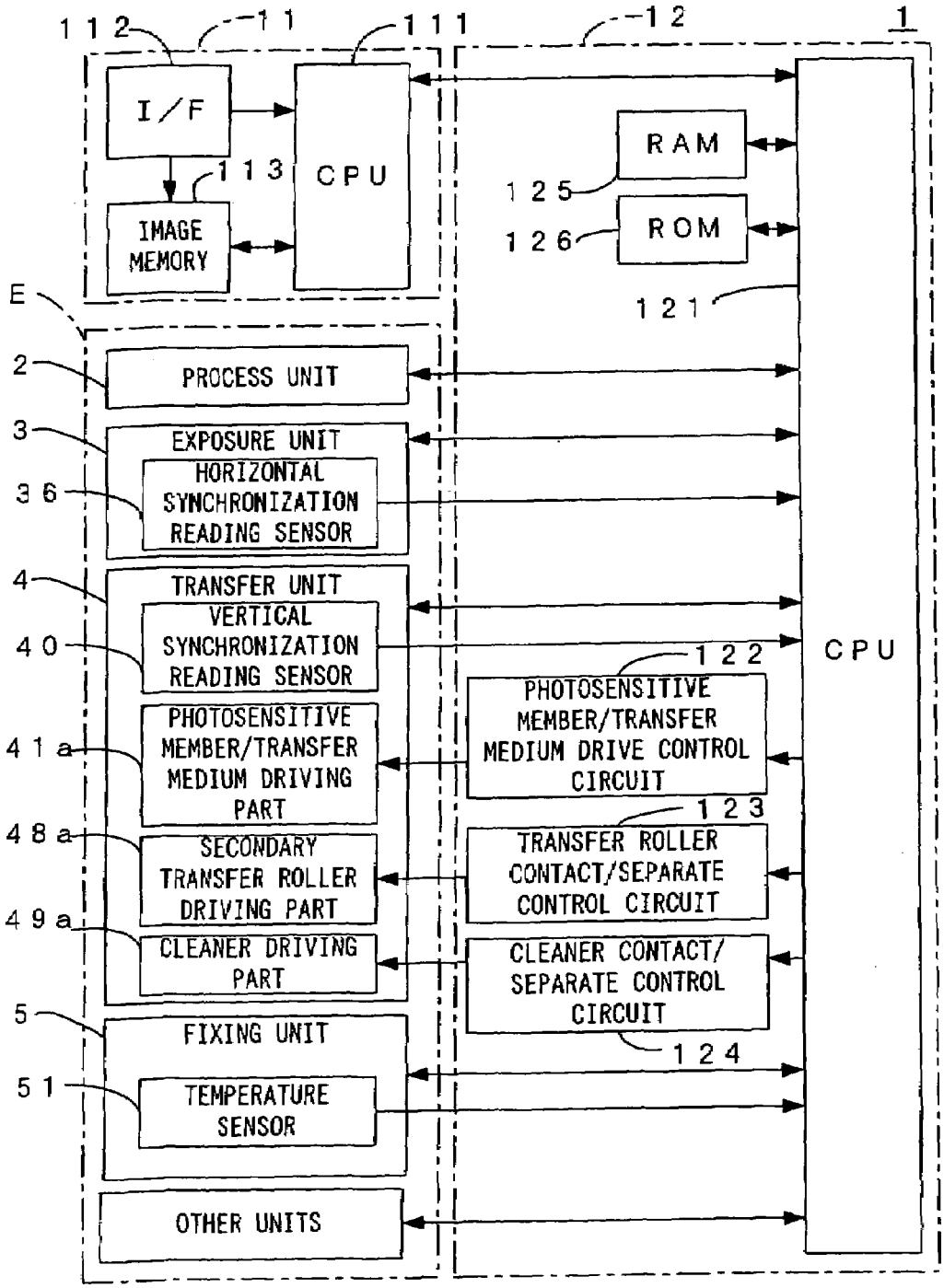
FIG. 2 is a block diagram showing an electric structure of FIG. 1.

FIG. 1 shows the image forming apparatus according to the first preferred embodiment of the present invention, and FIG. 2 is a block diagram showing an electric structure of FIG. 1. The image forming apparatus is an apparatus which superimposes toner images one atop the other which are in four colors of yellow (Y), cyan (C), magenta (M) and black (K) and creates a full-color image, or creates a monochrome image using only black (K) toner. In this image forming apparatus, responding to an image create instruction (which is a signal indicative of a content of a print request) supplied to a control unit 1 from an external apparatus such as a host computer, a main controller 11 disposed inside the control unit 1 converts the instruction into job data (print information) which are in a format which is suitable to instruct an engine part E of the image forming apparatus to operate, and feeds the data to an engine controller 12. Receiving this, the engine controller 12 controls the engine part E of the image forming apparatus in accordance with the job data.

In the engine part E, it is possible to form a toner image on a photosensitive member 21 of a process unit 2. More specifically, the process unit 2 has the photosensitive member 21 which can rotate in the direction indicated at the arrow in FIG. 1. An electrifying roller 22 which serves as electrifying means, developers 23Y, 23C, 23M and 23K which serve as developing means, and a photosensitive member cleaner blade 24 are arranged around the photosensitive member 21 along the direction of rotation of the photosensitive member 21. An electrifying bias is applied upon the electrifying roller 22 from an electrifying bias circuit (not shown), and the electrifying roller 22 contacts an outer circumferential surface of the photosensitive member 21 and uniformly electrifies the outer circumferential surface. A structure for driving the photosensitive member 21 and an intermediate transfer drum 41D which will be described later into rotation is the same as the structure shown in FIG. 59, and will not be described here.

An exposure unit 3 irradiates laser light L toward the outer circumferential surface of the photosensitive member 21 which is electrified by the electrifying roller 22. The exposure unit 3 comprises a light emitting device 31, such as a semiconductor laser, which is modulated in accordance with an image signal, as shown in FIG. 1. The laser light L from the light emitting device 31 impinges upon a polygon mirror 33 which is driven into rotation by a high-speed motor 32. Reflected by the polygon mirror 33, the laser light L sweeps over the photosensitive member 21 in a main scanning direction (direction perpendicular to the sheet of FIG. 1) through a lens 34 and a mirror 35, thereby forming an electrostatic latent image which corresponds to the image signal. Denoted at 36 is a horizontal synchronization reading sensor for obtaining a synchronizing signal in the main scanning direction, namely, a horizontal synchronizing signal HSYNC.

The electrostatic latent image which is created in this manner is developed with toner in the developer part 23. In other words, in the first preferred embodiment, the developer 23Y for yellow, the developer 23C for cyan, the developer 23M for magenta and the developer 23K for black are axially disposed so as to freely rotate as the developer part 23. Positioned for rotation, the developers 23Y, 23C, 23M and 23K selectively contact the photosensitive member 21 and supplies toner to the surface of the photosensitive member 21. In consequence, electrostatic latent images on the photosensitive member 21 are visualized. Toner images developed by the developer part 23 are thereafter primarily transferred within a primary transfer region TR1 onto the intermediate transfer drum 41D of a transfer unit 4.

The photosensitive member cleaner blade 24 is arranged ahead of the primary transfer region TR1 in a circumferential direction (the direction indicated at the arrow in FIG. 1), and scrapes off the toner which remains adhering to the outer circumferential surface of the photosensitive member 21 after the primary transfer.

The intermediate transfer drum 41D of the transfer unit 4, subjected to rotational drive force from a drive source such as a dynamotor (denoted at 81 in FIG. 59), rotates while staying in contact with the photosensitive member 21, whereby the toner images on the photosensitive member 21 are primarily transferred onto the intermediate transfer drum 41D within the primary transfer region TR1. For the purpose of printing a color image, the toner images in the respective colors formed on the photosensitive member 21 are superimposed one atop the other on the intermediate transfer drum 41D and a color image is accordingly formed. Meanwhile, for the purpose of printing a monochrome image, only the black toner image on the photosensitive member 21 is created on the intermediate transfer drum 41D. A sensor 40 for detecting a reference position of the intermediate transfer drum 41D is disposed in the vicinity of the primary transfer region TR1, and functions as a vertical synchronization reading sensor for obtaining a synchronizing signal in a sub scanning direction which is approximately perpendicular to the main scanning direction, namely, a vertical synchronizing signal VSYNC. The sensor 40 functions also as reference signal detecting means which outputs a reference signal in relation to rotation of the intermediate transfer drum 41D, as described later in detail.

The transfer unit 4 comprises a secondary transfer roller 48 which secondarily transfers intermediate toner images which have been transferred onto the intermediate transfer drum 41D further onto a sheet member S, and a photosensitive member/transfer medium driving part 41*a* which drives the photosensitive member 21 and the intermediate transfer drum 41D into rotation in mutual synchronization. For printing of a color image, a paper feed/discharge unit 6 unloads the sheet member S from a cassette, a manual-feed tray or an extension cassette (not shown), the sheet member S is transported to a secondary transfer region TR2, and a color image is secondarily transferred onto the sheet member S.

A cleaning part 49 is disposed in the vicinity of the secondary transfer region TR2 such that the cleaning part 49 can contact and move away from the intermediate transfer drum 41D. The cleaning part 49 contacts the intermediate transfer drum 41D at appropriate timing, and scrapes off the toner which remains adhering to an outer circumferential surface of the intermediate transfer drum 41D after the secondary transfer.

A fixing unit 5 is disposed on the downstream side to the secondary transfer region TR2 along a transport path (denoted at the alternate long and short dashed line in FIG. 1), and fixes a toner image on the sheet member S which bears the toner image and is transported along the transport path. The sheet member S is transported further along the transport path toward a discharge tray (not shown).

Next, the electric structure of the image forming apparatus shown in FIG. 1 will be described with reference to FIG. 2. The main controller 11 disposed inside the image forming apparatus comprises a CPU 111, an interface 112 which receives a signal from and sends a signal to the external apparatus such as a host computer, and an image memory 113 for storing an image which is fed through the interface 112. As described above, the main controller 11 creates job data (print information) and supplies the job data to the engine controller 12.

The engine controller 12 comprises a CPU 121. The engine controller 12 receives, as input signals from the engine part E, the horizontal synchronizing signal HSYNC from the horizontal synchronization reading sensor 36, the vertical synchronizing signal VSYNC from the vertical synchronization reading sensor 40 and a temperature signal Which represents a fixing temperature from a temperature sensor 51 which is disposed to the fixing unit 5. Based on these input signals and various types of information, the CPU 121 supplies a drive instruction signal to a photosensitive member/transfer medium drive control circuit 122. The photosensitive member/transfer medium drive control circuit 122, subjected to rotational drive force from the drive source (denoted at 81 in FIG. 59) through a power transmission unit (denoted at 9 in FIG. 59) based on the drive instruction signal, drives and controls the photosensitive member/transfer medium driving part 41*a* which drives the photosensitive member 21 and the intermediate transfer drum 41D into rotation in mutual synchronization. This controls acceleration/deceleration of a surface velocity of the photosensitive member 21 and a surface velocity V of the intermediate transfer drum 41D. Further, the CPU 121 executes establishment and storage of a registration control amount, updating of a sequence flag, registration control amount establish processing, etc., which will be described later, thus serving as an identification variable setting part, a registration control amount setting part, correction control part, etc., in the present invention.

The engine controller 12 also comprises, as a control circuit dedicated to control of the transfer unit 4, a transfer roller contact/separate control circuit 123 and a cleaner contact/separate control circuit 124, in addition to the photosensitive member/transfer medium drive control circuit 122. The transfer roller contact/separate control circuit 123, in accordance with an instruction signal from the CPU 121, controls a secondary transfer roller driving part 48*a* and causes the secondary transfer roller 48 to contact and leave the intermediate transfer drum 41D at appropriate timing. On the other hand, the cleaner contact/separate control circuit 124, in accordance with an instruction signal from the CPU 121, supplies a CB signal to a cleaner driving part 49*a* to thereby control the cleaner driving part 49*a* and cause the cleaning part 49 to contact and leave the intermediate transfer drum 41D at appropriate timing.

Denoted at 125 in FIG. 1 is a volatile memory, such as a RAM, which temporarily stores control data for controlling the engine part E, a calculation result at the CPU 121, etc. Denoted at 126 in FIG. 1 is a non-volatile memory, such as an EEPROM which can rewrite digital information, which stores a calculation program which is to be executed by the CPU 121.

A-2. Basic Operations

Figure 3:
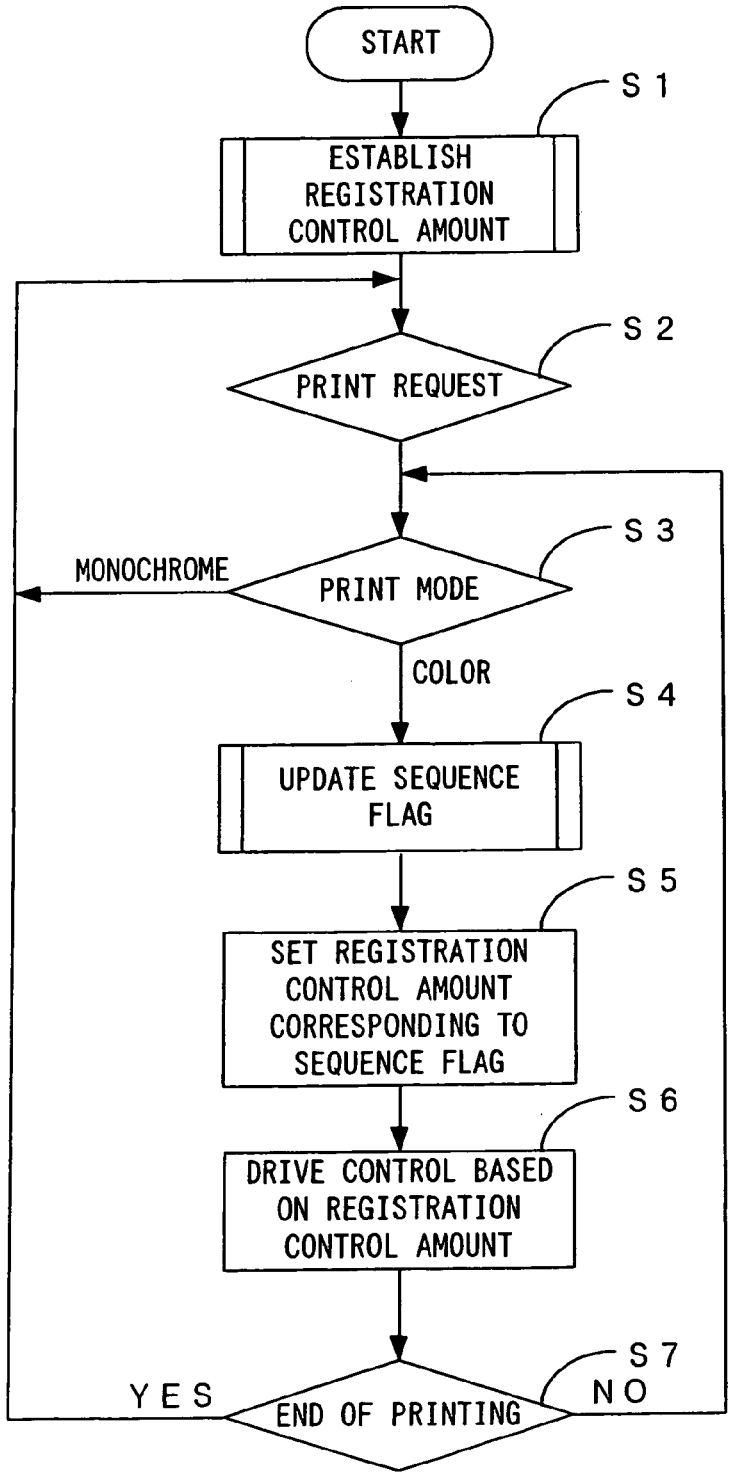
FIG. 3 is a flow chart showing basic operations in the image forming apparatus shown in FIG. 1.

FIG. 3 is a flow chart showing basic operations in the image forming apparatus which has such a structure as described above. In such an image forming apparatus, while various types of registration deviations are created as described in detail under the section "A-3. Analysis of Causes of Registration Deviation" later when the abutting means such as the secondary transfer roller 48 and the cleaning part 49 contacts the intermediate transfer drum 41D while the image create/transfer processing is repeated, transfer start positions are corrected by an amount equivalent to a registration control amount so that the registration deviations are suppressed and an image quality is accordingly improved.

In this image forming apparatus, as a power source of the apparatus is turned on, prior to actual processing of forming an image, three types of registration control amounts are automatically established through execution of registration control amount establish processing (step S1) and stored as initial registration control amounts in the memory 125 which serves as the memory means. In the first preferred embodiment, established as the three types of initial registration control amounts are the following registration control amounts Ra, Rb and Rc.

Ra: Resist control amount for correcting a registration deviation which is created as the cleaning part 49 contacts during primary transfer and the primary transfer is completed with the cleaning part 49 remains contacting Rb: Resist control amount for correcting a registration deviation which is created when the cleaning part 49 is in contact before the start of primary transfer during the image create/transfer processing, the primary transfer is started in this condition, and the cleaning part 49 moves away during the primary transfer.

Rc: Resist control amount for correcting a registration deviation which is created as the cleaning part 49 which is in contact starts moving away before primary transfer during the image create/transfer processing and the primary transfer is thereafter executed with the cleaning part 49 staying separated away The automatic establish processing (step S1) for establishing registration control amounts will be described in detail, under the section "A-4. Initial Registration Control Amount Establish Processing" later.

With the initial registration control amounts Ra to Rc established in this manner (Step S1), the sequence waits for an image signal from the external apparatus such as a host computer, namely, a print request (Step S2). As the print request is received, whether the requested print mode is monochrome printing or color printing is judged (Step S3), and when it is judged that the requested print mode is monochrome printing, the sequence executes normal image create processing without registration control and returns to the step S2. On the other hand, when it is judged at the step S3 that the requested print mode is color printing, one of three sequence flags F0, F1 and F2 which corresponds to a printing sequence state is selectively set (Identification variable setting step: Step S4). The step S4 will be described in detail under the section "A-5. Updating of Sequence Flag" later.

After setting up a registration control amount corresponding to the sequence flag (Resist control amount setting step: Step S5), for the image create/transfer processing in each toner color, the photosensitive member 21 is accelerated/decelerated under control during a predetermined acceleration/deceleration period, whereby a latent image forming position is shifted by the registration control amount in the sub scanning direction with respect to a reference latent image forming position (Correction step: Step S6). This also causes transfer positions of toner images which are primarily transferred onto the intermediate transfer drum 41D to shift by the registration control amount in the sub scanning direction. Registration deviations are suppressed by correcting the transfer start positions in this manner. This will be described in detail under the section "A-6. Correction of Transfer Start Position" later.

As creation of a color image is completed while suppressing registration deviations based on the registration control amount in this manner, whether the printing has completed or not is determined at a step S7. When it is judged that the printing has completed, the sequence returns to the step S2 to wait for the next print request. On the other hand, when it is judged that the printing has not completed, the sequence returns to the step S3 to repeat similar processing to that described above.

A-3. Analysis of Causes of Registration Deviation

Figure 4:
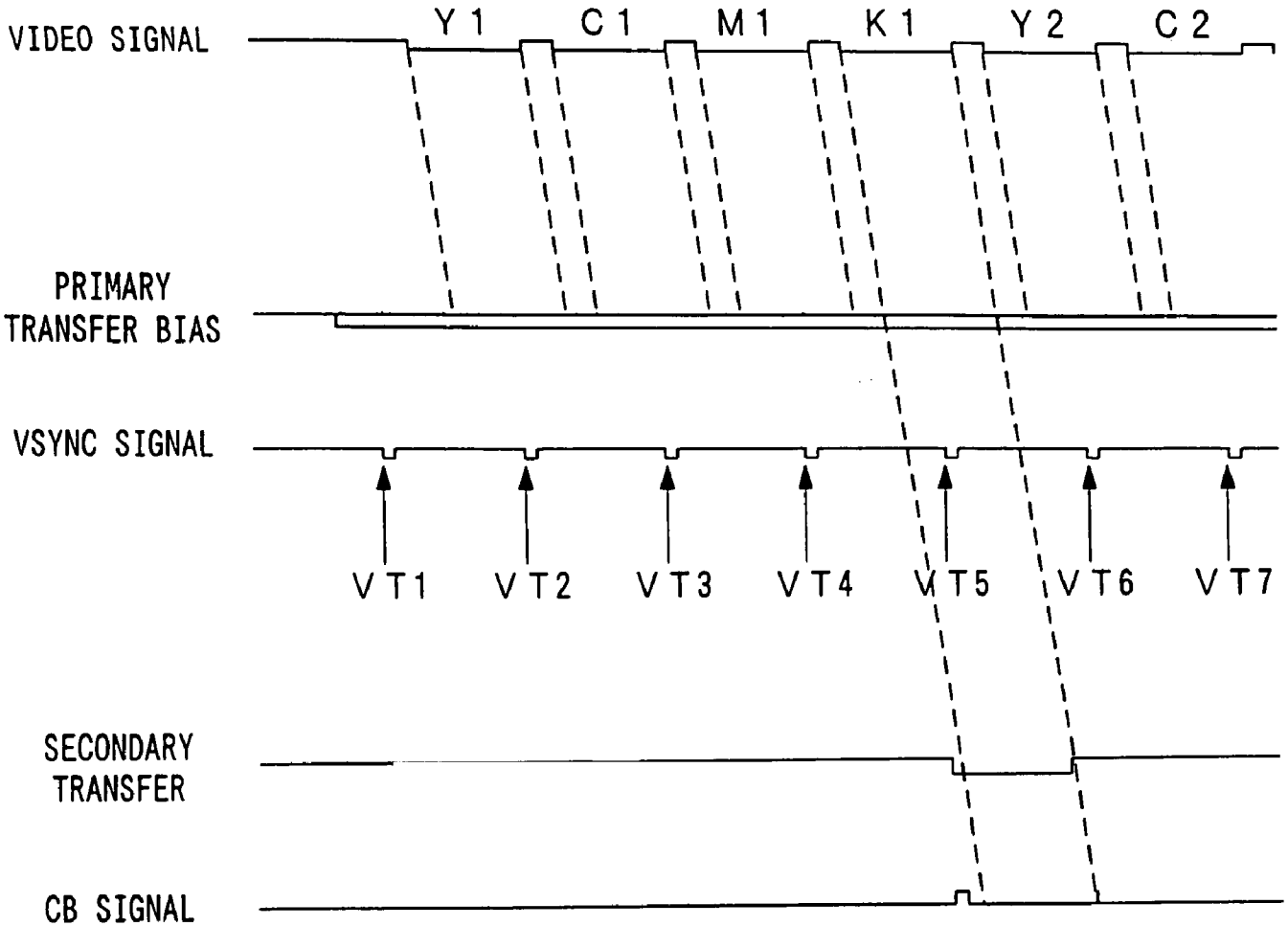
FIG. 4 is a timing chart showing one example of an operation sequence in the image forming apparatus according to the present invention.

This section will describe in detail, with reference to FIGS. 4 through 8, development of registration deviations in the case that the image forming apparatus shown in FIG. 1 operates in the operation sequence shown in FIG. 4 without correcting transfer start positions at all.

FIG. 4 is a timing chart showing one example of the operation sequence in the image forming apparatus which is shown in FIG. 1. As shown in FIG. 4, after the power source of the apparatus is turned on or as the image forming apparatus is released from a sleep mode, the intermediate transfer drum 41D is driven into rotation so that the vertical synchronizing signal VSYNC is outputted intermittently from the vertical synchronization reading sensor 40. As the vertical synchronizing signal VSYNC is outputted at timings VT1 through VT7, . . . , a yellow electrostatic latent image, a cyan electrostatic latent image, a magenta electrostatic latent image and a black electrostatic latent image are formed on the photosensitive member 21 repeatedly in this order. After the respective electrostatic latent images are formed, one of the developers 23Y, 23C, 23M and 23K selectively contacts the photosensitive member 21 and visualizes the associated electrostatic latent image which is on the photosensitive member 21, and the corresponding toner image is primarily transferred onto the intermediate transfer drum 41D. Hence, the toner images in the respective colors are created at a predetermined position, i.e., a reference latent image forming position on the photosensitive member 21, and primarily transferred at the same position onto the intermediate transfer drum 41D which rotates in synchronization with the photosensitive member 21 (the image create/transfer processing in the respective toner colors).

As the image create/transfer processing described above is repeated for the four colors, the toner images in the four colors are laid over with each other on the intermediate transfer drum 41D and a color image is formed. As the color image is obtained in this manner, the secondary transfer roller 48 contacts the intermediate transfer drum 41D with the sheet member S sandwiched in-between so that the color image is secondarily transferred onto the sheet member S, following which the cleaning part 49 contacts the intermediate transfer drum 41D in response to the CB signal to thereby remove the toner which remains on the drum surface. Such operations are repeated, whereby the sheet members S bearing color images are discharged one after another to a standard paper discharge tray.

This is the outline of the operations of the image forming apparatus in accordance with the operation sequence shown in FIG. 4. A relationship between such operations and a registration deviation amount in the sub scanning direction was studied, and different results were observed between the first sheet and the later sheets. As the different results are due to difference in operation sequences, an operation sequence for creating the first image (hereinafter the "first printing sequence") and an operation sequence for creating the second and subsequent images (hereinafter the "second printing sequence") will be described separately. Further, since this type of apparatus has a third printing sequence for idling, this will also be described.

A-3-1. First Printing Sequence

First, as the power source of the apparatus is turned on (or the image forming apparatus is released from a sleep mode), the intermediate transfer drum 41D is driven into rotation and the vertical synchronizing signal VSYNC is outputted sequentially at timings VT1 to VT3 from the vertical synchronization reading sensor 40. A yellow toner image Y1 is primarily transferred onto the intermediate transfer drum 41D at the first timing VT1, a cyan toner image C1 is primarily transferred over the yellow toner image Y1 on the intermediate transfer drum 41D at the timing VT2, and a magenta toner image M1 is primarily transferred over the yellow toner image Y1 and the cyan toner image C1 on the intermediate transfer drum 41D at the timing VT3. During this, neither cleaning of nor secondary transfer from the intermediate transfer drum 41D is executed, and the abutting means (the secondary transfer roller 48 and the cleaning part 49) remains away from the intermediate transfer drum 41D. Hence, these three toner images Y1, C1 and M1 are all laid one atop the other at the same position on the intermediate transfer drum 41D and accurately registered in the sub scanning direction. In short, transfer start positions of these three toner images Y1, C1 and M1 coincide with the reference transfer start position, and transfer rear end positions of the three toner images all coincide with a reference transfer rear end position.

Figure 5:
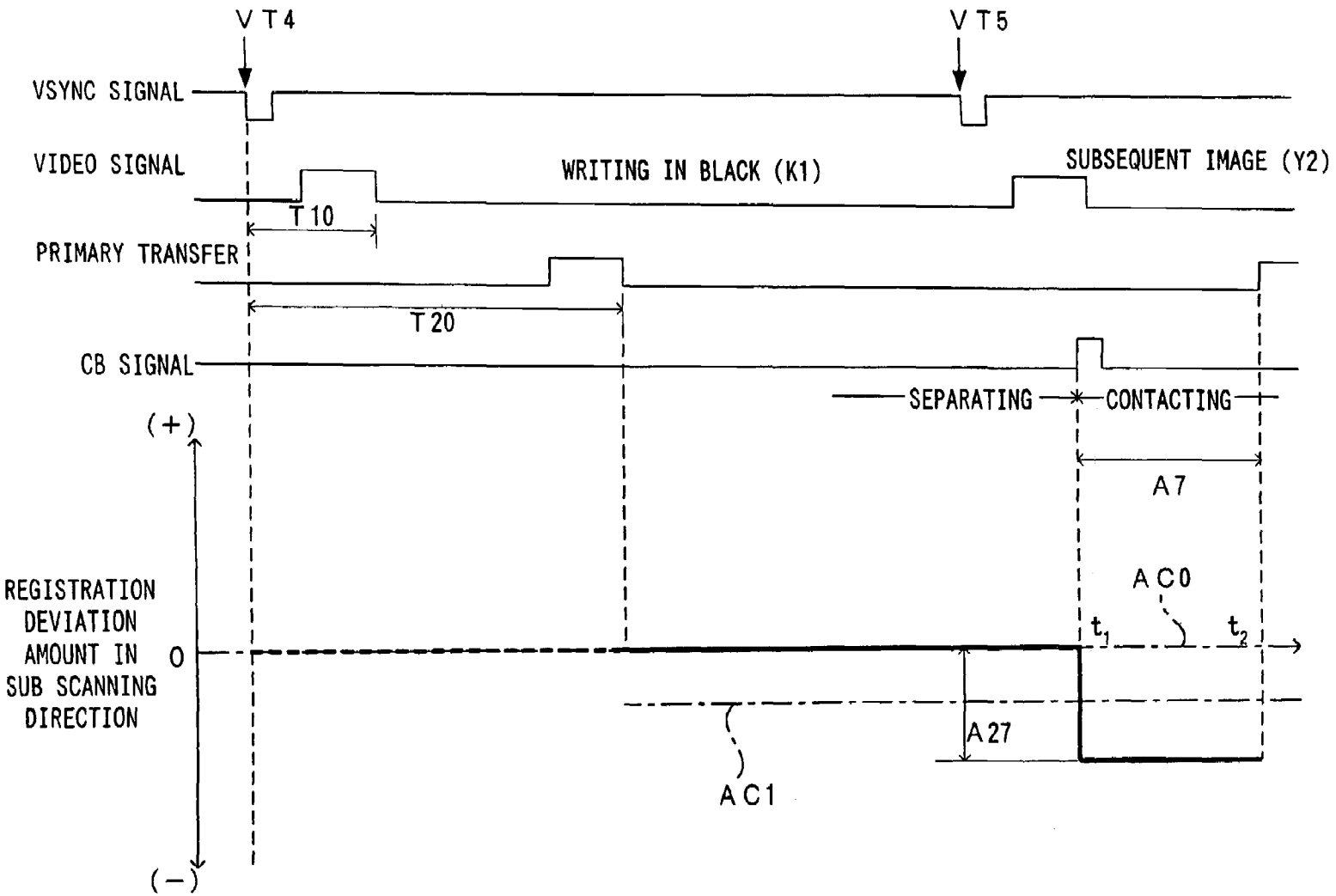
FIG. 5 is a drawing showing a state of a registration deviation which occurs in the image forming apparatus shown in FIG. 1 as a black toner image is transferred without registration control.
Figure 6:
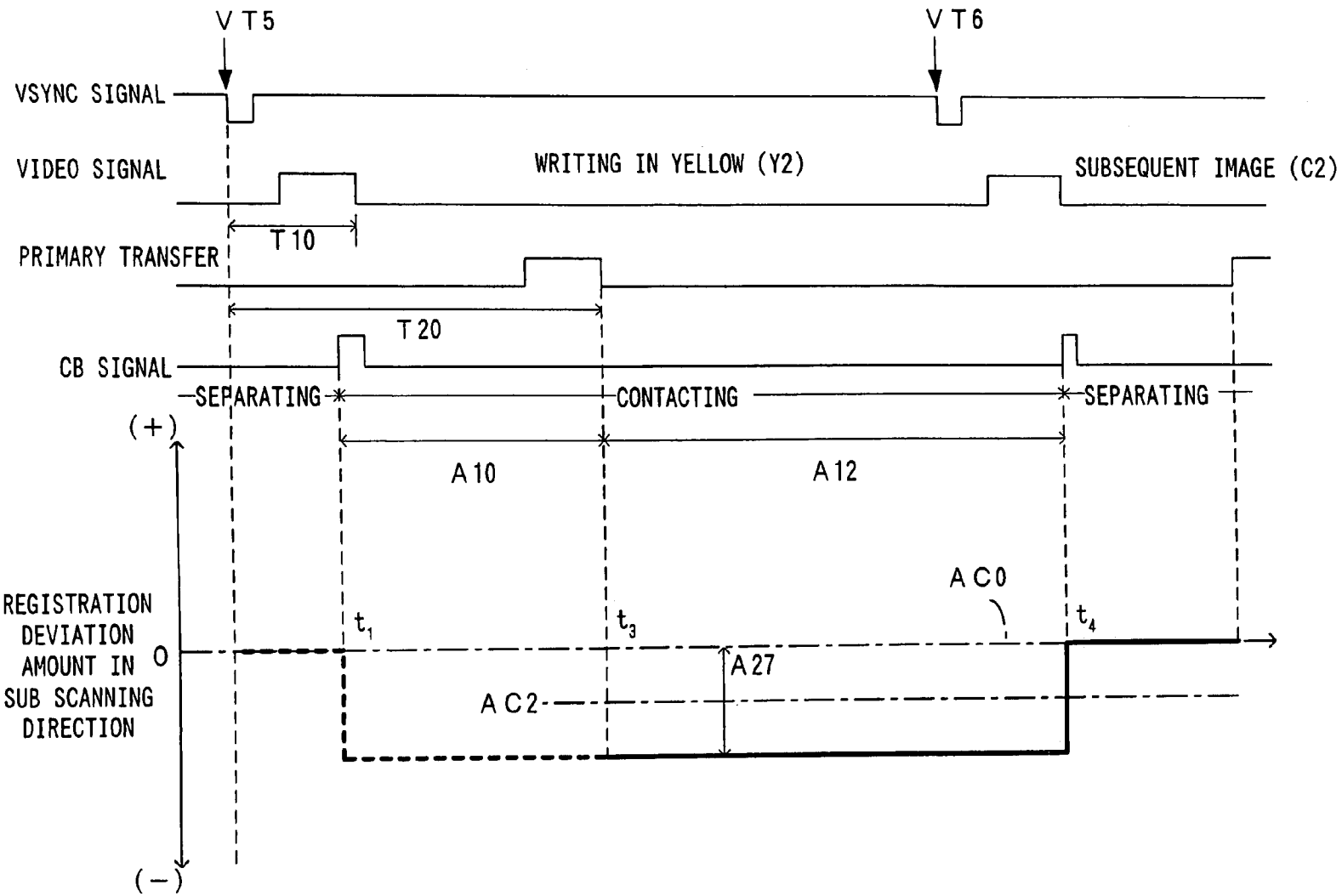
FIG. 6 is a drawing showing a state of a registration deviation which occurs in the image forming apparatus shown in FIG. 1 as a yellow toner image is transferred without registration control.

Next, as the vertical synchronizing signal VSYNC is outputted at the timing VT4, as shown in FIG. 5, a VIDEO signal is supplied to the exposure unit 3 after a predetermined period T10 so that while creating an electrostatic latent image corresponding to a black toner image K1 at a predetermined reference latent image forming position in a similar manner to that for the other toner colors, the electrostatic latent image is developed with the toner by the developer 23K for black. Primary transfer is then started after a predetermined period T20 since the outputting of the vertical synchronizing signal VSYNC (timing VT4). At this point, as in the case of the yellow toner image Y1, the cyan toner image C1 and the magenta toner image M1, the cleaning part 49 is away from the intermediate transfer drum 41D, and as a result, the transfer start position of the black toner image K1 coincides with the reference transfer start position as in the case of the other toner images Y1, C1 and M1. While the separated condition continues, the surface velocity V of the intermediate transfer drum 41D remains constant so that the black toner image K1 is laid over the other toner images Y1, C1 and M1 which have been already primarily transferred while accurately registered to the toner images Y1, C1 and M1.

However, at some point during the latter half of the primary transfer of the black toner image K1, i.e., timing t1, the CB signal for controlling the operations of the cleaning part 49 rises from an L level to an H level, which in turn causes the cleaning part 49 to abut on the intermediate transfer drum 41D to thereby deviate the black toner image K1 from the other toner images Y1, C1 and M1 in the sub scanning direction. In other words, the cleaning part 49 contacts the intermediate transfer drum 41D at the timing t1, serving as a transportation load upon the intermediate transfer drum 41D. The power transmission members 91 (FIG. 59), which apply the rotational drive force to the intermediate transfer drum 41D, are therefore elastically deformed, which instantaneously develops stretching A27 in the sub scanning direction. In consequence, a registration deviation having the registration deviation amount A27 is created in a (−) direction.

Further, while the intermediate transfer drum 41D is cleaned with the cleaning part 49 maintained contacting the intermediate transfer drum 41D since the timing t1 until the CB signal rises once again from the L level to the H level, the primary transfer of the black toner image K1 is continued until timing t2 in the still ongoing contacting condition. As a result, an eventual registration deviation amount of the black toner image K1 in the sub scanning direction becomes a deviation amount (−A27), the transfer rear end position of the black toner image K1 becomes deviated by the deviation amount A27 from the reference transfer rear end position in the (−) direction. In FIG. 5 (and later drawings for describing a state of a registration deviation), the thick solid lines represent registration deviations of toner images in the associated toner colors and the thick dotted lines are auxiliary lines for easier understanding of a state of development of a registration deviation condition.

In this manner, in the case of the first color image, only the black toner image K1 is deviated from the other toner images Y1, C1 and M1 in the latter half portion of the color image, and particularly in the rear-most portion, deviated by the deviation amount (−A27). More precisely, as shown in FIG. 5, as to the black toner image on the first sheet, a registration deviation in the sub scanning direction during creation and transfer of the image is in an amount within a deviation amount range of (A27/2) about the amplitude center AC1, each along the (+) side and the (−) side of the sub scanning direction, thereby leading to a deteriorated image quality. Although the secondary transfer roller 48 as well contacts the intermediate transfer drum 41D and generates a similar registration deviation before the cleaning part 49 contacts, a registration deviation amount attributed to this is smaller than that caused by the cleaning part 49. For easy understanding of the basic principles of the invention, therefore, a description will be continued ignoring registration deviations which are developed as the secondary transfer roller 48 contacts and leaves the intermediate transfer drum 41D.

A-3-2. Second Printing Sequence

Figure 7:
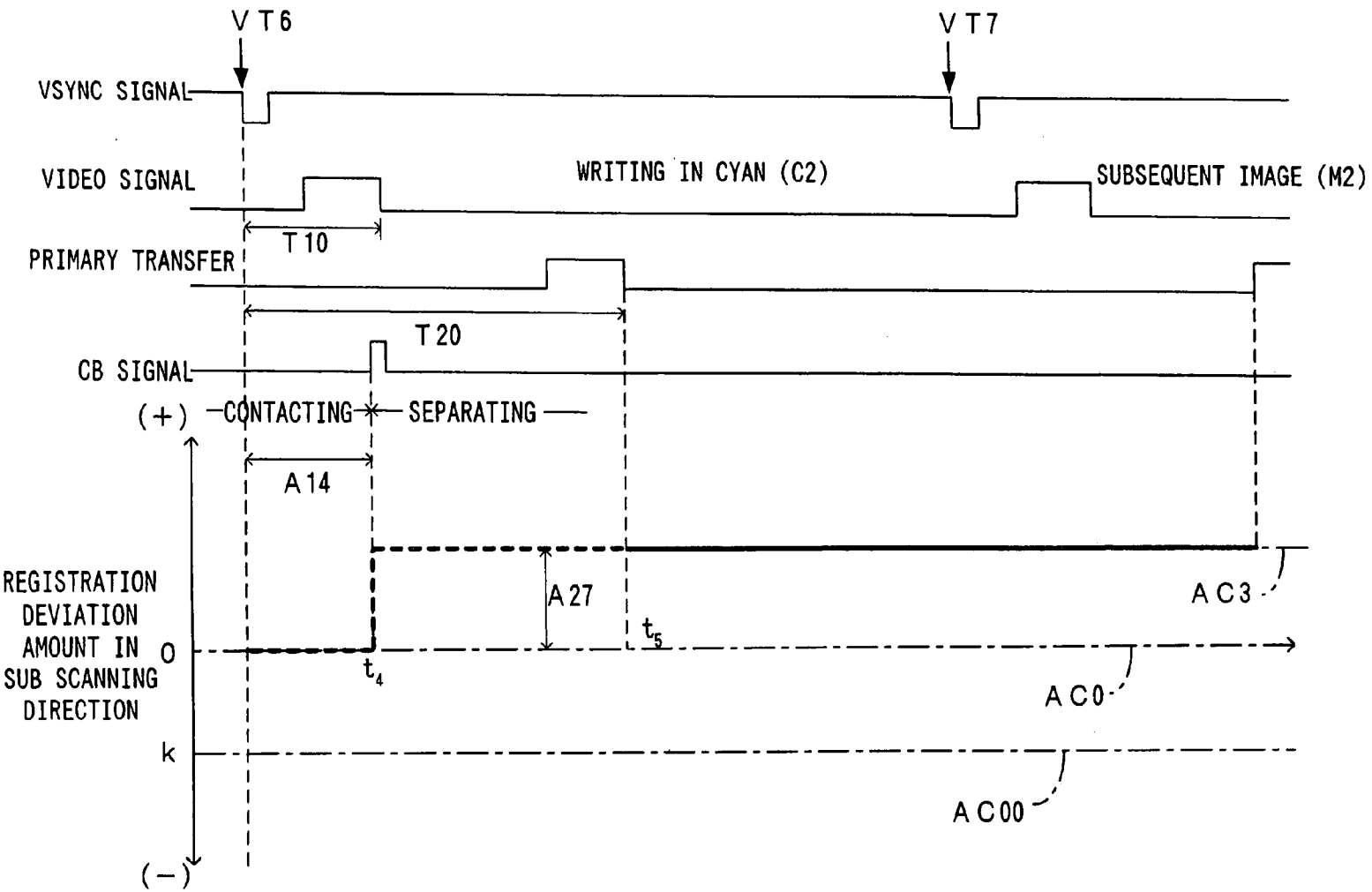
FIG. 7 is a drawing showing a state of a registration deviation which occurs in the image forming apparatus shown in FIG. 1 as a cyan toner image is transferred without registration control.

Such registration deviations are generated not only in the first color image but in the second color image as well. That is, in order to form a yellow toner image Y2 for the second color image, as shown in FIG. 7, after the predetermined period T10 since the outputting of the vertical synchronizing signal VSYNC at the timing VT5, a VIDEO signal for creating the yellow toner image Y2 is supplied to the exposure unit 3. Following this, while creating an electrostatic latent image corresponding to the yellow toner image Y2 on the photosensitive member 21, the electrostatic latent image is developed with the toner by the developer 23Y for yellow. Further, primary transfer is started after the predetermined period T20 since the outputting of the vertical synchronizing signal VSYNC (timing VT5), i.e., at timing t3.

However, after a while since the timing VT5 of outputting the vertical synchronizing signal VSYNC, as described above, the cleaning part 49 contacts the intermediate transfer drum 41D at the timing t1, the power transmission members 91 are elastically deformed, and the instantaneous stretching A27 is developed in the sub scanning direction. In addition, since the contacting condition continues until the CB signal next rises to the H level as described in detail later, at the primary transfer start timing t3, a registration deviation amount in the sub scanning direction is the deviation amount (−A27).

Further, since the entire circumference of the drum is cleaned up and the cleaning completes as the intermediate transfer drum 41D moves passed the cleaning part 49 and travelling approximately one round, the CB signal rises once again from the L level to the H level at the timing t4 and the cleaning part 49 leaves the intermediate transfer drum 41D. Since this removes the load applied upon the intermediate transfer drum 41D unlike in the contacting condition, the power transmission members 91 return to their original conditions and the registration deviation amount in the sub scanning direction becomes zero.

In the case of the second color image, the transfer start position of the yellow toner image Y2 is largely deviated from the reference transfer start position in this manner. In addition, while a deviation amount remains constant as the primary transfer progresses, as the cleaning part 49 moves away during the primary transfer at the timing t4, the registration deviation amount conversely returns to zero. In short, as shown in FIG. 7, with respect to the second yellow toner image Y2, a registration deviation in the sub scanning direction during creation and transfer of the image is in an amount within the deviation amount range of (A27/2) about the amplitude center AC2, each along the (+) side and the (−) side of the sub scanning direction, thereby leading to a deteriorated image quality.

Further, as to a cyan toner image C2 as well which is formed following the yellow toner image Y2, subjected to the influence of contact and separation of the cleaning part 49, the transfer start position is deviated from the reference transfer start position. Now, this phenomenon will be described with reference to FIG. 7.

For the purpose of creating the second cyan toner image C2, a VIDEO signal for forming the cyan toner image C2 is supplied to the exposure unit 3 after the predetermined period T10 since the outputting of the vertical synchronizing signal VSYNC at timing VT6. Following this, while creating an electrostatic latent image corresponding to the cyan toner image C2 on the photosensitive member 21, the electrostatic latent image is developed with the toner by the developer 23C for cyan. Primary transfer is started after the predetermined period T20 since the vertical synchronizing signal VSYNC was outputted (timing VT6), i.e., at timing t5.

At the timing VT6 of outputting the vertical synchronizing signal VSYNC, as described above, the cleaning part 49 is in contact with the intermediate transfer drum 41D, and the cleaning part 49 moves away from the intermediate transfer drum 41D at the timing t4 (at which the CB signal rises once again from the L level to the H level). In response, as described above, conversely to the contacting condition, the load applied upon the intermediate transfer drum 41D is removed, the power transmission members 91 return to their original conditions and the registration deviation amount in the sub scanning direction increases by the registration amount A27 in the (+) direction. The separating condition is maintained until the CB signal next rises to the H level from the L level again. As a result of this, at the primary transfer start timing (timing t5) for the cyan toner image C2, the registration deviation amount in the sub scanning direction becomes a deviation amount (+A27).

Thus, as to the second cyan toner image C2, a registration deviation in the sub scanning direction during creation and transfer of the image is in an amplitude amount of zero about the amplitude center AC3. Although the registration deviation amount does not change during the primary transfer, the amplitude center AC3 per se shifts in parallel by the deviation amount A27 in the sub scanning direction (+), which leads to a deteriorated image quality. In other words, with respect to the second toner color among the four toner colors, a registration deviation is generated although the abutting means (the secondary transfer roller 48 and the cleaning part 49) does not contact or move away from the intermediate transfer drum 41D during the primary transfer in the second toner color. Hence, for creation of a high-quality color image while suppressing registration deviations, how to suppress a registration deviation in the second toner color is important.

As the primary transfer of the cyan toner image C2 is completed in the manner described above, a magenta toner image M2 is formed and primarily transferred next. Since the cleaning part 49 stays away from the intermediate transfer drum 41D during this processing, a registration deviation is not created in the sub scanning direction and therefore a deviation amount is zero as in the case of the first sheet. Hence, as to the magenta toner image M2, a registration deviation in the sub scanning direction during creation and transfer of the image is in an amplitude amount of zero about an axis along which the registration deviation amount is zero (the alternate long and short dashed lines AC0 in FIG. 5, FIG. 7, etc.). From this, in an image forming apparatus which forms an image in the operation sequence shown in FIG. 4, a magenta toner image is used as a reference toner image, and the transfer start position and the transfer rear end position of the magenta toner image are used as the "reference transfer start position" and the "reference transfer rear end position," respectively.

Further, while a second black toner image is formed and primarily transferred after the primary transfer of the magenta toner image M2 is completed, in this case, the cleaning part 49 contacts the intermediate transfer drum 41D in mid course of the primary transfer as in the case of the first sheet, the power transmission members 91 is elastically deformed, the instantaneous stretching A27 is developed in the sub scanning direction, and a registration deviation is created along the (−) side in the sub scanning direction. A profile showing a change in registration deviation amount with respect to the operation sequence (hereinafter simply referred to as a "profile") is however the same as that shown in FIG. 5, and a registration deviation in the sub scanning direction during creation and transfer of the image is within the range of (A27/2) about the amplitude center AC1, each along the (+) side and the (−) side of the sub scanning direction, thereby leading to a deteriorated image quality.

Further, similar registration deviations to those in the second sheet described above are created as the third and subsequent color images are formed continuously following the second color image.

A-3-3. Third Printing Sequence

In this type of image forming apparatus, the intermediate transfer drum 41D needs run idle sometimes. For example, while the intermediate transfer drum 41D is allowed to run idle when an image signal from the external apparatus such as a host computer is received at or beyond a certain interval, the apparatus is stopped temporarily if it is necessary to run the intermediate transfer drum 41D idle twice or more. At this stage, the cleaning part 49 stays contacting the intermediate transfer drum 41D. To start creating a new image, the intermediate transfer drum 41D is driven into rotation and image creation is started. During primary transfer of the initial yellow toner image, a similar registration deviation to those in the second and subsequent cyan toner images shown in FIG. 7 is created.

Figure 8:
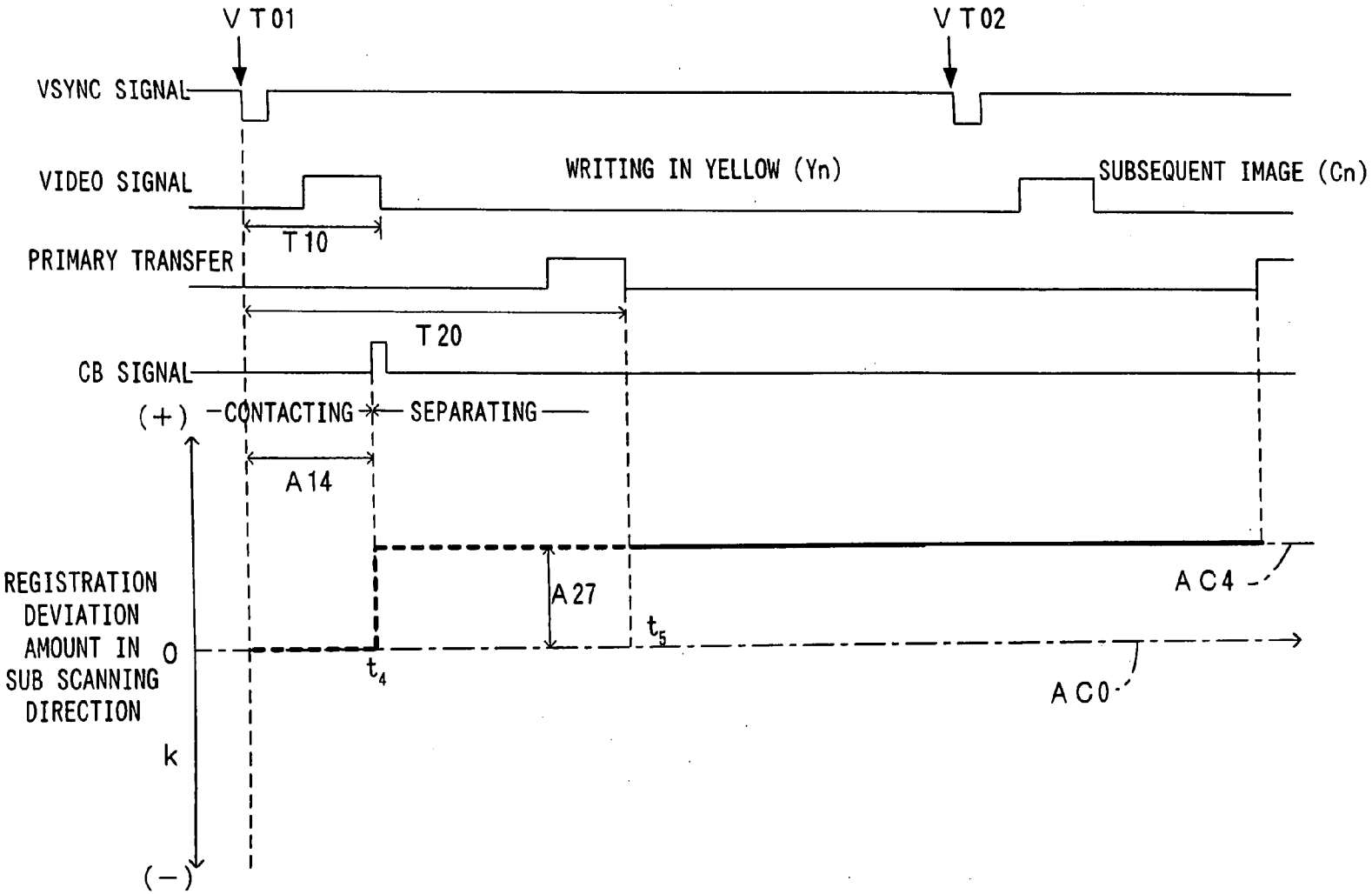
FIG. 8 is a drawing showing a state of a registration deviation which occurs in the image forming apparatus shown in FIG. 1 as a yellow toner image is transferred without registration control.

In short, as shown in FIG. 8, as the image creation is resumed and the intermediate transfer drum 41D is driven into rotation, the vertical synchronizing signal VSYNC is outputted at timing VT01 from the vertical synchronization reading sensor 40, and after the cleaning part 49 moves away from the intermediate transfer drum 41D in a certain period A14 from the timing VT01, primary transfer of the yellow toner image is started. Because of this, the transfer start position is deviated by the deviation amount A27 in the (+) direction for a similar reason to that described in relation to the cyan toner image C2 in the section "A-3-2. Second Printing Sequence" above. That is, a registration deviation in the sub scanning direction during creation and transfer of the image is in an amplitude amount of zero about the amplitude center AC4. While the registration deviation amount does not change during the primary transfer, the amplitude center AC4 itself shifts by the deviation amount A27 in parallel in the sub scanning direction (+), which leads to a deteriorated image quality.

Since subsequent primary transfer of a cyan and a magenta toner images is executed with the cleaning part 49 away from the intermediate transfer drum 41D, a registration deviation is not generated. However, as to a black toner image which is the last one, as in the first and the second printing sequences, the cleaning part 49 and the secondary transfer roller 48 abut on the intermediate transfer drum 41D during primary transfer and a registration deviation having the deviation amount A27 is accordingly created in the (−) direction.

As described above, as the abutting means such as the cleaning part 49 comes into contact with and moves away from the intermediate transfer drum 41D while the image create/transfer processing is repeated, a predetermined registration deviation amount is generated depending on the timing of contact and separation. As a profile of this itself is inherently determined by the apparatus structure, operation conditions, etc., the profile per se does not change unless the apparatus structure or the operation sequence is changed. Still, it is possible to reduce a registration deviation to zero or suppress a registration deviation in the reference toner image, by moving the transfer start positions for toner images in at least one or more toner colors in the sub scanning direction based on the registration deviation amount. For example, with respect to the cyan toner image C2, as shown in FIG. 7, since the transfer start position of the cyan toner image C2 has the deviation amount A27 in the (+) direction from the reference transfer start position while the registration deviation amount does not subsequently increase or decrease, it is possible to reduce the registration deviation amount to zero by controlling such that the transfer start position of the cyan toner image C2 shifts by the deviation amount A27 in the (−) direction.

Hence, in the first preferred embodiment, as described earlier, prior to actual image create processing, a registration deviation amount is calculated in advance through similar analysis to that described above from the apparatus structure, the operation sequences, etc., a registration control amount (which corresponds to A27 described above in relation to cyan, for example) which is necessary to reduce the registration deviation amount to zero or suppress the registration deviation amount is obtained, and the transfer start positions for toner images in at least one or more toner colors are corrected in the sub scanning direction based on the registration control amount during the actual image create processing, whereby registration deviations are suppressed and a high-quality image is formed. For instance, the amplitude center AC1 through AC4 for the toner colors (Y, C, K) except for the reference toner color (magenta) are matched with the amplitude center AC0 for the reference toner color, so that registration deviations are suppressed and a high-quality image is formed.

A-4. Initial Registration Control Amount Establish Processing

Figure 9:
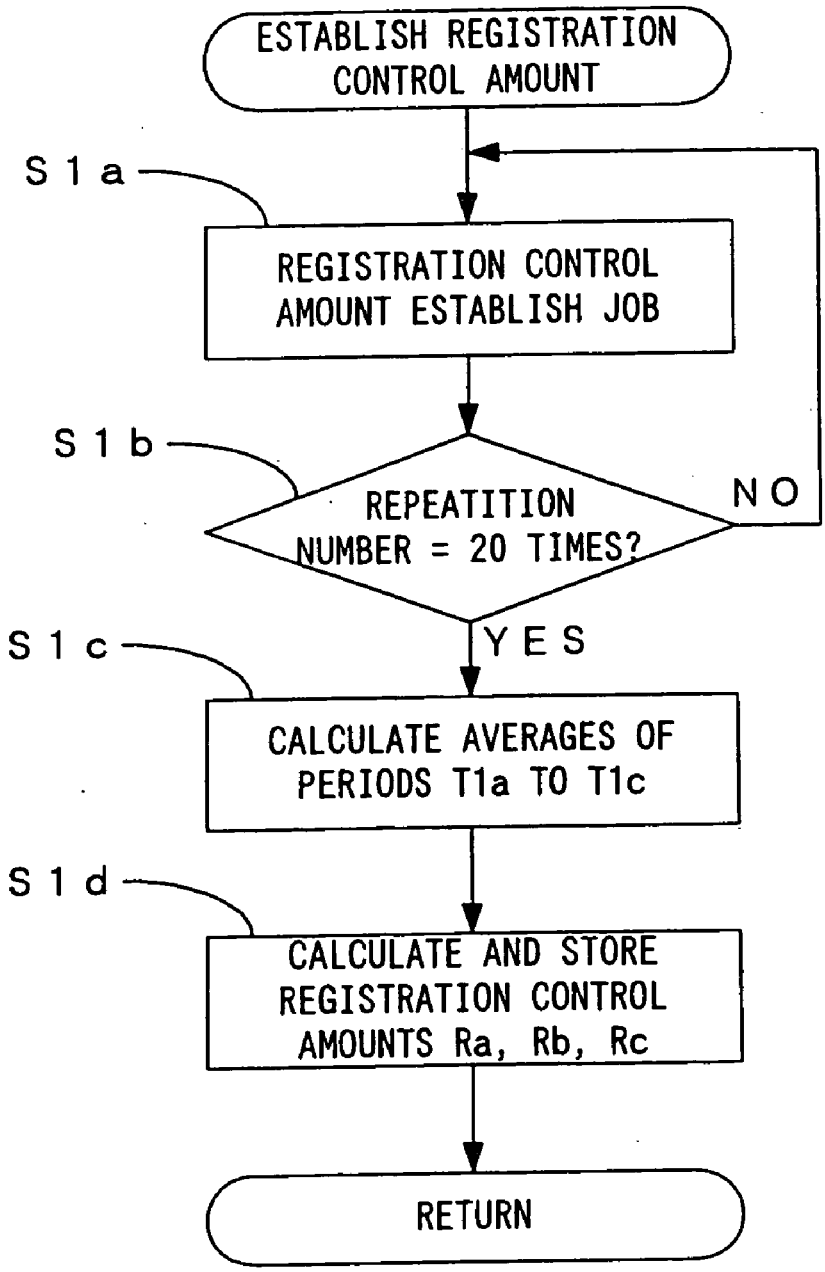
FIG. 9 is a flow chart showing processing for automatically establishing an initial registration control amount (registration control amount establish processing)
Figure 10:
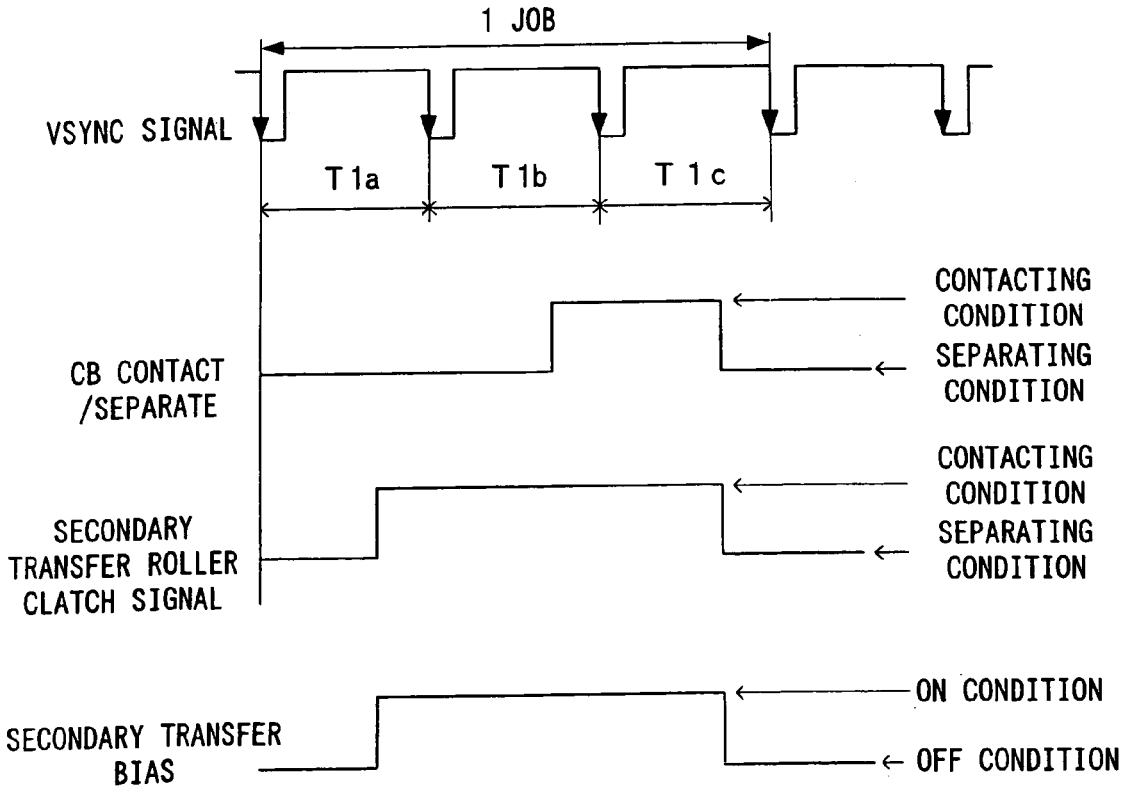
FIG. 10 is a timing chart showing a content of a registration control amount establish job.

FIG. 9 is a flow chart showing processing for automatically establishing an initial registration control amount (registration control amount establish processing). First, a process speed (the circumferential speed of the intermediate transfer drum 41D) A2 is set up in advance based on the apparatus structure and the operation sequences of the image forming apparatus according to the first preferred embodiment, and stored in the memory 125. As shown in FIG. 10, this is followed by, using the VSYNC signal as a reference, repetition for a predetermined number of times, e.g., twenty times (Step S1*b*) of a registration control amount establish job (Step S1*a*) in which contained as one job are:

(a) a period T1*a* during which the cleaning part 49 and the secondary transfer roller 48 remain separated away from the intermediate transfer drum 41D;

(b) a period T1*b* during which the cleaning part 49 and the secondary transfer roller 48 abut on the intermediate transfer drum 41D; and (c) a period T1*c* during which the cleaning part 49 and the secondary transfer roller 48 move away from the intermediate transfer drum 41D.

Further, in the first preferred embodiment, during repeated execution of the registration control amount establish job (Step S1*a*), incoming periodical data (the periods T1*a* to T1*c*) are stored in the memory 125. In addition, the electrifying bias and a primary transfer bias are always set ON condition during this. Although not shown in FIG. 1, a diselectrifying lamp is disposed between the primary transfer region TR1 and the photosensitive member cleaner blade 24 and is always set ON condition. Moreover, while the secondary transfer roller 48 remains abutting on the intermediate transfer drum 41D, a secondary transfer bias is applied so that the initial registration control amounts are obtained in a condition close to actual printing.

After twenty actual measurement values are obtained for the respective periods T1*a* to T1*c*, the periodical data are read from the memory 125 and average values T1*a*(av) to T1*c*(av) of the data are calculated (Step S1*c*). Further, the initial registration control amounts Ra, Rb and Rc are calculated from the formulas described below (Step S1*d*). Reasons of this will be described separately.

<Initial Registration Control Amount Ra>

As shown in FIG. 5, for example, the cleaning part 49 starts contacting the intermediate transfer drum 41D while the black toner image K1 is being primarily transferred onto the intermediate transfer drum 41D. A load variation is generated at the moment of the contact, thereby elastically deforming the power transmission members 91 (FIG. 59) which applies rotational drive force to the intermediate transfer drum 41D and developing the instantaneous stretching A27 in the sub scanning direction. The amount of the stretching A27 can be calculated by comparing the period T1*a* with the period T1*b*. That is, the instantaneous stretching A27 is calculated by the following formula:

$$A27=(T1b(av)-T1a(av))\times A2\times 1000$$

Hence, with the transfer start position shifted half this value in advance in the sub scanning direction, it is possible to minimize a registration deviation of the black toner image K1. Noting this, the initial registration control amount Ra is set as:

$$Ra=A27/2$$

in the first preferred embodiment.

<Initial Registration Control Amount Rb>

This is exactly the same as to the yellow toner image Y2, the black toner image K2 and the like. The initial registration control amount Rb is set as:

$$Rb=A27/2(=Ra)$$

<Initial Registration Control Amount Rc>

On the other hand, the cyan toner image C2, a yellow toner image Yn and the like have the registration deviation amount A27 already at the start of the primary transfer as described earlier. However, a deviation does not occur in the sub scanning direction during the primary transfer. Noting that it is possible to reduce registration deviations to zero in the cyan toner image C2, the yellow toner image Yn and the like by shifting in advance by this value (the registration deviation amount A27) in the (−) sub scanning direction, the initial registration control amount Rc is set as:

$$Rc=-A27$$

in the first preferred embodiment.

While the first preferred embodiment requires to (a) measure as a steady period the period T1*a* during which the cleaning part 49 and the secondary transfer roller 48 remain separated away from the intermediate transfer drum 41D, and (b) measure as a contact/separate period the period T1*b* during which the cleaning part 49 and the secondary transfer roller 48 abut on the intermediate transfer drum 41D, and calculate the respective registration control amounts Ra, Rb and Rc from a difference between these periods, the respective registration control amounts Ra, Rb and Rc may be calculated as described below. More precisely, this is (c) to measure as the contact/separate period the period T1*c* during which the cleaning part 49 and the secondary transfer roller 48 move away from the intermediate transfer drum 41D and calculate the respective registration control amounts Ra, Rb and Rc based on a difference from the period T1*a*.

An alternative may be (d) to measure as the steady period a period T1*d* during which the cleaning part 49 and the secondary transfer roller 48 stay abutting on the intermediate transfer drum 41D, and calculate the respective registration control amounts Ra, Rb and Rc based on a difference between the period T1*d* and the contact/separate period T1*b* or T1*c*.

As described above, since the registration control amount establish processing is executed in the dedicated sequence (FIG. 9) which is different from the printing sequences (FIG. 1) which are used for forming color images, it is possible to accurately calculate the registration control amounts Ra, Rb and Rc which are essential to highly precise registration control. This function and effect as well as various functions and effects described next are realized in a similar manner in later preferred embodiments as well.

While the configuration according to the first preferred embodiment is that the vertical synchronizing signal VSYNC which is the reference signal is outputted every time the intermediate transfer drum 41D rotates once, it is needless to mention that the present invention is applicable also to a configuration that a plurality of reference positions are set for the intermediate transfer drum 41D and the reference signal is outputted more than once while the intermediate transfer drum 41D rotates one time, for instance. In this configuration, in particular, it is possible to set each period short, and hence, reduce a time period which is necessary to establish the initial registration control amounts.

In addition, while the secondary transfer bias is applied while the secondary transfer roller 48 stays abutting on the intermediate transfer drum 41D during the establishment of the initial registration control amounts (the registration control amount establish processing), this is not an essential condition to establish the initial registration control amounts. The secondary transfer bias may not be applied or a bias having the opposite polarity to the secondary transfer bias may be applied instead, respectively for the following effects as described below. That is, where the secondary transfer bias is not applied, it is possible to simplify the establishment of the initial registration control amounts. Conversely, where the secondary transfer bias is applied, loads which are applied by the secondary transfer roller 48 upon the intermediate transfer drum 41D, the photosensitive member/transfer medium driving part 41*a* and the like become closer to loads applied during actual printing, and therefore, it is possible to accurately calculate the initial registration control amounts. Further, where a bias having the opposite polarity is applied, as the toner adhering to the secondary transfer roller 48 is transferred back to the intermediate transfer drum 41D, and the secondary transfer roller 48 is cleaned up thereby preventing the secondary transfer roller 48 from staining the back of the sheets, it is possible to obtain an excellent printing result.

Further, during the establishment of the initial registration control amounts described above, since the initial registration control amounts are calculated while applying the primary transfer bias to the intermediate transfer drum 41D in a condition which is close to that during actual printing, it is possible to accurately calculate the initial registration control amounts.

Still further, during the establishment of the initial registration control amounts described above, the registration control amount establish job (Step S1*a*) is repeated twenty times (Step S1*b*), the twenty actual measurement values are obtained for the respective periods T1*a* to T1*c*, and the initial registration control amounts are calculated based on these actual measurement values. However, the intermediate transfer drum 41D may not be rotating stable in some cases immediately upon driven. If the initial registration control amounts are calculated based on the periods T1*a* to T1*c* which are measured in such a condition, the accuracy of the initial registration control amounts may become lowered. An approach to overcome this problem may be to actually measure the respective periods T1*a* to T1*c* after the intermediate transfer drum 41D has rotated a few predetermined times since driven and come into stable rotation and to thereafter calculate the initial registration control amounts based on the actual measurement values. In this manner, it is possible to accurately calculate the initial registration control amounts.

A-5. Updating of Sequence Flag

Figure 11:
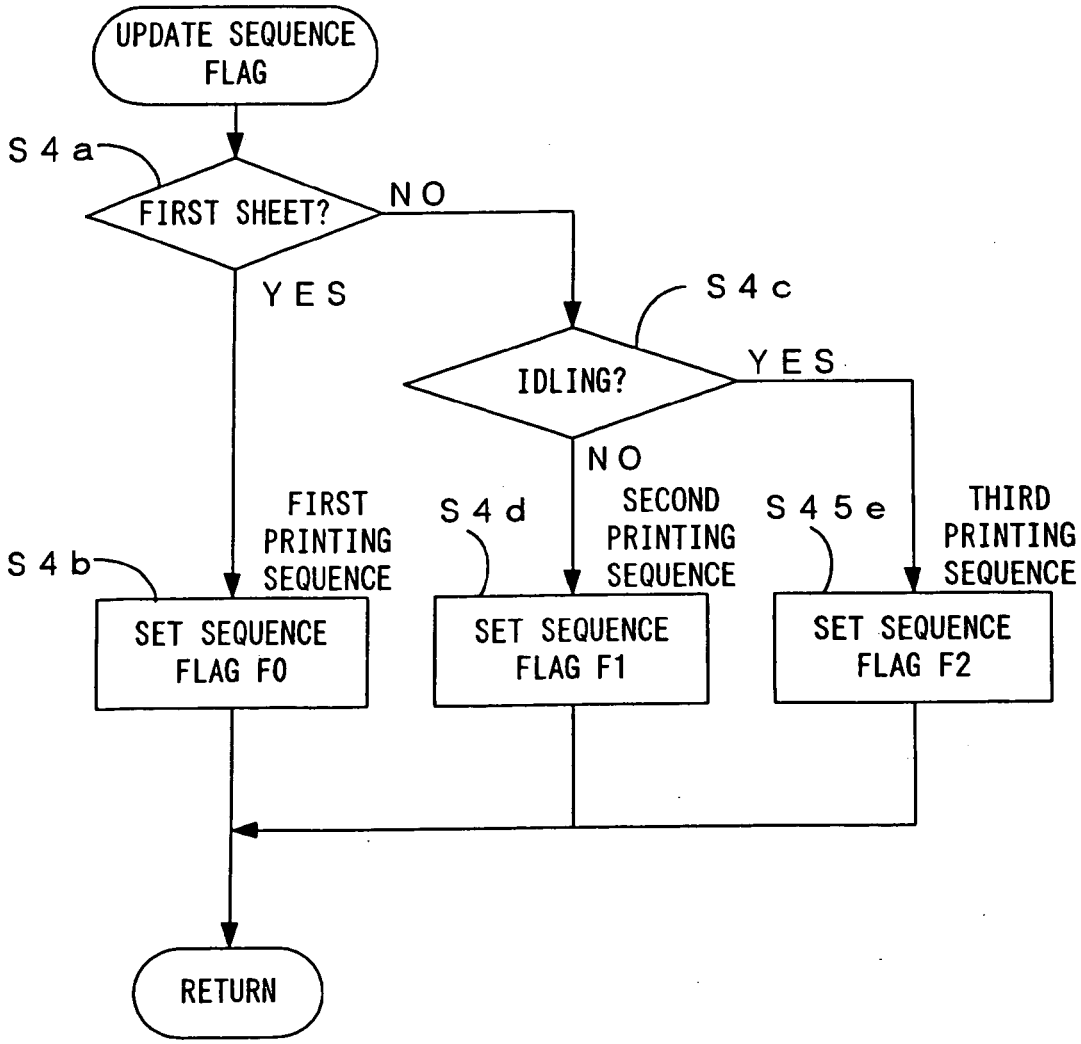
FIG. 11 is a flow chart showing an updated content of sequence flags in FIG. 3.

FIG. 11 is a flow chart showing an updated content of the sequence flags shown in FIG. 3. In the illustrated updating of the sequence flags, first, whether a print content is color printing on the first sheet or not is judged (Step S4*a*). When it is judged that the content is the first sheet, that is, when it is detected that the first printing sequence is to be executed, the sequence flag F0 is set up (Step S4*b*). On the other hand, when it is judged at the step S4*a* that the content is the second or later sheet, the sequence proceeds to a step S4*c* to judge whether idling is ongoing.

When idling is not ongoing, i.e., in the case of continuous printing, the sequence flag F1 is set up (Step S4*d*) as the second printing sequence is to be executed. On the other hand, when idling is ongoing, as the third printing sequence is to be executed, the sequence flag F2 is set up (Step S4*e*).

In the manner described above, the printing sequence is detected through the sequence flag updating (Step S4) and the corresponding sequence flag is set up and updated. The sequence flags F0, F1 and F2 are associated with the registration control amounts described above in the following manner.

<Sequence Flag F0: First Printing Sequence>

The first printing sequence, as shown in FIG. 11, is for printing in color on the first sheet, that is, creation of the first color image after the power source of the apparatus is turned on or release from the sleep mode. Upon turning on of the power source or release from the sleep mode, toner does not remain on the intermediate transfer drum 41D and it is therefore ready for the image create/transfer processing, and therefore, both the cleaning part 49 and the secondary transfer roller 48 stay away from the intermediate transfer drum 41D during primary transfer of the respective toner images in yellow, cyan and magenta for creation of the first color image. Registration deviations are not generated during the primary transfer of these. In contrast, as described in detail with reference to FIG. 5, during primary transfer of the black toner image, the cleaning part 49 and the secondary transfer roller 48 abut on the intermediate transfer drum 41D, thereby creating a registration deviation.

Noting this, in the first printing sequence, the flag F0 is set up. As shown in Table 1, "0" is set as the registration control amounts for the yellow toner image Y1, the cyan toner image C1 and the magenta toner image M1, whereas the control amount Ra is set as the registration control amount for the black toner image K1 in accordance with the sequence flag F0.

TABLE 1

| SEQUENCE FLAG | YELLOW Y | CYAN C | MAGENTA M | BLACK K |
|---|---|---|---|---|
| FLAG F0 | 0 | 0 | 0 | Ra |
| FLAG F1 | Rb | Rc | 0 | Ra |
| FLAG F2 | Rc | 0 | 0 | Ra |

<Sequence Flag F1: Second Printing Sequence>

The second printing sequence, as shown in FIG. 11, is for continuous printing in color on the second and subsequent sheets. As described in detail with reference to FIG. 7, on the second and subsequent sheets, a transfer start position of a yellow toner image shifts in the sub scanning direction, and a registration deviation amount changes during the primary transfer as the cleaning part 49 and the like contact and move away from the intermediate transfer drum 41D. While a cyan toner image is being formed and transferred as well, as described with reference to FIG. 7, the transfer start position shifts in the sub scanning direction. In addition, with respect to a black toner image as well, as in the case of the first sheet, the cleaning part 49 and the secondary transfer roller 48 abut on the intermediate transfer drum 41D during the primary transfer, thereby creating a registration deviation.

Noting this, in the second printing sequence, the flag F1 is set up. As shown in Table 1, the control amount Rb is set as the registration control amount for the yellow toner image Y2, the control amount Rc is set as the registration control amount for the cyan toner image C2 and "0" is set as the registration control amount for the magenta toner image M2, whereas the control amount Ra is set as the registration control amount for the black toner image K2 in accordance with the sequence flag F1.

<Sequence Flag F2: Third Printing Sequence>

The third printing sequence, as shown in FIG. 11, is for continuous printing in color on the second and subsequent sheets, yet with idling prior to the printing. Where idling intervenes, as creation of an n-th image ($n \geqq 2$) is started, as described earlier, the cleaning part 49 moves away from the intermediate transfer drum 41D after the vertical synchronizing signal VSYNC is outputted and the image create/transfer processing for yellow is started but prior to the primary transfer of a yellow toner image, and the transfer start position accordingly shifts in the sub scanning direction (FIG. 8). As the subsequent image create/transfer processing for a cyan and a magenta toner images is executed always with the cleaning part 49 staying away from the intermediate transfer drum 41D, registration deviations are not generated. However, as to a black toner image which is the last one, as in the first and the second printing sequences, the cleaning part 49 and the secondary transfer roller 48 abut on the intermediate transfer drum 41D during the primary transfer and a registration deviation is created.

Noting this, in this printing sequence, the flag F2 is set up. As shown in Table 1, the control amount Rc is set as the registration control amount for the yellow toner image and "0" is set as the registration control amounts for the cyan toner image and the magenta toner image, whereas the control amount Ra is set as the registration control amount for the black toner image in accordance with the sequence flag F2.

A-6. Correction of Transfer Start Position

In reality, while color images are serially printed starting with the first one, transfer start positions are corrected and registration deviations are suppressed as described below. For printing of the first color image, since the flag F0 which corresponds to the first printing sequence is set up at the step S4 shown in FIG. 3, at the step S5 shown in FIG. 3, "0" is set as the registration control amounts for the yellow toner image Y1, the cyan toner image C1 and the magenta toner image M1, whereas the initial registration control amount Ra is set as the registration control amount for the black toner image K1. Hence, the yellow toner image Y1, the cyan toner image C1 and the magenta toner image M1 are all formed at a predetermined position on the photosensitive member 21, i.e., at the reference latent image forming position, and primarily transferred at the same position onto the intermediate transfer drum 41D which rotates in synchronization with the photosensitive member 21. In consequence, the transfer start positions of the three toner images Y1, C1 and M1 all coincide with the reference transfer start position, and so do the transfer rear end positions of the three toner images with the reference transfer rear end position.

Figure 12:
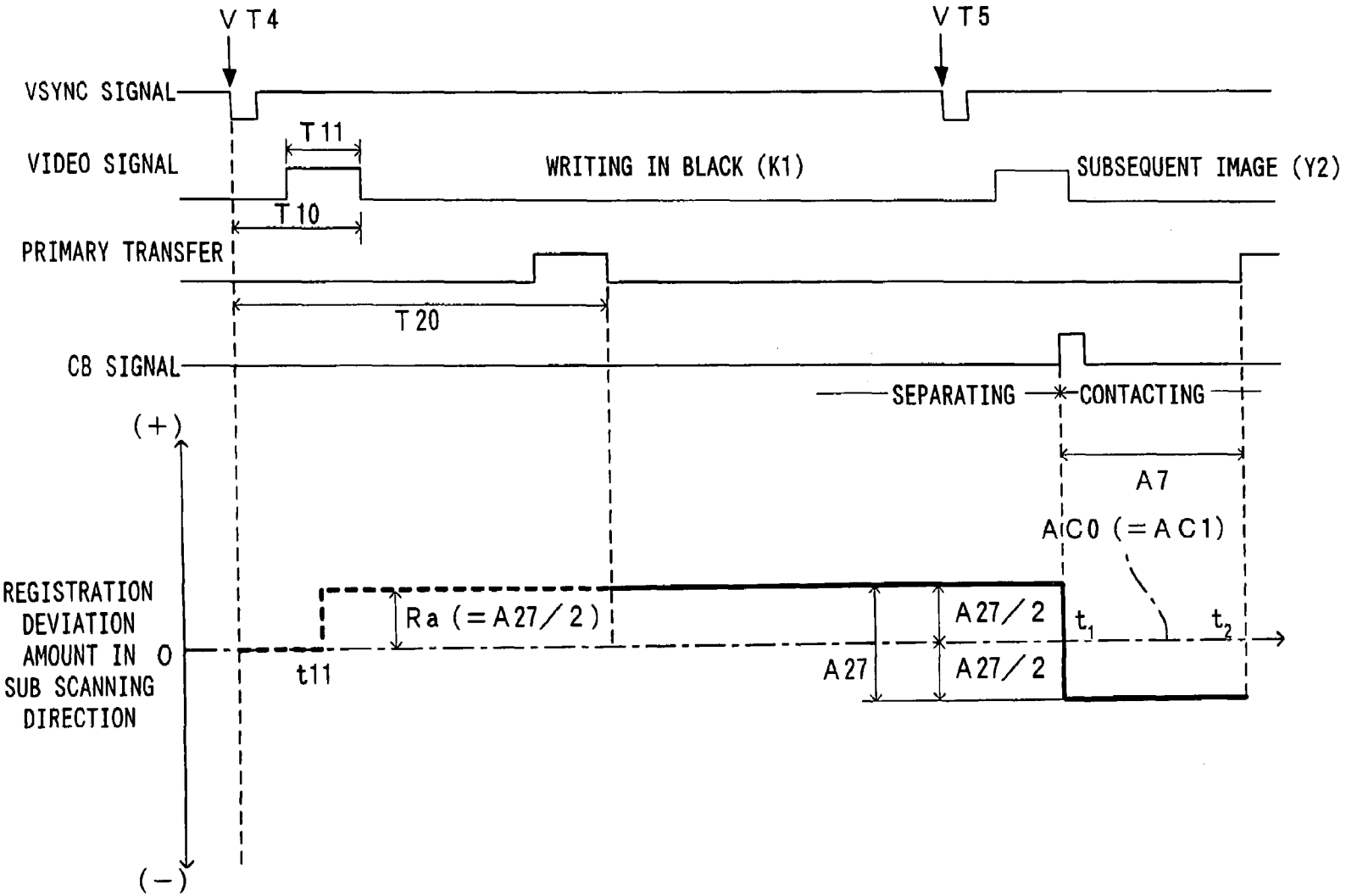
FIG. 12 is a drawing showing a content of registration control for transfer of a black toner image in the image forming apparatus shown in FIG. 1.

On the other hand, as to the black toner image K1, since the initial registration control amount Ra is set as the registration control amount, as shown in FIG. 12, using the vertical synchronizing signal VSYNC outputted at the timing VT4 as a reference, the photosensitive member 21 is accelerated/decelerated under control at timing t11 of an acceleration/deceleration period T11, whereby the latent image forming position for the black toner image is shifted by the control amount Ra (=A27/2) from the reference latent image forming position toward the (+) side of the sub scanning direction. The "acceleration/deceleration period" as herein referred to means a period during which the VIDEO signal stays at the H level and the exposure processing is suspended. Further, while the immediately precedent toner image (the magenta toner image M1) is still being primarily transferred during the acceleration/deceleration period T11, since the intermediate transfer drum 41D is driven under control in synchronization with the photosensitive member 21 in the first preferred embodiment, the toner image which is primarily transferred in parallel with the controlled acceleration/deceleration of the photosensitive member 21 and the intermediate transfer drum 41D is not disturbed.

The latent image formed on the photosensitive member 21 in the manner above is visualized by the developer 23K, and the resulting black toner image K1 is primarily transferred onto the intermediate transfer drum 41D. As a result, the transfer start position of the black toner image K1 is shifted by the registration control amount Ra from the reference transfer start position in the (+) direction.

The primary transfer progresses, and at the timing t1 at the beginning of the latter half of this, as shown in FIG. 12, the CB signal which controls the operations of the cleaning part 49 rises from the L level to the H level. While this causes the cleaning part 49 to abut on the intermediate transfer drum 41D, thereby shifting the black toner image K1 from the other toner images Y1, C1 and M1 in the sub scanning direction, an eventual registration deviation amount of the black toner image K1 in the sub scanning direction becomes the deviation amount (A27/2) along the (−) direction. That is, with the transfer start position of the black toner image K1 shifted by the registration control amount Ra from the reference transfer start position in the (+) direction, the amplitude center AC1 for the black color is matched with the amplitude center AC0 for the magenta color which is the reference toner color, which in turn matches the amplitude center of registration deviations in the respective toner colors in the sub scanning direction with each other during the image create/transfer processing in all toner colors.

As a result, in the first preferred embodiment, the black toner image K1 is shifted by the deviation amount (A27/2) on the transfer start side from the other toner images Y1, C1 and M1 in the (+) direction, but is shifted by the deviation amount (A27/2) on the transfer rear end side from the other toner images in the (−) direction. Therefore, a maximum deviation amount is half that in the case where the registration control is not performed (FIG. 5).

Next, for creation of the second color image following the first color image (the second printing sequence), after the sequence flag F1 is set up as the sequence flag at the step S4 in FIG. 3, a high-quality image is formed while suppressing registration deviations in the manner described below.

That is, registration deviation amounts corresponding to the sequence flag F1 are set at a step S5. More precisely, the initial registration control amount Rb (=A27/2) is set as the registration control amount for the yellow toner image Y2, the initial registration control amount Rc (=−A27) is set as the registration control amount for the cyan toner image C2, "0" is set as the registration control amount for the magenta toner image M2, and the initial registration control amount Ra (=A27/2) is set as the registration control amount for the black toner image K2. The registration control is then performed on the respective toner images.

Figure 13:
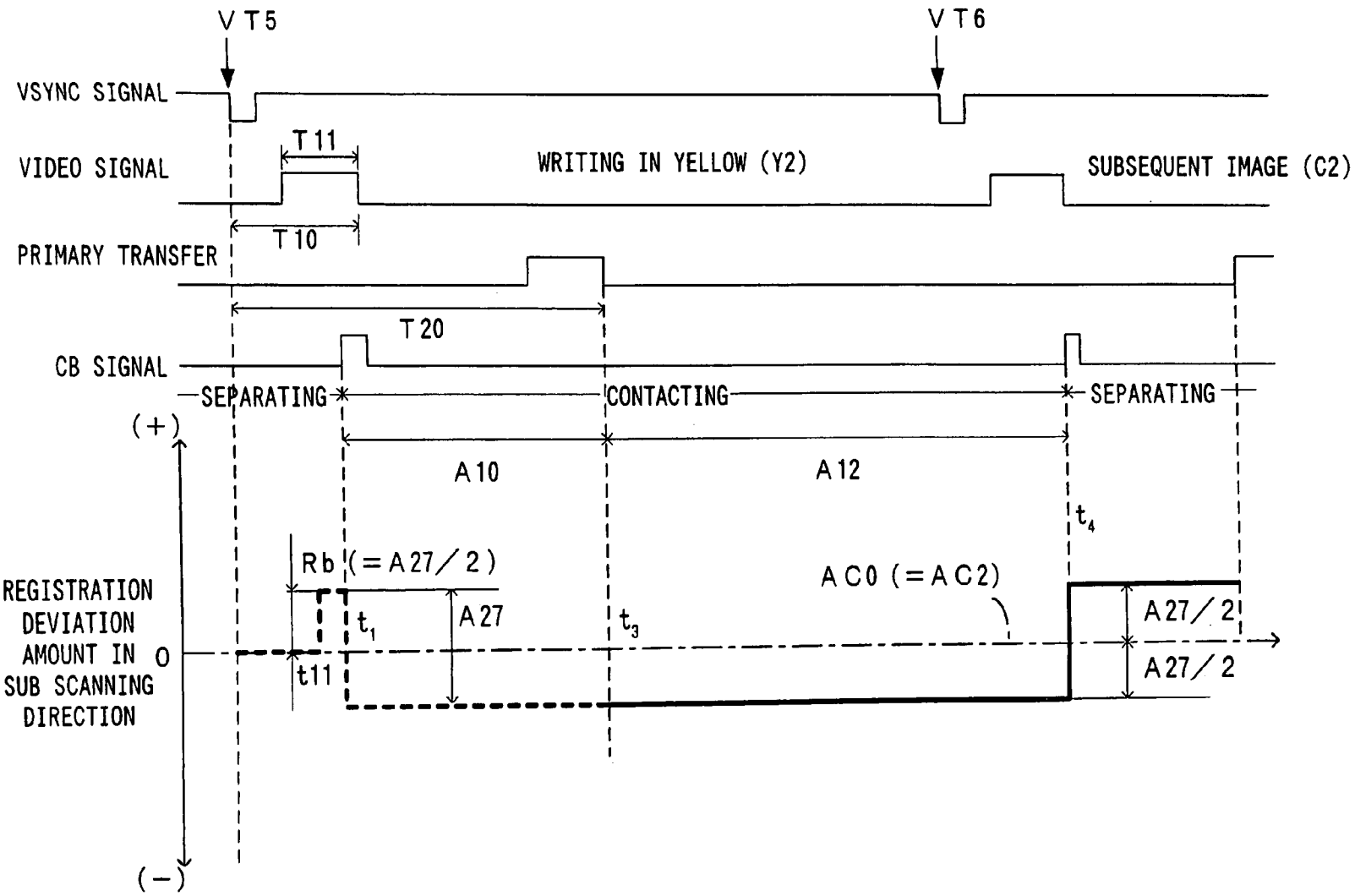
FIG. 13 is a drawing showing a content of registration control for transfer of a yellow toner image in the image forming apparatus shown in FIG. 1.

First, as to the yellow toner image Y2, since the initial registration control amount Rb is set as the registration control amount, as shown in FIG. 13, using the vertical synchronizing signal VSYNC outputted at the timing VT5 as a reference, the photosensitive member 21 is accelerated/decelerated under control at the timing t11 of the acceleration/deceleration period T11, whereby the latent image forming position for the yellow toner image is shifted by the control amount Rb (=A27/2) from the reference latent image forming position toward the (+) side of the sub scanning direction. The latent image is thereafter visualized by the developer 23Y.

The CB signal rises from the L level to the H level at the timing t1, and as the cleaning part 49 which used to be away contacts the intermediate transfer drum 41D, the power transmission members 91 (FIG. 59) are elastically deformed to thereby develop the stretching A27, so that a registration deviation amount in the sub scanning direction at the primary transfer start timing t3 is the deviation amount (−A27/2). As the cleaning part 49 moves away from the intermediate transfer drum 41D in the latter half of the primary transfer of the yellow toner image Y2, the power transmission members 91 return to their original conditions to thereby change the registration deviation in the (+) direction, and the deviation amount in the yellow toner image Y2 on the transfer rear end side eventually becomes (+A27/2). As a result, as in the case of the black toner image K1, a maximum deviation amount is half that where the registration control is not performed (FIG. 7), thus more largely reducing the maximum deviation amount relative to the reference toner image (the magenta toner image M2) than where the registration control is not performed (FIG. 7).

As described above, in this preferred embodiment, as the latent image forming position on the photosensitive member 21 is shifted by the registration control amount Rb from the reference latent image forming position in the sub scanning direction, the transfer start position of the second yellow toner image Y2 is adjusted. This matches the amplitude center AC2 for the yellow color with the amplitude center AC0 for the magenta color which is the reference toner color. Hence, it is possible to suppress a deviation amount from the reference toner image (the magenta toner image M2) within the range of (A27/2).

Figure 14:
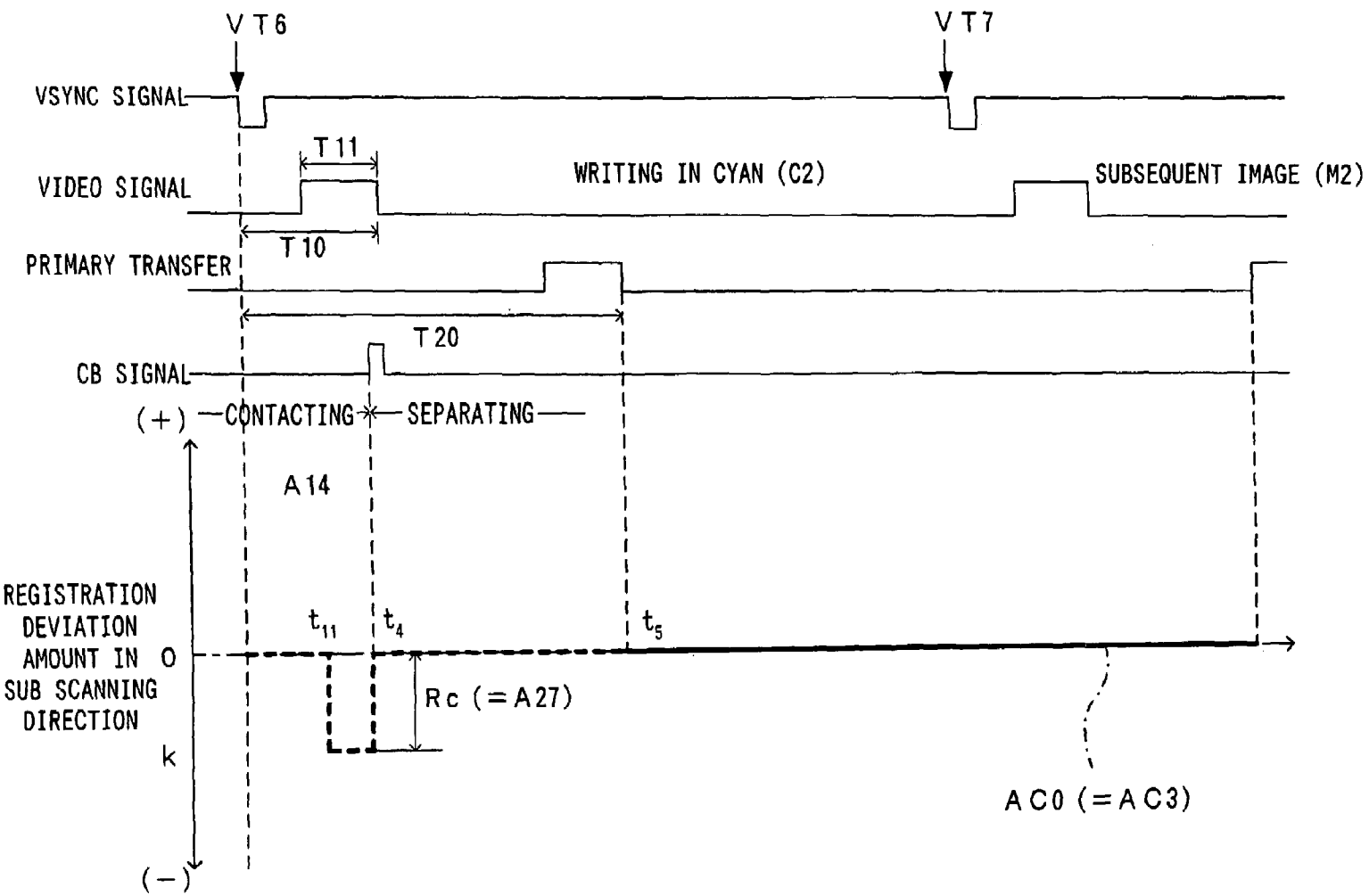
FIG. 14 is a drawing showing a content of registration control for transfer of a cyan toner image in the image forming apparatus shown in FIG. 1.

The image create/transfer processing for the cyan toner image C2 is executed following the second yellow toner image Y2, for which the initial registration control amount Rc (=−A27) is set as the registration control amount for the cyan toner image C2. Hence, as shown in FIG. 14, using the vertical synchronizing signal VSYNC outputted at the timing VT6 as a reference, at the timing t11 of the acceleration/deceleration period T11, the surface velocity of the photosensitive member 21 and the surface velocity V of the intermediate transfer drum 41D are slowed down temporarily, thereby reducing the amount of rotation of the photosensitive member 21 and the amount of travelling of the intermediate transfer drum 41D by the deviation amount A27 as compared to where these rotate at a constant speed (that is, as compared to the reference toner image, namely, the magenta toner image). In consequence, the latent image forming position on the photosensitive member 21 is shifted by the registration control amount Rc from the reference latent image forming position in the sub scanning direction.

Following this, the developer 23C visualizes the latent image which is formed on the photosensitive member 21 as described above, and the resulting cyan toner image C2 is primarily transferred onto the intermediate transfer drum 41D. Hence, the registration deviation amount (A27) due to contacting and leaving of the cleaning part 49 coincides with the shift amount Rc of the toner image C2 on the photosensitive member 21, which in turn matches the transfer start position of the cyan toner image C2 with the reference transfer start position.

Further, since the CB signal rises from the L level to the H level at the timing t4 which comes before the start of the primary transfer of the cyan toner image C2 onto the intermediate transfer drum 41D and the cleaning part 49 which used to contact the intermediate transfer drum 41D moves away from the intermediate transfer drum 41D, a registration deviation is not created during the primary transfer. Because of this, the transfer rear end position of the cyan toner image C2 coincides with the transfer rear end position.

As described above, in this preferred embodiment, as the photosensitive member 21 and the intermediate transfer drum 41D are accelerated/decelerated under control based on the registration control amount Rc, the amplitude center AC3 for the cyan color is matched with the amplitude center AC0 for the magenta color which is the reference toner color. Hence, it is possible to suppress a deviation amount to the reference toner image (the magenta toner image M2) to zero.

The image create/transfer processing for the magenta toner image M2 is executed following the cyan toner image C2, during which neither the cleaning part 49 nor the secondary transfer roller 48 ever abut or move away and the transfer start position and the transfer rear end position of the magenta toner image M2 coincide respectively with the reference transfer start position and the transfer rear end position.

As the toner images Y2, C2 and M2 in the three colors are completed, the image create/transfer processing in the last toner color, i.e., for the black toner image K2 is executed. During this image create/transfer processing, as in the case of the first black toner image K1, as the latent image forming position on the photosensitive member 21 is shifted by the registration control amount Ra in the sub scanning direction, the amplitude center AC1 for the black color is matched with the amplitude center AC0 for the magenta color which is the reference toner color.

Hence, there is a deviation (A27/2) on the transfer start side from the reference toner image in the (+) direction and a deviation (A27/2) on the transfer rear end side from the reference toner image in the (−) direction. Therefore, a maximum deviation amount is half that where the registration control is not performed (FIG. 5).

In this manner, as to the second sheet, for all toner colors, the surface velocity of the photosensitive member 21 and the surface velocity of the intermediate transfer drum 41D are accelerated/decelerated in synchronization under control based on the registration control amounts for the respective toner colors in such a manner that the amplitude center of registration deviations in the sub scanning direction for the respective toner colors match with each other during the transfer processing, whereby the transfer start positions of the toner images are corrected. In short, with respect to the three colors of yellow (Y), cyan (C) and black (K) among the four toner colors, the transfer start positions of the toner images are corrected based on the registration control amounts. As a result, the cyan toner image C2 is registered completely to the magenta toner image M2 which is the reference toner image, and although the yellow toner image Y2 and the black toner image K2 may not be registered completely to the reference toner image, registration deviation amounts of the yellow toner image Y2 and the black toner image K2 are suppressed to minimum, which makes it possible to form a high-quality image.

Meanwhile, when the sequence flag F2 is set up, the initial registration control amount Rc is set as a registration control amount for a yellow toner image Yn, "0" is set as registration control amounts for a cyan toner image Cn and a magenta toner image Mn, and the initial registration control amount Ra is set as a registration control amount for a black toner image Kn. The registration control is thereafter executed for each toner image.

Figure 15:
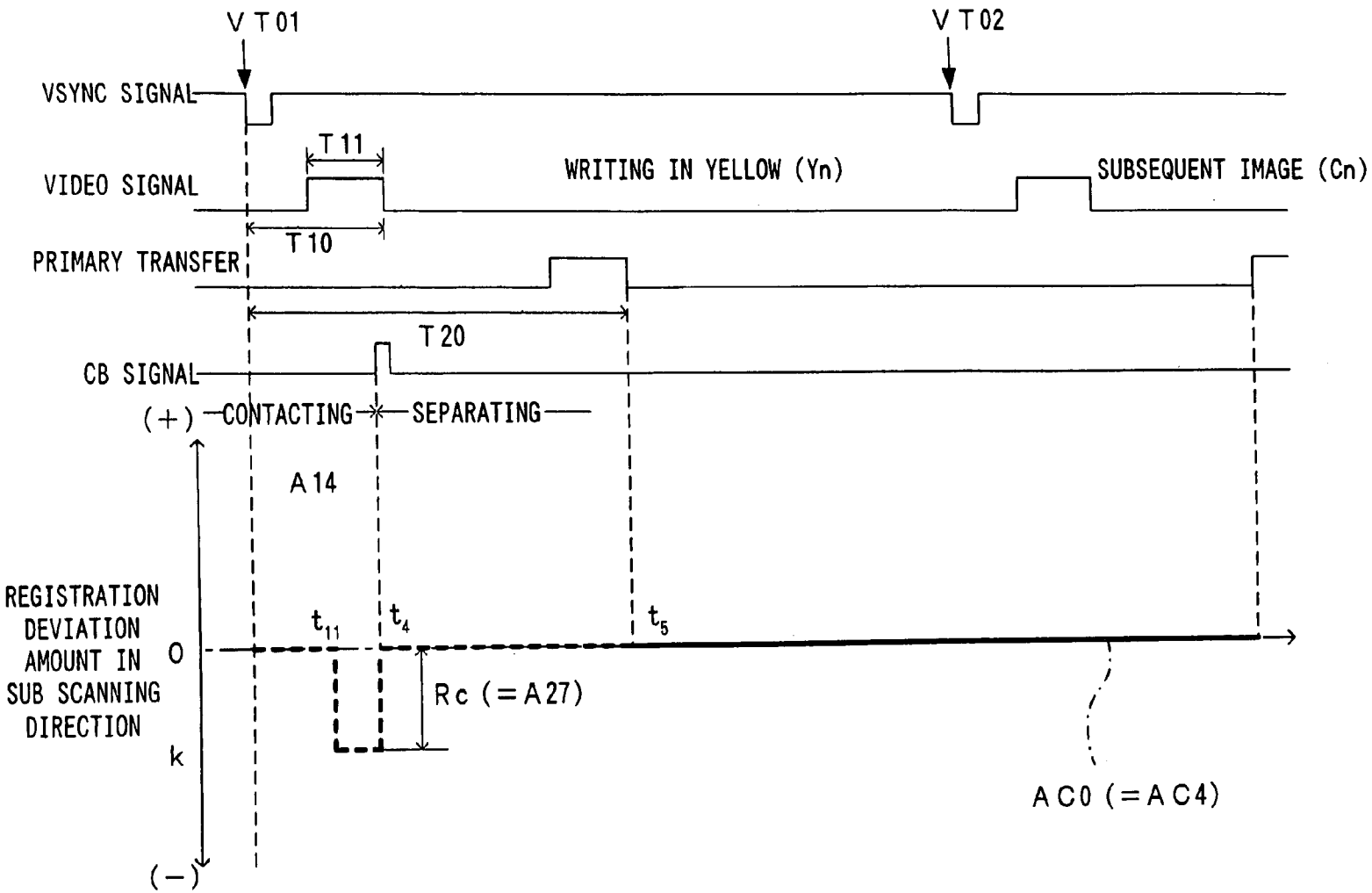
FIG. 15 is a drawing showing a content of registration control for transfer of a yellow toner image in the image forming apparatus shown in FIG. 1.

First, as to the yellow toner image Yn, since the initial registration control amount Rc is set as the registration control amount, as shown in FIG. 15, using the vertical synchronizing signal VSYNC outputted at the timing VT01, at the timing t11 of the acceleration/deceleration period T11, the surface velocity of the photosensitive member 21 and the surface velocity V of the intermediate transfer drum 41D are slowed down temporarily, thereby reducing the amount of rotation of the photosensitive member 21 and the amount of travelling of the intermediate transfer drum 41D by the deviation amount A27 as compared to where these rotate at a constant speed (the reference toner image, namely, the magenta toner image). In consequence, the latent image forming position on the photosensitive member 21 is shifted by the registration control amount Rc (=−A27) from the reference latent image forming position in the sub scanning direction.

The latent image which is formed on the photosensitive member 21 as described above is thereafter visualized by the developer 23Y, and the resulting yellow toner image Yn is primarily transferred onto the intermediate transfer drum 41D. Hence, the registration deviation amount (A27) due to contacting and leaving of the cleaning part 49 coincides with the shift amount Rc of the toner image Yn on the photosensitive member 21, which in turn matches the transfer start position of the yellow toner image Yn with the reference transfer start position.

Further, since the CB signal rises from the L level to the H level at the timing t4 which comes before the start of the primary transfer of the yellow toner image Yn onto the intermediate transfer drum 41D and since the cleaning part 49 which used to contact the intermediate transfer drum 41D moves away from the intermediate transfer drum 41D, a registration deviation is not created during the primary transfer. Because of this, the transfer rear end position of the yellow toner image Yn coincides with the transfer rear end position.

As described above, in the first preferred embodiment, as the photosensitive member 21 and the intermediate transfer drum 41D are accelerated/decelerated under control based on the registration control amount Rc, the amplitude center AC4 for the yellow color is matched with the amplitude center AC0 for the magenta color which is the reference toner color. Hence, it is possible to suppress a deviation amount from the reference toner image (the magenta toner image M2) to zero.

The image create/transfer processing is executed for the cyan toner image Cn and the magenta toner image Mn serially following the yellow toner image Yn. During this image create/transfer processing, neither the cleaning part 49 nor the secondary transfer roller 48 ever abut on or move away from the intermediate transfer drum 41D, the amplitude center for the two toner colors coincide with each other, and the transfer start positions and the transfer rear end positions of the toner images Cn and Mn coincide respectively with the reference transfer start position and the transfer rear end position.

As the toner images Yn, Cn and Mn in the three colors are completed, the image create/transfer processing in the last toner color, i.e., for the black toner image Kn is executed. During this image create/transfer processing, similarly to the first and the second printing sequences, the photosensitive member 21 and the intermediate transfer drum 41D are accelerated/decelerated under control based on the registration control amount Ra, and therefore, the amplitude center AC1 for the black color is matched with the amplitude center AC0 for the magenta color which is the reference toner color. Hence, there is a deviation (A27/2) on the transfer start side from the reference toner image in the (+) direction and a deviation (A27/2) on the transfer rear end side from the reference toner image in the (−) direction. Therefore, a maximum deviation amount is half that where the registration control is not performed (FIG. 5).

Thus, for color printing after idling as well, the transfer start positions of the toner images in the two colors of yellow (Y) and black (K) out of the four toner colors are corrected based on the registration control amounts. In other words, as to all toner colors, the photosensitive member 21 and the intermediate transfer drum 41D are accelerated/decelerated under control based on the registration control amounts corresponding to the respective toner colors in such a manner that the amplitude center of registration deviations in the sub scanning direction for the respective toner colors match with each other during the transfer processing, whereby the transfer start positions of the toner images are corrected. This as a result allows to completely register the yellow toner image Yn, the cyan toner image Cn and the magenta toner image (the reference toner image) Mn to each other and to suppress a registration deviation amount of the black toner image Kn to minimum although the black toner image Kn may not be registered completely to the reference toner image, which in turn makes it possible to form a high-quality image.

A-7. Functions and Effects

As described above, the first preferred embodiment promises the following functions and effects. First, since the abutting means (the secondary transfer roller 48, the cleaning part 49, etc.) is allowed to contact and move away from the intermediate transfer drum 41D which is a transfer medium while the image create/transfer processing is repeated, the power transmission members 91 are elastically deformed as described earlier, which serves as a main cause of a registration deviation. However, it is possible to suppress a registration deviation to minimum by identifying registration control amounts which are necessary to correct registration deviations in accordance with the printing sequence state and thereafter correcting the transfer start positions for toner images in at least one or more toner colors out of the four toner colors based on the obtained registration control amounts. More precisely, in this preferred embodiment, with respect to the black, the yellow and the cyan colors, the amplitude center AC1, AC2 (or AC4) and AC3 of registration deviations in the sub scanning direction during the image create/transfer processing for the respective toner colors are matched with the amplitude center AC0 for the magenta color which is the reference toner color, and hence, registration deviations among all toner colors are suppressed to minimum and a high-quality color image is obtained.

One of the functions and effects according to this preferred embodiment which is to be particularly noted is that this preferred embodiment requires to obtain the registration control amount Rc which is for a situation that the abutting means, such as a cleaner blade 491, moves away from an intermediate transfer belt 41 before the primary transfer is started after the reference signal (the vertical synchronizing signal VSYNC) for the image create/transfer processing is outputted, to thereby effectively suppress registration deviations of the second cyan image and the like based on the calculated registration control amount Rc.

In the mean time, while it may be possible to form the power transmission members 91 using a highly rigid material, such as metal and a ceramic material, so that elastic deformation of the power transmission members 91 is suppressed to thereby eventually suppress the amount of deviations, if the power transmission members 91 are fabricated by finely processing such a highly rigid material, the cost of these members largely increases, and therefore, a production cost of the image forming apparatus becomes high. Further, as this is not directly applicable to apparatuses which have been already designed and manufactured, the apparatuses have to be improved. In contrast, as the preferred embodiment above permits to suppress registration deviations and enhance an image quality independently of the apparatus structure, the preferred embodiment above is a more flexible and inexpensive technique.

In addition, this type of image forming apparatus has a plurality of printing sequences which are different from each other, as described earlier. The abutting means (the secondary transfer roller 48 and the cleaning part 49) contacts and moves away from the intermediate transfer drum 41D in one of the multiple printing sequences which corresponds to an operation state of the apparatus, and therefore, optimal registration control amounts become different in accordance with the respective printing sequences. In contrast, the preferred embodiment above requires to store, in the memory 125 in advance, all the registration control amounts Ra, Rb and Rc which are necessary to correct relative registration deviations among toner images on the intermediate transfer drum 41D which are created as the abutting means temporarily contacts and moves away from the intermediate transfer drum 41D while the image create/transfer processing is repeated, to set up one which corresponds to the updated and established sequence flag in accordance with the printing sequence as a registration control amount, and to execute the registration control based on this registration control amount. This eliminates the necessity to newly obtain a registration control amount every time the sequence is changed, and realizes excellent controllability.

Further, this type of image forming apparatus is not supplied with electricity all day long, but is usually turned on at the start of the day's operation and turned off at the end of the day's operation. Since the automatic establish processing (step S1) for establishing a registration control amount is executed every time the apparatus is turned on to thereby automatically obtain the registration control amounts Ra, Rb and Rc, it is always possible to correct registration deviations using the most recent and appropriate registration control amounts Ra, Rb and Rc every day even if the image forming apparatus is used over a long period of time, and therefore, it is possible to obtain a high-quality color image stably over the long period of time.

B. Second Preferred Embodiment

While the image forming apparatus according to the first preferred embodiment described above is an apparatus in which a transfer drum is used as a transfer medium, the present invention is not limited to such, but is applicable to an image forming apparatus of the so-called transfer belt type. However, in an image forming apparatus of the transfer belt type, since a transfer belt itself is elastically deformed as the abutting means contacts and moves away, a profile which is indicative of a change in registration deviation amount is naturally very different from a profile of the transfer drum type. Now, a second preferred embodiment, which is an application of the present invention to an image forming apparatus of the transfer belt type, will be described in the following, mainly with respect to differences.

B-1. Structure of Apparatus

Figure 16:
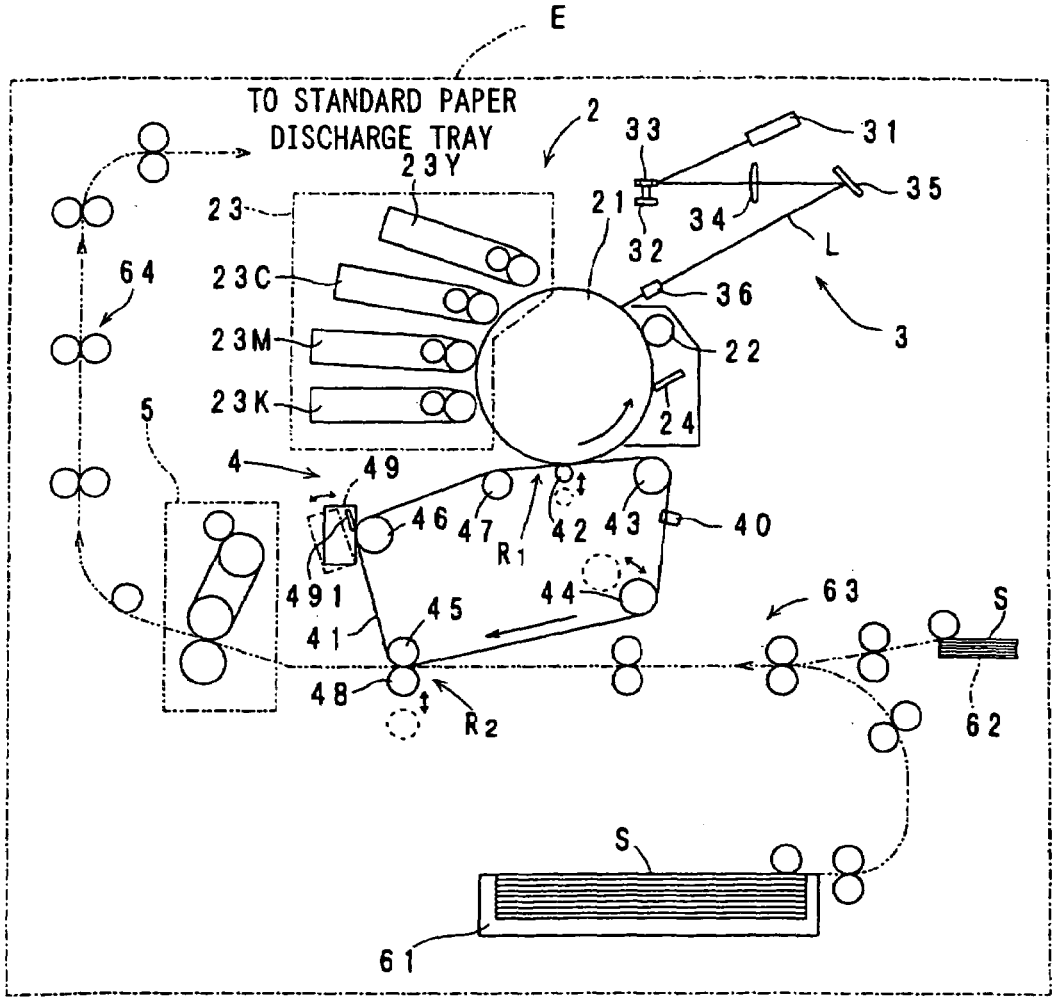
FIG. 16 is a drawing showing an image forming apparatus according to a second preferred embodiment of the present invention.

FIG. 16 shows an image forming apparatus according to the second preferred embodiment of the present invention. A large difference in mechanical structure of the second preferred embodiment from the first preferred embodiment lies in a specific structure of the transfer unit 4. That is, while the transfer unit 4 is of the transfer drum type in the first preferred embodiment, the transfer unit 4 of the transfer belt type is used in the second preferred embodiment. The mechanical structure (the process unit 2, the exposure unit 3, the fixing unit 5 and the paper feed/discharge unit 6) is otherwise approximately the same. In addition, the electrical structure remains the same as that of the first preferred embodiment (FIG. 2).

In the process unit 2 of this image forming apparatus, as in the first preferred embodiment, the electrifying roller 22 which serves as electrifying means, the developers 23Y, 23C, 23M and 23K which serve as developing means, and the photosensitive member cleaner blade 24 are arranged around the photosensitive member 21, which can rotate in the direction denoted at the arrow in FIG. 16, along the direction of rotation of the photosensitive member 21. The exposure unit 3 irradiates laser light L toward the outer circumferential surface of the photosensitive member 21, and electrostatic latent images which correspond to an image signal are consequently formed. The electrostatic latent images which are formed in this manner are developed with toner by the developer part 23.

The toner images developed by the developer part 23 are primarily transferred onto an intermediate transfer belt 41B of the transfer unit 4, within the primary transfer region TR1 which is located between the developer 23K for black and the photosensitive member cleaner blade 24. In addition, the photosensitive member cleaner blade 24 is disposed at a position which is ahead in the circumferential direction (the direction denoted at the arrow in FIG. 1) from the primary transfer region TR1, to scrape off toner which remains adhering to the outer circumferential surface of the photosensitive member 21 after the primary transfer.

Next, the structure of the transfer unit 4 will be described. In this preferred embodiment, the transfer unit 4 comprises rollers 42 to 47, the intermediate transfer belt 41B which is spun across the rollers 42 to 47, the secondary transfer roller 48 for secondarily transferring intermediate toner images which have been transferred onto the intermediate transfer belt 41B onto the sheet member S the photosensitive member/transfer medium driving part 41*a* (FIG. 2) which drives the photosensitive member 21 and the intermediate transfer belt 41B into synchronized rotation. For the purpose of printing an image in color, toner images in the respective colors on the photosensitive member 21 are laid one atop the other on the intermediate transfer belt 41B so that a color image is formed, and a paper feed part 63 of the paper feed/discharge unit 6 unloads the sheet member S from a cassette 61, a manual-feed tray 62 or an extension cassette (not shown) and transports the sheet member S to the secondary transfer region TR2. The color image is thereafter secondarily transferred onto the sheet member S, thereby obtaining a full-color image.

A cleaner blade 491 which is disposed in the cleaning part 49 removes toner which remains adhering to the outer circumferential surface of the intermediate transfer belt 41B after the secondary transfer. More precisely, the cleaning part 49 is arranged facing the roller 46 with the intermediate transfer belt 41B sandwiched in-between, and the cleaner blade 491 contacts the intermediate transfer belt 41B at timing described in detail later and scrapes off the toner which remains adhering to the outer circumferential surface of the intermediate transfer belt 41B.

The sensor 40 which detects a reference position of the intermediate transfer belt 41B is disposed in the vicinity of the roller 43, serving as a vertical synchronization reading sensor for obtaining a synchronizing signal in the sub scanning direction which is approximately perpendicular to the main scanning direction, namely, the vertical synchronizing signal VSYNC. Further, as described in detail later, the sensor 40 functions also as the reference signal detecting means which outputs the reference signal in relation to rotation of the intermediate transfer belt 41B.

The paper feed part 63 of the paper feed/discharge unit 6 transports the sheet member S now seating the toner images transferred by the transfer unit 4 in the manner described above to the fixing unit 5 which is disposed on the downstream side to the secondary transfer region TR2, along a predetermined transport path (denoted at the chain doubledashed line), and the toner images on the sheet member S are fixed to the sheet member S. After further transported to a paper discharge part 64 along the transport path, the sheet member S is discharged into a standard paper discharge tray.

B-2. Basic Operations

In the image forming apparatus as above, while the image create/transfer processing is repeated, various types of registration deviations are generated as the abutting means such as the secondary transfer roller 48 and the cleaner blade 491 temporarily contacts the intermediate transfer belt 41B. However, in this preferred embodiment, since not only the power transmission members 91 but the intermediate transfer belt 41B, which is one of the elements forming the transfer unit 4, as well are elastically deformed as loads change, there are more complex factors intertwined with each other than in the first preferred embodiment. Noting this, in this preferred embodiment, causes of registration deviations were analyzed in detail, as described in the section "B-3. Analysis of Causes of Registration Deviation" later. Transfer start positions are corrected based on registration control amounts after obtaining registration deviation amounts based on a result of the analysis, so that registration deviations are suppressed and an image quality is improved. Since basic operations are the same as those in the first preferred embodiment (FIG. 2), the basic operations will be described in detail with reference to FIG. 2 without illustration of an operation flow in other drawings.

In this image forming apparatus, as the power source of the apparatus is turned on, the registration control amount establish processing (Step S1) is executed prior to actual processing to form an image, so that the three types of registration control amounts Ra, Rb and Rc are automatically established and stored as initial registration control amounts in the memory 125 which serves as the memory means. While the technical meaning of the registration control amounts Ra, Rb and Rc remains the same as in the first preferred embodiment, since the causes of registration deviations are different from those in the first preferred embodiment, the values of the registration control amounts Ra, Rb and Rc are largely different from those in the first preferred embodiment as described in detail in the section "B-4. Initial Registration Control Amount Establish Processing" later. The details of the automatic establish processing (step S1) for establishing the registration control amounts will be given under the section "B-4. Initial Registration Control Amount Establish Processing" later.

As the establishment of the initial registration control amounts Ra through Rc (Step S1) completes, the sequence waits for an image signal from the external apparatus such as a host computer, namely, a print request (Step S2). As the print request is received, whether the requested print mode is monochrome printing or color printing is judged (Step S3), and when it is judged that the requested print mode is monochrome printing, the sequence executes normal image create processing without registration control and returns to the step S2. On the other hand, when it is judged at the step S3 that color printing is requested, one of the three sequence flags F0, F1 and F2 which corresponds to a printing sequence state is selectively set (Step S4) as described in detail in the section "A-5. Updating of Sequence Flag" earlier.

After setting up a registration control amount corresponding to the sequence flag (Step S5), for the image create/transfer processing in each toner color, the photosensitive member 21 is accelerated/decelerated under control during a predetermined acceleration/deceleration period, whereby a latent image forming position is shifted by an amount equivalent to the registration control amount in the sub scanning direction with respect to a reference latent image forming position (Step S6). This causes the transfer positions of toner images as well which are primarily transferred onto the intermediate transfer belt 41B to shift by the registration control amount in the sub scanning direction. Registration deviations are suppressed by correcting the transfer start positions in this manner. The details of this will be given under the section "B-5. Correction of Transfer Start Position" later.

As creation of a color image is completed while suppressing registration deviations based on the registration control amount in this manner, whether the printing has completed or not is determined at a step S7. When it is judged that the printing has completed, the sequence returns to the step S2 to wait for the next print request. On the other hand, when it is judged that the printing has not completed, the sequence returns to the step S3 to repeat similar processing to the above.

B-3. Analysis of Causes of Registration Deviation This section will describe in detail, with reference to FIGS. 4, 17 through 21, a state of development of registration deviations in the case that the image forming apparatus shown in FIG. 16 operates in the operation sequence shown in FIG. 4 without correcting transfer start positions at all.

The image forming apparatus according to the second preferred embodiment operates in the same sequence as that of the first preferred embodiment. In other words, as shown in FIG. 4, after the power source of the apparatus is turned on or the image forming apparatus is released from a sleep mode, the intermediate transfer belt 41B is driven into rotation and the vertical synchronizing signal VSYNC is outputted intermittently from the vertical synchronization reading sensor 40. As the vertical synchronizing signal VSYNC is outputted at timings VT1 through VT7, . . . , a yellow electrostatic latent image, a cyan electrostatic latent image, a magenta electrostatic latent image and a black electrostatic latent image are formed on the photosensitive member 21 repeatedly in this order. After the respective electrostatic latent images are formed, one of the developers 23Y, 23C, 23M and 23K selectively contacts the photosensitive member 21 and visualizes the associated electrostatic latent image which is on the photosensitive member 21, and the corresponding toner image is primarily transferred onto the intermediate transfer belt 41B. Hence, the toner images in the respective colors are created at a predetermined position, i.e., a reference latent image forming position on the photosensitive member 21, and primarily transferred at the same position onto the intermediate transfer belt 41B which rotates in synchronization with the photosensitive member 21 (the image create/transfer processing in the respective toner colors).

As the image create/transfer processing described above is repeated for the four colors, the toner images in the four colors are laid over with each other on the intermediate transfer belt 41B and a color image is formed. As the color image is obtained in this manner, the secondary transfer roller 48 contacts the intermediate transfer belt 41B with the sheet member S sandwiched in-between so that the color image is secondarily transferred onto the sheet member S, following which the cleaner blade 491 contacts the intermediate transfer belt 41B in respect to the CB signal to thereby remove the toner which remains on the belt surface. Such operations are repeated, whereby the sheet members S bearing color images are discharged one after another to the standard paper discharge tray.

This is the outline of the operations of the image forming apparatus in accordance with the operation sequence shown in FIG. 4. A relationship between such operations and a registration deviation amount in the sub scanning direction was studied, and different results were observed between the first sheet and the later sheets. As the different results are due to difference in operation sequences, an operation sequence for creating the first image (hereinafter the "first printing sequence") and an operation sequence for creating the second and subsequent images (hereinafter the "second printing sequence") will be described separately. Further, since this type of apparatus has a third printing sequence for idling, this will also be described.

B-3-1. First Printing Sequence

First, as the power source of the apparatus is turned on (or the image forming apparatus is released from a sleep mode), the intermediate transfer belt 41B is driven into rotation and the vertical synchronizing signal VSYNC is outputted sequentially at timings VT1 to VT3 from the vertical synchronization reading sensor 40. A yellow toner image Y1 is primarily transferred onto the intermediate transfer belt 41B at the first timing VT1, a cyan toner image C1 is primarily transferred over the yellow toner image Y1 on the intermediate transfer belt 41B at the timing VT2, and a magenta toner image M1 is primarily transferred over the yellow toner image Y1 and the cyan toner image C1 on the intermediate transfer belt 41B at the timing VT3. During this, neither cleaning of nor secondary transfer from the intermediate transfer belt 41B is executed, and the abutting means (the secondary transfer roller 48 and the cleaner blade 491) is away from the intermediate transfer belt 41B.

Figure 17:
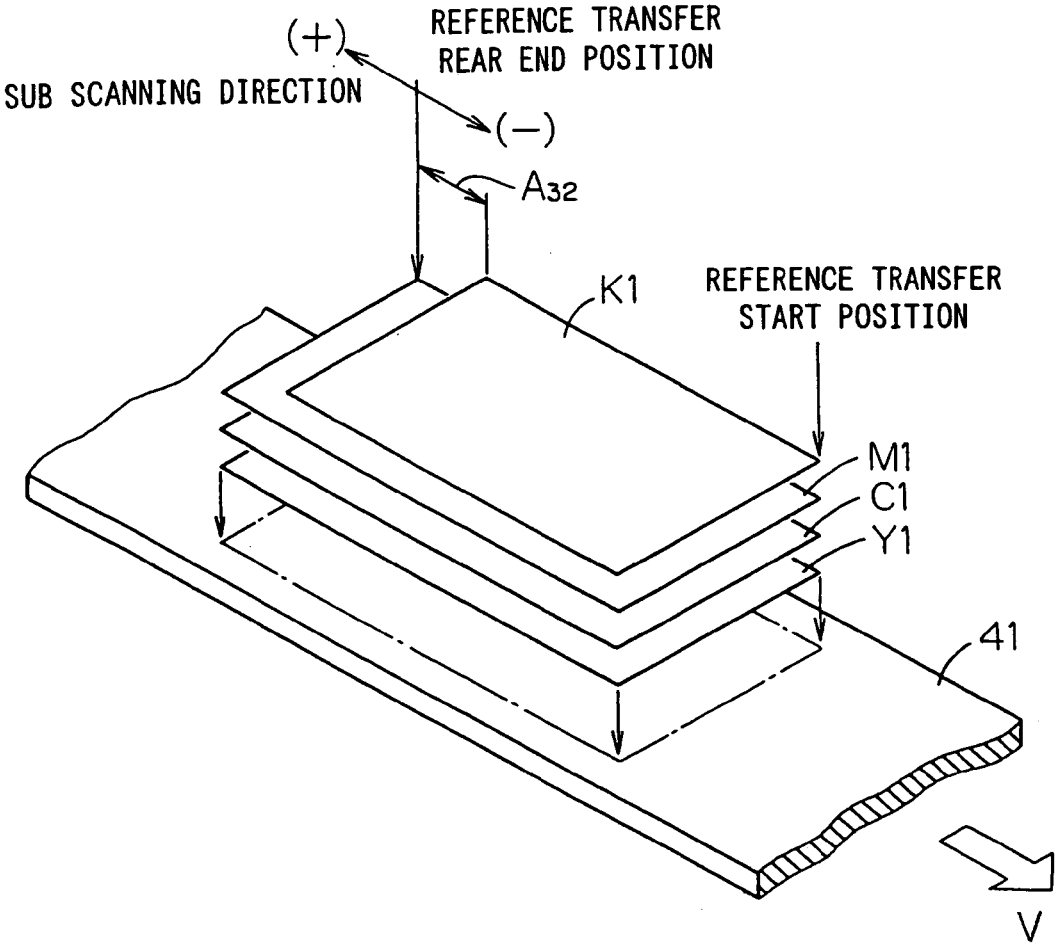
FIG. 17 is a schematic drawing showing a state of registration of toner images in the image forming apparatus shown in FIG. 16 which arises as primary transfer is executed at operation timing as that shown in FIG. 4 without registration control.

Hence, these three toner images Y1, C1 and M1 are all laid one atop the other at the same position on the intermediate transfer belt 41B and accurately registered in the sub scanning direction. In short, as shown in FIG. 17, the transfer start positions of these three toner images Y1, C1 and M1 coincide with the reference transfer start position, and the transfer rear end positions of the three toner images all coincide with a reference transfer rear end position. The alternate long and short dashed line in FIG. 17 (and in FIG. 24 which will be described later) denotes the primary transfer position at which the respective toner images are transferred. Although the respective toner images are laid one atop the other at the position denoted by the alternate long and short dashed line during actual primary transfer, for the convenience of description, the respective toner images are shown separated from each other in the vertical direction.

Figure 18:
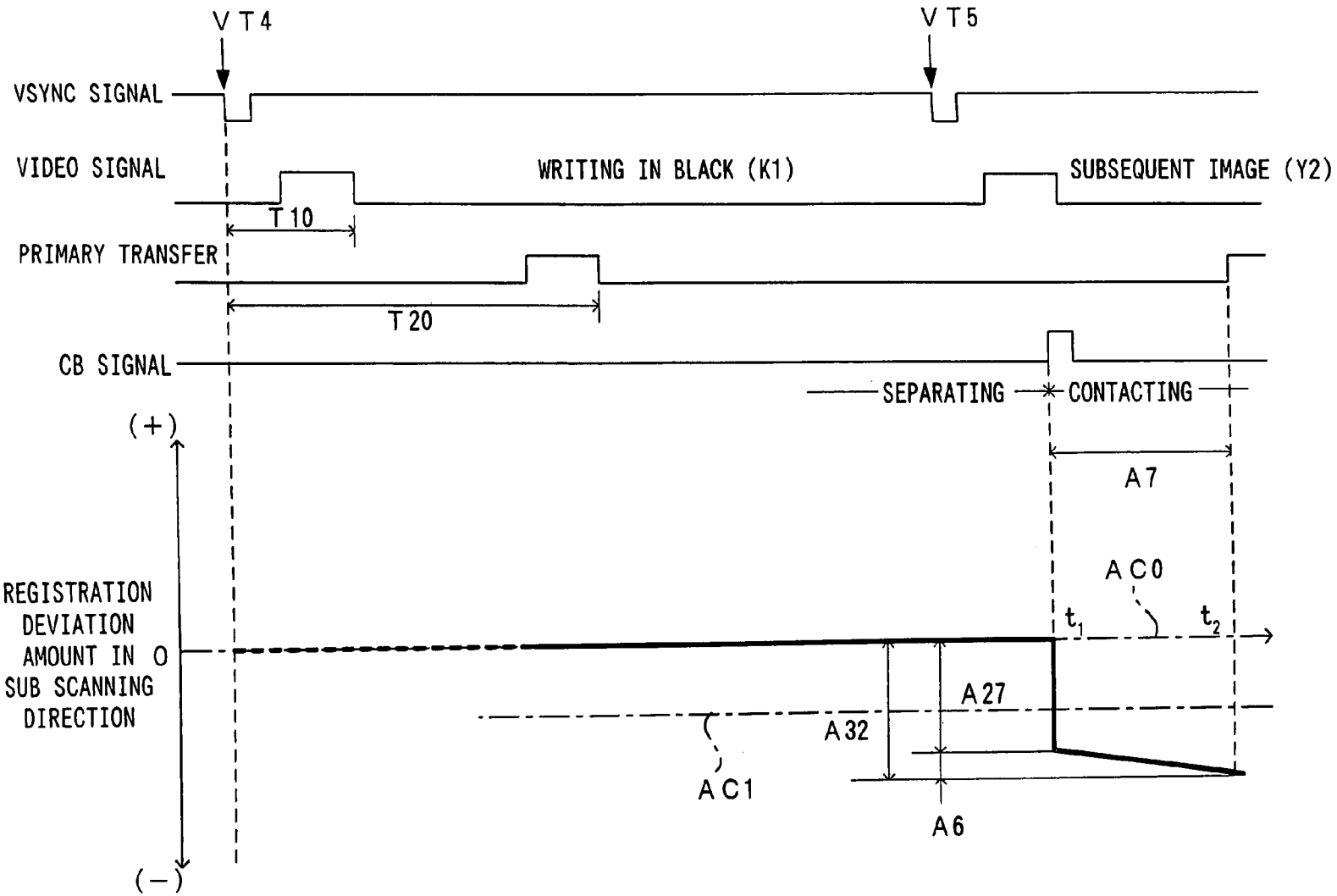
FIG. 18 is a drawing showing a state of a registration deviation which occurs in the image forming apparatus shown in FIG. 16 as a black toner image is transferred without registration control.

Next, as the vertical synchronizing signal VSYNC is outputted at the timing VT4, as shown in FIG. 18, a VIDEO signal is fed to the exposure unit 3 after the predetermined period T10, and an electrostatic latent image which corresponds to the black toner image K1 is formed at the reference latent image forming position similarly to the other toner colors and developed with the toner by the developer 23K for black. Following this, primary transfer is started after the predetermined period T20 since the vertical synchronizing signal VSYNC was outputted (the timing VT4). At this point, as in the case of the yellow toner image Y1, the cyan toner image C1 and the magenta toner image M1, the cleaner blade 491 is away from the intermediate transfer belt 41B, and as a result, the transfer start position of the black toner image K1 as well coincides with the reference transfer start position like the other toner images Y1, C1 and M1 as shown in FIG. 17. While the separated condition continues, the surface velocity V of the intermediate transfer belt 41B remains constant so that the black toner image K1 is laid over the other toner images Y1, C1 and M1 which have been already primarily transferred while accurately registered to the toner images Y1, C1 and M1.

However, at some point during the latter half of the primary transfer of the black toner image K1, i.e., timing t1, the CB signal for controlling the operations of the cleaner blade 491 rises from an L level to an H level, which in turn causes the cleaner blade 491 to abut on the intermediate transfer belt 41B to thereby deviate the black toner image K1 from the other toner images Y1, C1 and M1 in the sub scanning direction. In other words, the cleaner blade 491 contacts the intermediate transfer belt 41B at the timing t1, serving as a transportation load upon the intermediate transfer belt 41B, which instantaneously develops stretching in the sub scanning direction. The power transmission members 91 (FIG. 59), which transmit dynamic force to the intermediate transfer belt 41B, are similarly elastically deformed. In consequence, a registration deviation having the registration deviation amount A27 is created in the (−) direction.

Further, after the timing t1, until the CB signal rises from an L level to an H level once again, the cleaner blade 491 cleans the intermediate transfer belt 41B while maintained contacting the intermediate transfer belt 41B. The primary transfer of the black toner image K1 is continued until the timing t2, with this contacting condition continued. As a result, the registration deviation increases even larger, and therefore, the amount of the registration deviation of the black toner image K1 in the sub scanning direction eventually becomes:

$$A32=A27+A6$$

Therefore, as shown in FIG. 17, the transfer rear end position of the black toner image K1 deviates by the amount A32 in the (−) direction from the reference transfer rear end position. Represented by symbol A6 corresponds to stretching of the belt which is created as the cleaner blade 491 remains contacting the intermediate transfer belt 41B during a period from the timing t1 to the timing t2 (i.e., a period A7).

In this manner, as to the first color image, as shown in FIG. 17, only the black toner image K1 deviates from the other toner images Y1, C1 and M1 in the rear half of the first color image, and particularly in the rear-most portion of the first color image, the black toner image K1 deviates by the registration deviation amount A32. More precisely, as shown in FIG. 18, in the case of the first black toner image, a registration deviation in the sub scanning direction during the image create/transfer processing is within the range of (A32/2) about the amplitude center AC1 each along the (+) side and the (−) side of the sub scanning direction, thereby inviting a deteriorated image quality. While the secondary transfer roller 48 as well contacts the intermediate transfer belt 41B before the cleaner blade 491 contacts the intermediate transfer belt 41B and creates a similar registration deviation, since a corresponding registration deviation amount is smaller than that caused by the cleaner blade 491, for easy understanding of the basic principles of the invention, a description will be continued ignoring registration deviations which are created as the secondary transfer roller 48 contacts and leaves the intermediate transfer belt 41B.

B-3-2. Second Printing Sequence

Figure 19:
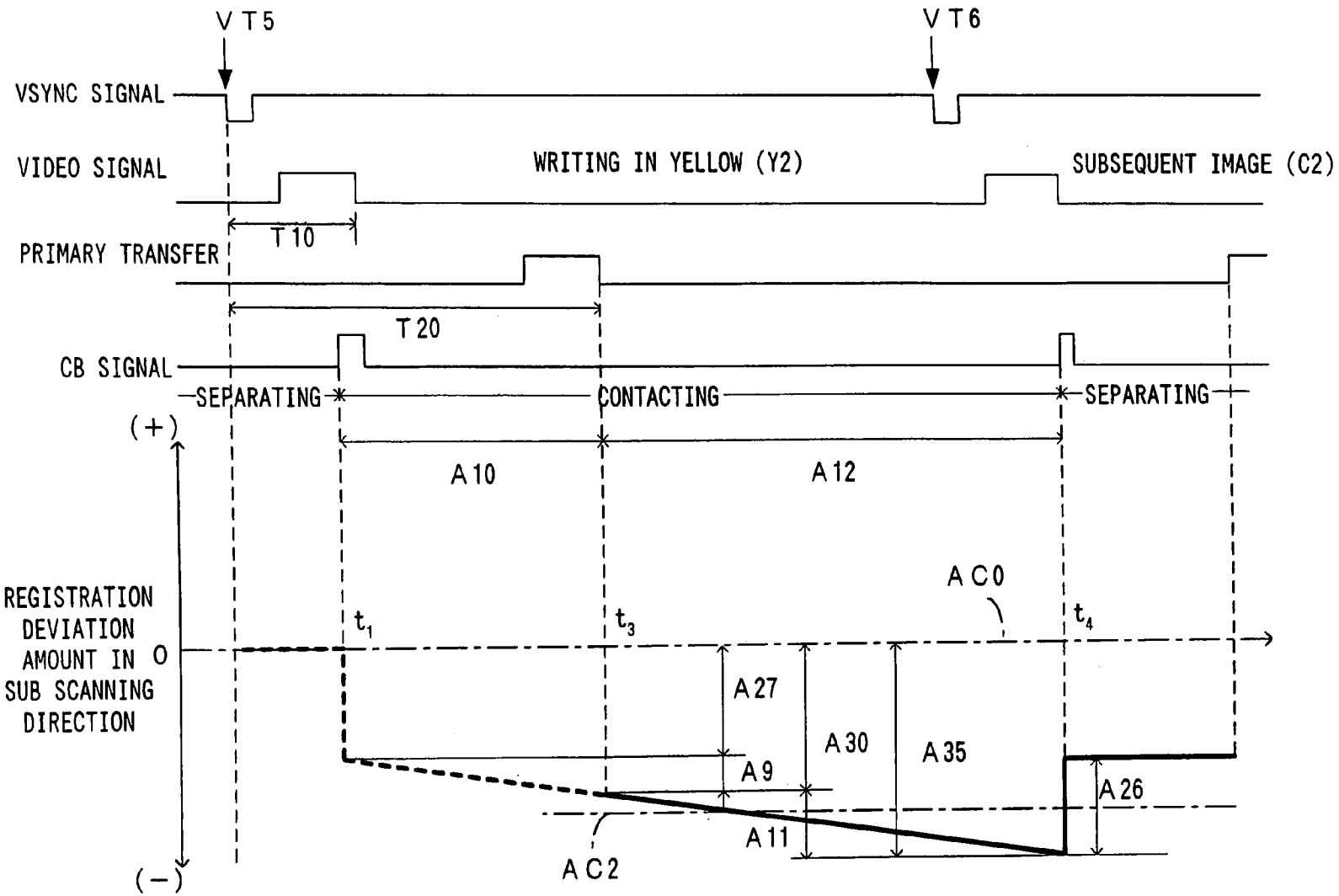
FIG. 19 is a drawing showing a state of a registration deviation which occurs in the image forming apparatus shown in FIG. 16 as a yellow toner image is transferred without registration control.

Such registration deviations are generated not only in the first color image but in the second color image as well. That is, in order to form a yellow toner image Y2 for the second color image, as shown in FIG. 19, after the predetermined period T10 since the vertical synchronizing signal VSYNC is outputted at the timing VT5, a VIDEO signal for creating the yellow toner image Y2 is supplied to the exposure unit 3. Following this, while creating an electrostatic latent image which corresponds to the yellow toner image Y2 on the photosensitive member 21, the electrostatic latent image is developed with the toner by the developer 23Y for yellow. Further, primary transfer is started after the predetermined period T20 since the vertical synchronizing signal VSYNC is outputted (timing VT5), i.e., at timing t3.

Figure 59:
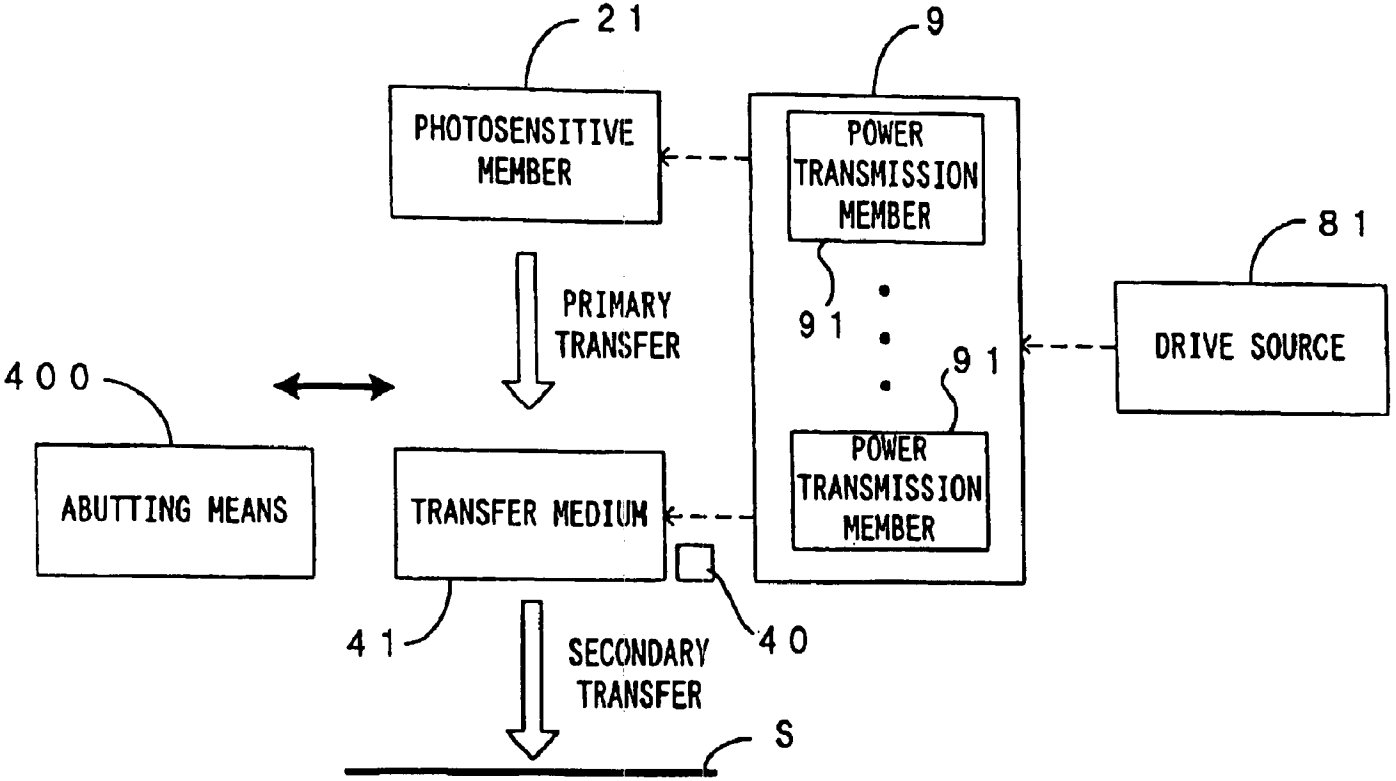
Fig. 59 PRIOR ART
FIG. 59 is a drawing schematically showing an overall structure of an image forming apparatus which serves as a background technique of the present invention.

However, after a while since the timing VT5 of outputting the vertical synchronizing signal VSYNC, as described above, the cleaner blade 491 contacts the intermediate transfer belt 41B at the timing t1, and the registration deviation amount A27 is developed due to instantaneous stretching of the intermediate transfer belt 41B in the sub scanning direction and elastic deformation of the power transmission members 91 (FIG. 59). Further, since the contacting condition continues until the CB signal next rises to the H level as described in detail later, the stretching in the sub scanning direction increases as time elapses. At the primary transfer start timing t3, a registration deviation amount A30 in the sub scanning direction is:

$$A30=A27+A9$$

Represented by symbol A9 corresponds to stretching of the belt which is created as the cleaner blade 491 remains contacting the intermediate transfer belt 41B during a period from the timing t1 to the timing t3 (i.e., a period A10).

Further, since the entire belt is cleaned up and the cleaning completes as the intermediate transfer belt 41B moves passed the cleaning part 49 and travelling approximately one round, the CB signal rises once again from the L level to the H level at the timing t4 and the cleaner blade 491 leaves the intermediate transfer belt 41B. The cleaner blade 491 remains contacting the intermediate transfer belt 41B from the primary transfer start timing t3 until the timing t4 at which the cleaner blade 491 moves away, during which period A12 (=t4−t3) the intermediate transfer belt 41B stretches by an amount A11 in the sub scanning direction, whereby the registration deviation further increases and the amount of the registration deviation becomes a deviation amount A35 in the (−) direction immediately before the timing t4.

On the other hand, at the timing t4, the cleaner blade 491 leaves the intermediate transfer belt 41B. Since this removes the load upon the intermediate transfer belt 41B, the intermediate transfer belt 41B contracts unlike in the contacting condition and the power transmission members (e.g., gears and the belt) 91 which used to be elastically deformed return to their original conditions, so that the registration deviation amount in the sub scanning direction reduces by the amount A26. Thus, in the case of the second color image, the transfer start position of the yellow toner image Y2 largely shifts from the reference transfer start position. In addition, the deviation amount increases as the primary transfer progresses, and the registration deviation amount starts decreasing as the cleaner blade 491 moves away at the timing t4 during the primary transfer. In other words, as shown in FIG. 19, with respect to the second yellow toner image Y2, a registration deviation in the sub scanning direction during the image create/transfer processing is in the range of (A26/2) about the amplitude center AC2 each along the (+) side and the (−) side of the sub scanning direction, which leads to a deteriorated image quality.

Further, as to the cyan toner image C2 which is created after the second yellow toner image Y2, too, the transfer start position deviates from the reference transfer start position, due to the influence exerted as the cleaner blade 491 contacts and moves away. Now, this phenomenon will be described with reference to FIG. 20.

For the purpose of creating the second cyan toner image C2, a VIDEO signal for forming the cyan toner image C2 is supplied to the exposure unit 3 after the predetermined period T10 since the vertical synchronizing signal VSYNC is outputted at timing VT6. Following this, while creating an electrostatic latent image corresponding to the cyan toner image C2 on the photosensitive member 21, the electrostatic latent image is developed with the toner by the developer 23C for cyan. Primary transfer is started after the predetermined period T20 since the outputting of the vertical synchronizing signal VSYNC (timing VT6), i.e., at the timing t5.

At the timing VT6 of outputting the vertical synchronizing signal VSYNC, as described above, the cleaner blade 491 is in contact with the intermediate transfer belt 41B, and therefore, the contacting condition is maintained until the timing t4 (at which the CB signal rises once again from the L level to the H level), i.e., during a period A14. Hence, the intermediate transfer belt 41B stretches by A13, starting at the timing VT6 until the timing t4. On the other hand, as the cleaner blade 491 leaves the intermediate transfer belt 41B at the timing t4, as described above, conversely to the contacting condition, both the load upon the intermediate transfer belt 41B and the load upon the power transmission members 91 are removed, and the intermediate transfer belt 41B contracts by A26, and after this, remains away until the CB signal next rises to the H level from the L level. As a result, at the primary transfer start timing (the timing t5) for the cyan toner image C2, a registration deviation amount A34 in the sub scanning direction is:

$$A34=A26-A13$$

Thus, with respect to the second cyan toner image C2, a registration deviation in the sub scanning direction during the image create/transfer processing is in an amplitude amount of zero about the amplitude center AC3. While the registration deviation amount does not change during the primary transfer, the amplitude center AC3 itself shifts by the deviation amount A34 in parallel in the sub scanning direction (+), and therefore, an image quality deteriorates. That is, as to the second toner color among the four toner colors, although the abutting means (the secondary transfer roller 48, the cleaner blade 491, etc.) does not contact or move away from the intermediate transfer belt 41B during the primary transfer in the second toner color, a registration deviation is generated. Hence, for creation of a high-quality color image while suppressing a registration deviation, how to suppress a registration deviation in the second toner color is important.

As the primary transfer of the cyan toner image C2 is completed in the manner described above, the magenta toner image M2 is formed and primarily transferred next. Since the cleaner blade 491 stays away from the intermediate transfer belt 41B during this processing, a registration deviation is not created in the sub scanning direction and therefore a deviation amount is zero as in the case of the first sheet. Hence, as to the magenta toner image M2, a registration deviation in the sub scanning direction during creation and transfer of the image is in an amplitude amount of zero about an axis along which the registration deviation amount is zero (the alternate long and short dashed lines AC0 in FIG. 18, FIG. 19, etc.). From this, in an image forming apparatus which forms an image in the operation sequence shown in FIG. 4, a magenta toner image is used as a reference toner image, and a transfer start position and a transfer rear end position of a magenta toner image are used as the "reference transfer start position" and the "reference transfer rear end position," respectively.

Further, while a second black toner image is formed and primarily transferred after the primary transfer of the magenta toner image M2 is completed, in this case, as in the case of the second sheet, the cleaner blade 491 contacts the intermediate transfer belt 41B in mid course of the primary transfer and stretches the intermediate transfer belt 41B by the amount A32, thereby creating a registration deviation along (−) side in the sub scanning direction. A profile showing a change in registration deviation amount corresponding to the operation sequence is the same as that shown in FIG. 18, and a registration deviation in the sub scanning direction during creation and transfer of the image is within the range of (A32/2) about the amplitude center AC1, each along the (+) side and the (−) side of the sub scanning direction, thereby leading to a deteriorated image quality.

Moreover, similar registration deviations to those in the second sheet described above are created, as the third and subsequent color images are formed continuously following the second color image.

B-3-3. Third Printing Sequence

Figure 20:
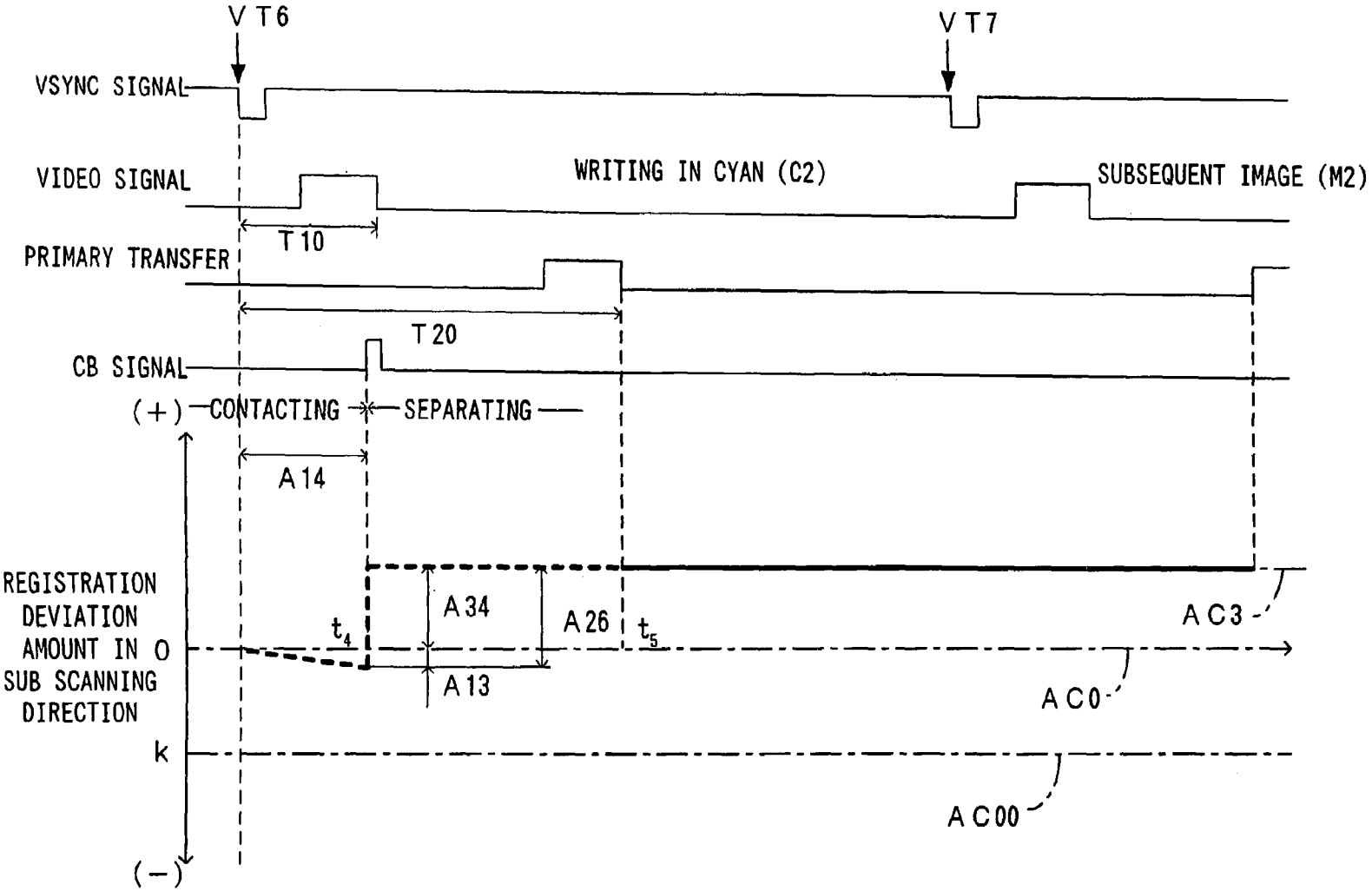
FIG. 20 is a drawing showing a state of a registration deviation which occurs in the image forming apparatus shown in FIG. 16 as a cyan toner image is transferred without registration control.

In this type of image forming apparatus, the intermediate transfer belt 41B needs run idle sometimes. For example, while the intermediate transfer belt 41B is allowed to run idle when image data from the external apparatus such as a host computer are received at or beyond a certain interval, the apparatus is stopped temporarily if it is necessary to run the intermediate transfer belt 41B idle twice or more. At this stage, the cleaner blade 491 is in contact with the intermediate transfer belt 41B. To start creating a new image, the intermediate transfer belt 41B is driven into rotation and image creation is started. During primary transfer of the initial yellow toner image, a similar registration deviation to those in the second and subsequent cyan toner images shown in FIG. 20 are created.

Figure 21:
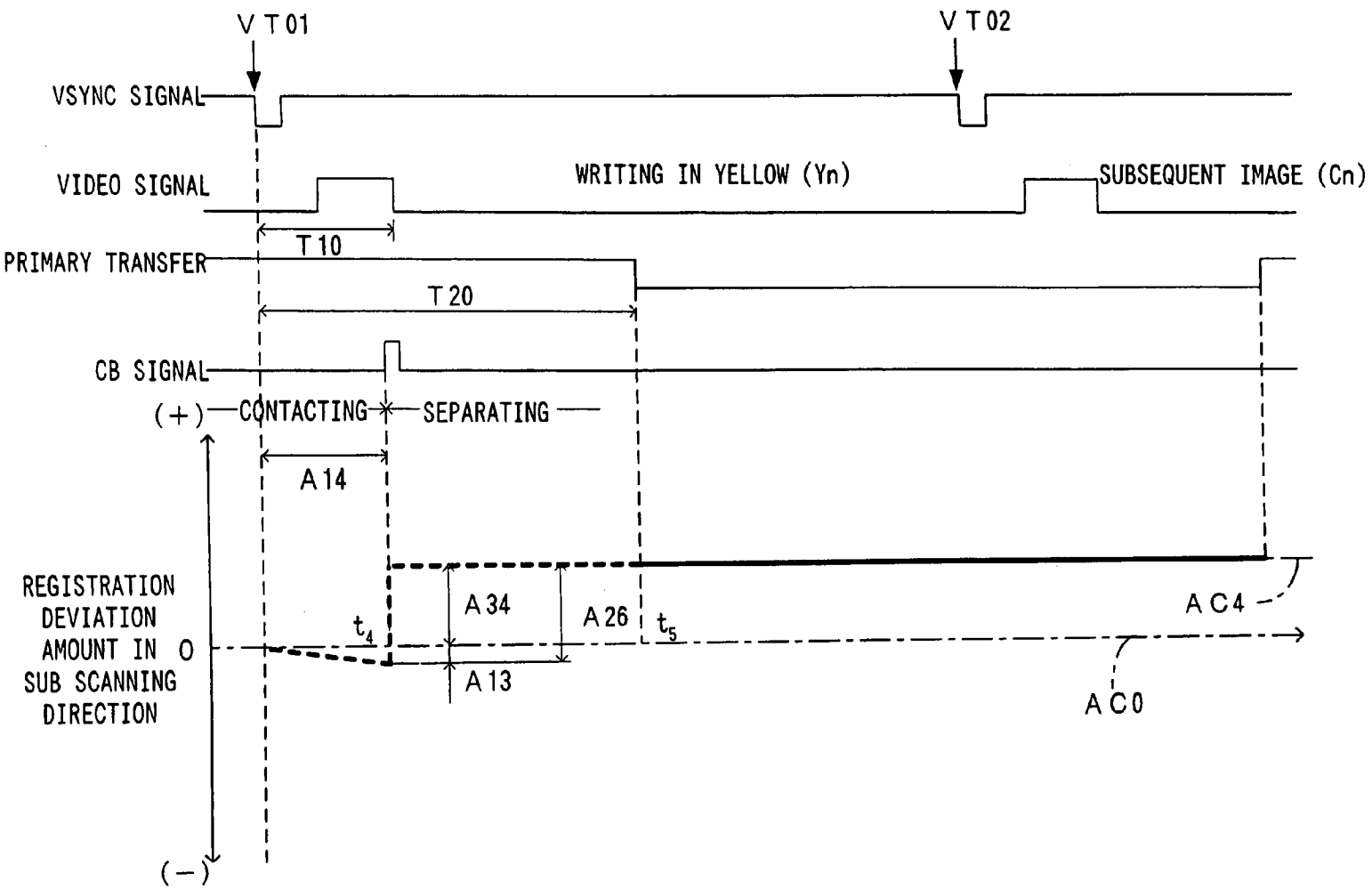
FIG. 21 is a drawing showing a state of a registration deviation which occurs in the image forming apparatus shown in FIG. 16 as a yellow toner image is transferred without registration control.

In short, as shown in FIG. 21, as the image creation is resumed and the intermediate transfer belt 41B is driven into rotation, the vertical synchronizing signal VSYNC is outputted at timing VT01 from the vertical synchronization reading sensor 40, and after the cleaner blade 491 moves away from the intermediate transfer belt 41B after the certain period A14 from the timing VT01, primary transfer of a yellow toner image is started. Because of this, the transfer start position is deviated by the deviation amount A34 in the (+) direction for a similar reason to that described in relation to the cyan toner image C2 in the section "B-3-2. Second Printing Sequence" above. That is, a registration deviation in the sub scanning direction during creation and transfer of the image is in an amplitude amount of zero about the amplitude center AC3. While the registration deviation amount does not change during the primary transfer, the amplitude center AC4 itself shifts by the deviation amount A34 in parallel in the sub scanning direction (+), which leads to a deteriorated image quality.

Since subsequent primary transfer of a cyan and a magenta toner images is executed with the cleaner blade 491 always away from the intermediate transfer belt 41B, a registration deviation is not generated. However, as to a black toner image which is the last one, as in the first and the second printing sequences, the cleaner blade 491 and the secondary transfer roller 48 abut on the intermediate transfer belt 41B during primary transfer and a registration deviation of the deviation amount A32 is created in the (−) direction.

As described above, as the abutting means such as the cleaner blade 491 comes into contact with and moves away from the intermediate transfer belt 41B while the image create/transfer processing is repeated, a predetermined registration deviation amount is generated in response to the timing of contact and separation. As a profile of this itself is inherently determined by the apparatus structure, operation conditions, etc., the profile per se does not change unless the apparatus structure or the operation sequence is changed. Still, it is possible to reduce a registration deviation to zero or suppress a registration deviation in the reference toner image, by moving transfer start positions for toner images in at least one or more toner colors in the sub scanning direction based on the registration deviation amount. For example, with respect to the cyan toner image C2, as shown in FIG. 20, since the transfer start position of the cyan toner image C2 has the deviation amount A34 in the (+) direction from the reference transfer start position while the registration deviation amount does not subsequently increase or decrease, it is possible to reduce the registration deviation amount to zero by controlling such that the transfer start position of the cyan toner image C2 shifts by the deviation amount A34 in the (−) direction.

Hence, prior to actual processing to form an image, a registration deviation amount is obtained in advance through similar analysis to that described above from the apparatus structure, the operation sequences, etc., a registration control amount (which corresponds to A34 described above in the case of cyan, for example) which is necessary to reduce the registration deviation amount to zero or suppress the registration deviation amount is identified, and transfer start positions for toner images in at least one or more toner colors are corrected in the sub scanning direction based on the registration control amount during the actual image create processing, whereby registration deviations are suppressed and a high-quality image is formed. For instance, the amplitude center AC1 through AC4 for the toner colors (Y, C, K) except for the reference toner color (magenta) are matched with the amplitude center AC0 for the reference toner color, so that registration deviations are suppressed and a high-quality image is formed.

B-4. Initial Registration Control Amount Establish Processing

Figure 22:
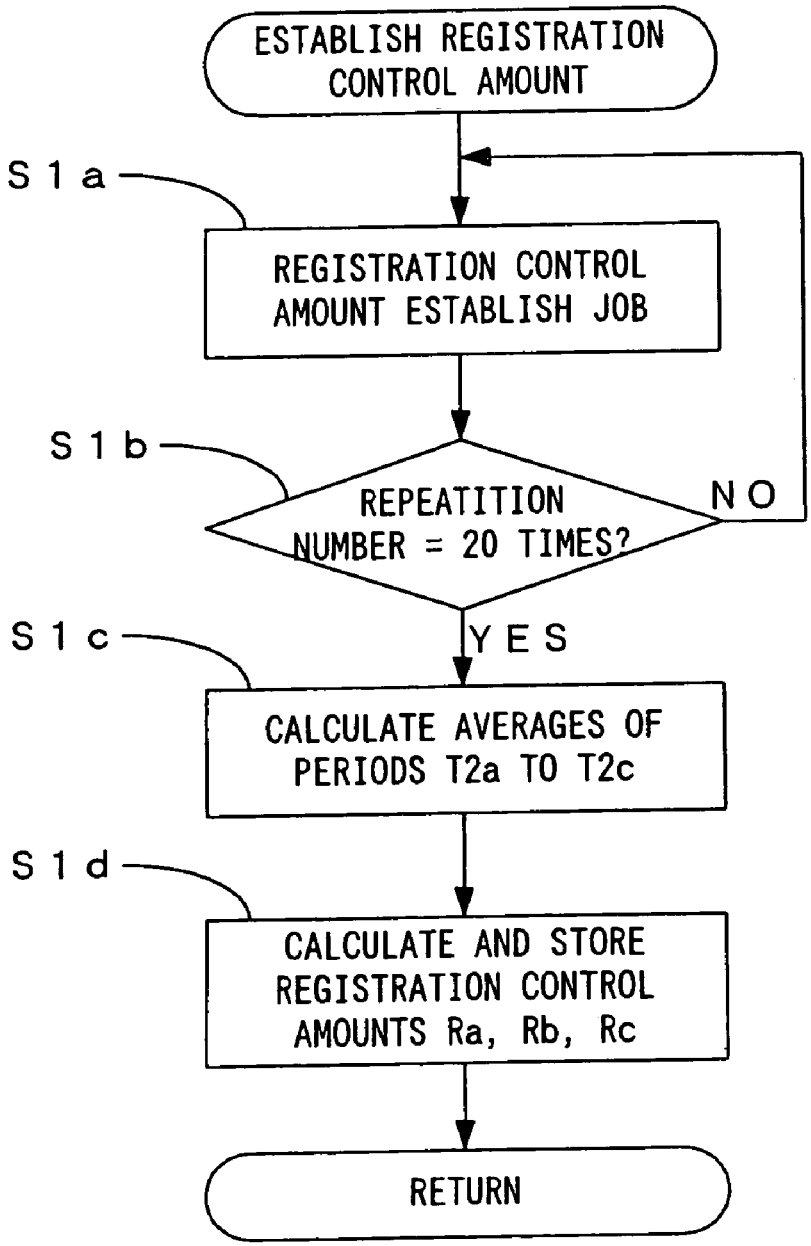
FIG. 22 is a flow chart showing processing for automatically establishing an initial registration control amount (registration control amount establish processing)
Figure 23:
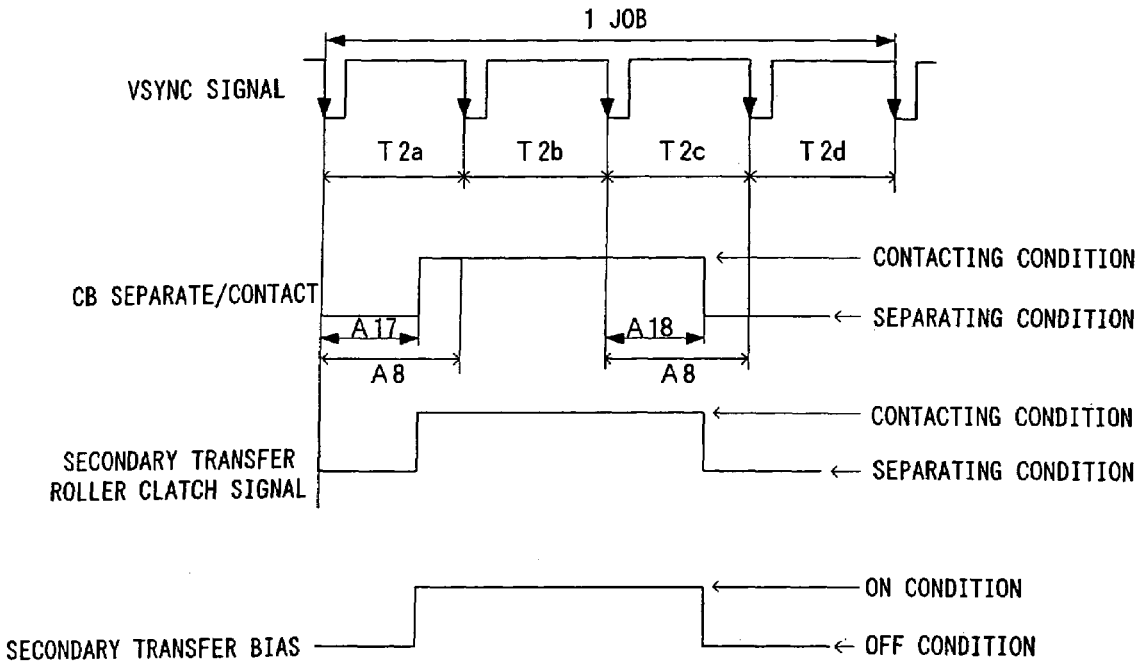
FIG. 23 is a timing chart showing a content of a registration control amount establish job.

FIG. 22 is a flow chart showing processing for automatically establishing a registration control amount. First, the following initial setting conditions are set up in advance based on the apparatus structure of and the operation sequence for the image forming apparatus according to the second preferred embodiment, and stored in a memory 126. This is followed by, as shown in FIG. 23, using the VSYNC signal as a reference, repetition for a predetermined number of times, e.g., twenty times (Step S1*b*) of the registration control amount establish job (Step S1*a*) in which contained as one job are:

(a) a period T2*a* during which the cleaner blade 491 and the secondary transfer roller 48 abut on the intermediate transfer belt 41B;

(b) a period T2*b* during which the cleaner blade 491 and the secondary transfer roller 48 remain abutting on the intermediate transfer belt 41B;

(c) a period T2*c* during which the cleaner blade 491 and the secondary transfer roller 48 move away from the intermediate transfer belt 41B; and (d) a period T2*d* during which the cleaner blade 491 and the secondary transfer roller 48 remain separated away from the intermediate transfer belt 41B.

The initial conditions are:

A2: Process speed (the circumferential speed of the intermediate transfer belt 41B)

A7: Period since the cleaner blade 491 contacts until the primary transfer of a black toner image ends (See FIG. 18)

A8: Period required for the intermediate transfer belt 41B to travel one round A10: Period since the cleaner blade contacts until the primary transfer of a yellow toner image starts (See FIG. 19)

A12: Period since a transfer start position of the yellow toner image until the cleaner blade moves away (See FIG. 19)

A14: Period since the VSYNC signal until the cleaner blade moves away (See FIG. 20)

A17: Time interval between the VSYNC signal and contacting of the cleaner blade during the period T1 (See FIG. 23)

A18: Time interval between the VSYNC signal and separation of the cleaner blade during the period T2*c* (See FIG. 23)

Further, in this preferred embodiment, the electrifying bias and the primary transfer bias are always ON condition while the registration control amount establish job (Step S1*a*) is repeatedly executed. Although not shown in FIG. 16, a diselectrifying lamp is disposed between the primary transfer region TR1 and the photosensitive member cleaner blade 24 and is always set ON condition. Moreover, while the secondary transfer roller 48 remains abutting on the intermediate transfer belt 41B, a secondary transfer bias is applied so that registration control amounts are obtained in a condition close to actual printing.

After twenty actual measurement values are obtained for the respective periods T2*a* to T2*d*, average values T2*a*(av) to T2*d*(av) of the measurement values are calculated (Step S1*c*). Further, the registration control amounts Ra, Rb and Rc are calculated from the formulas described below (Step S1*d*). Reasons of this will be described separately.

<Registration Control Amount Ra>

As shown in FIG. 18, since the cleaner blade 491 starts contacting the intermediate transfer belt 41B while the black toner image K1 is being primarily transferred onto the intermediate transfer belt 41B and since the cleaner blade 491 remains abutting at the end of the primary transfer of the black toner image K1 whose size is the A3 size, for instance, the deviation amount A32 is created in the sub scanning direction. The deviation amount A32 is the sum of two stretching elements A6 and A27. That is, $$A32=A6+A27$$

The contact-induced stretching A6 is contact-induced stretching which is created as the intermediate transfer belt 41B rotates with the cleaner blade 491 contacting the same, while the stretching A27 is a combination of instantaneous stretching upon contacting of the cleaner blade 491 with the intermediate transfer belt 41B (elasticity+slipping) and elastic deformation of the power transmission members (e.g., gears and the belt) 91 which transmit dynamic force to the intermediate transfer belt 41B.

First, the stretching A6 will be discussed. While a periodical difference A1 is developed as the cleaner blade 491 stays in contact, the periodical difference A1 is calculated by the following formula:

$$A1=(T2b(av)-T2d(av))\times A2\times 1000$$

Since the cleaner blade 491 stays abutting only for the predetermined period A7 during the primary transfer of the black toner image K1, the contact-induced stretching A6 is:

$$A6=A1\times A7/A8$$

On the other hand, the instantaneous stretching A27 is calculated by comparing the period T2*a* with the period T2*d*. In other words, the instantaneous stretching A27 is calculated by the following formula:

$$A27=(T2a(av)-T2d(av))\times A2\times 1000-A15$$

As the stretching A15 is stretching which is created as the cleaner blade 491 stays abutting for the predetermined time period A17 during the period T2*a* as shown in FIG. 23, the stretching A15 is calculated as:

$$A15=A1\times(A8-A17)/A8$$

Hence, the registration deviation amount A32 is calculated as:

$$A32=A6+A27$$

Therefore, with the transfer start position shifted half this value in advance from the reference transfer start position in the sub scanning direction, a registration deviation in the black toner image K1 is suppressed to minimum. Noting this, in this preferred embodiment, the registration control amount Ra is set as:

$$Ra=A32/2$$

<Registration Control Amount Rb>

As shown in FIG. 19, as the yellow toner image Y2 is formed and transferred on the intermediate transfer belt 41B after the black toner image K1 is formed and transferred, during the period A10 since the contact of the cleaner blade until the primary transfer of the yellow toner image starts, the stretching A30 (=A27+A9) is created in the sub scanning direction. In addition, while the stretching A11 is developed since the cleaner blade 491 stays abutting on the intermediate transfer belt 41B even after the start of the primary transfer, contraction A26 is created as the cleaner blade 491 moves away from the intermediate transfer belt 41B immediately before the primary transfer completes and the intermediate transfer belt 41B and the power transmission members 91 which used to be elastically deformed return to their original conditions. Hence, as shown in FIG. 19, when the contraction A26 is larger than the stretching A11, the registration control amount Rb is set as:

$$Rb=A35-A26/2$$

with the condition that:

$$A35=A30+A11$$

Conversely, in the opposite condition (A26<A11), the registration control amount Rb is set as:

$$Rb=A35-A11/2$$

In this manner, it is possible to suppress a registration deviation of the yellow toner image to minimum.

Although the stretching A30 at the start of the primary transfer is:

$$A30=A27+A9$$

as described above, since the stretching A9 is stretching which is created as the intermediate transfer belt 41B rotates with the cleaner blade 491 contacting the same for the period A10, the stretching A9 is calculated as:

$$A9=A1\times A10/A8$$

Meanwhile, since the stretching A11 is stretching which is created as the cleaner blade 491 stays abutting on the intermediate transfer belt 41B even after the start of the primary transfer, the stretching A11 is calculated as:

$$A11=A1\times A12/A8$$

Further, the contraction A26 is created the cleaner blade 491 moves away from the intermediate transfer belt 41B, the contraction A26 is calculated by comparing the period T2*c* with the period T2*d*. In other words, the contraction A26 is calculated by the following formula:

$$A26=A25-(T2c(av)-T2d(av))\times A2\times 1000$$

In the formula above, denoted at A25 is stretching during the period T2*c* as shown in FIG. 23, and is calculated as:

$$A25=A1\times A18/A8$$

<Registration Control Amount Rc>

As shown in FIG. 20, during the image create/transfer processing of a cyan toner image after the yellow toner image is formed and transferred, the cleaner blade 491 contacts the intermediate transfer belt 41B when the VSYNC signal VT6, which is a reference used in this image create/transfer processing, is outputted, and the intermediate transfer belt 41B rotates with the cleaner blade 491 contacting the same for the period A14 until the primary transfer of the cyan toner image is thereafter started. Hence, the stretching A13 is created. That is, the stretching A13 is:

$$A13=A1\times A14/A8$$

Further, as the cleaner blade 491 moves away from the intermediate transfer belt 41B, the contraction A26 is created as described above under the section <Registration Control Amount Rb>. Hence, while the registration deviation amount A34 (=A13−A26) is created at the start of the primary transfer of the cyan toner image, a deviation in the sub scanning direction does not occur during the primary transfer. Noting this, in this preferred embodiment, since it is possible to suppress a registration deviation of the cyan toner image to zero as the transfer start position is shifted by this value (the registration deviation amount A34) in advance in the sub scanning direction, the registration control amount Rc is set as:

$$Rc=A34$$

B-5. Correction of Transfer Start Position

Figure 24:
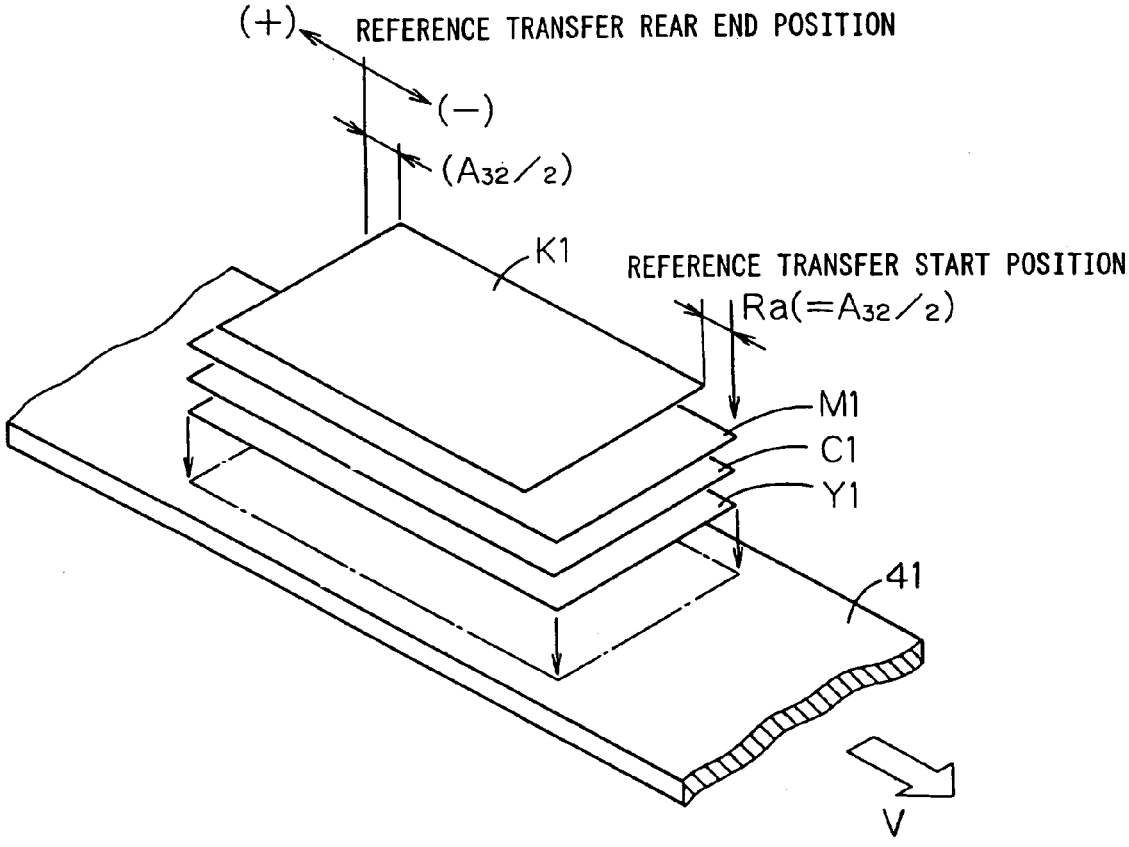
FIG. 24 is a schematic drawing showing a state of registration of toner images in the image forming apparatus shown in FIG. 16 which arises as primary transfer is executed at operation timing as that shown in FIG. 4 while performing registration control.

In reality, while color images are serially printed starting with the first one, the transfer start positions are corrected and registration deviations are suppressed as described below. For printing of the first color image, since the flag F0 which corresponds to the first printing sequence is set up at the step S4 shown in FIG. 3, at the step S5 shown in FIG. 3, "0" is set as the registration control amounts for the yellow toner image Y1, the cyan toner image C1 and the magenta toner image M1, whereas the initial registration control amount Ra is set as the registration control amount for the black toner image K1. Hence, the yellow toner image Y1, the cyan toner image C1 and the magenta toner image M1 are all formed at a predetermined position on the photosensitive member 21, i.e., at the reference latent image forming position, and primarily transferred at the same position onto the intermediate transfer belt 41B which rotates in synchronization with the photosensitive member 21. In consequence, as shown in FIG. 24, the transfer start positions of the three toner images Y1, C1 and M1 all coincide with the reference transfer start position, and so do the transfer rear end positions of the three toner images with the reference transfer rear end position.

Figure 25:
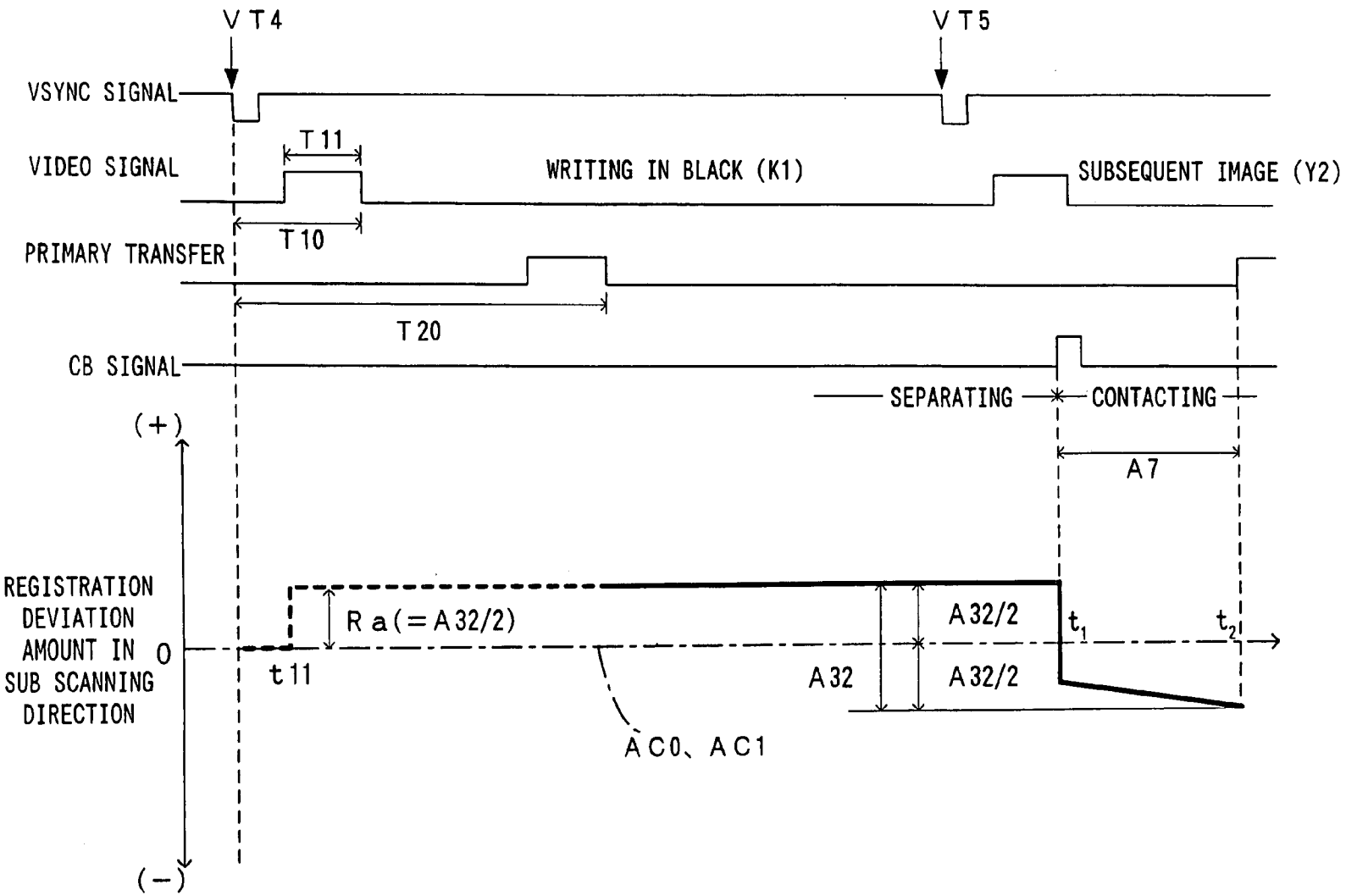
FIG. 25 is a drawing showing a content of registration control for transfer of a black toner image in the image forming apparatus shown in FIG. 16.

On the other hand, as to the black toner image K1, since the initial registration control amount Ra is set as the registration control amount, as shown in FIG. 25, using the vertical synchronizing signal VSYNC which is outputted at the timing VT4 as a reference, the photosensitive member 21 is accelerated/decelerated under control at the timing t11 of the acceleration/deceleration period T11, whereby the latent image forming position for the black toner image is shifted by the control amount Ra (=A32/2) from the reference latent image forming position toward the (+) side of the sub scanning direction. Further, while the immediately precedent toner image (the magenta toner image M1) is still being primarily transferred during the acceleration/deceleration period T11, since the intermediate transfer belt 41B is driven under control in synchronization with the photosensitive member 21 in this preferred embodiment, the toner image which is primarily transferred in parallel with the acceleration/deceleration of the photosensitive member 21 and the intermediate transfer belt 41B is not disturbed.

The latent image formed on the photosensitive member 21 in the manner above is visualized by the developer 23K, and the resulting black toner image K1 is primarily transferred onto the intermediate transfer belt 41B. As a result, as shown in FIG. 24, the transfer start position of the black toner image K1 is shifted by the registration control amount Ra from the reference transfer start position in the (+) direction.

The primary transfer progresses, and at the timing t1 at the beginning of the latter half of this, as shown in FIG. 25, the CB signal which controls the operations of the cleaner blade 491 rises from the L level to the H level, and the cleaner blade 491 contacts the intermediate transfer belt 41B, thereby shifting the black toner image K1 from the other toner images Y1, C1 and M1 in the sub scanning direction. An eventual registration deviation amount of the black toner image K1 in the sub scanning direction becomes the deviation amount (A32/2) along the (−) direction, although the registration deviation increases even larger as this contacting condition continues until the timing t2. That is, with the transfer start position of the black toner image K1 shifted by the registration control amount Ra from the reference transfer start position in the (+) direction, the amplitude center AC1 for the black color is matched with the amplitude center AC0 for the magenta color which is the reference toner color, which in turn matches the amplitude center of registration deviations in the respective toner colors in the sub scanning direction with each other during the subsequent image create/transfer processing in all of the toner colors.

As a result, in this preferred embodiment, as shown in FIG. 24, the black toner image K1 is shifted by the deviation amount (A32/2) on the transfer start side from the other toner images Y1, C1 and M1 in the (+) direction, but is shifted by the deviation amount (A32/2) on the transfer rear end side from the other toner images in the (−) direction. Therefore, a maximum deviation amount is half that in the case where the registration control is not performed (FIGS. 17 and 18).

Next, for creation of the second color image following the first color image (the second printing sequence), after the sequence flag F1 is set up as the sequence flag at the step S4 in FIG. 3, a high-quality image is formed while suppressing registration deviations in the manner described below.

That is, a registration control amount corresponding to the sequence flag F1 is set at a step S5. More precisely, the initial registration control amount Rb is set as the registration control amount for the yellow toner image Y2, the initial registration control amount Rc is set as the registration control amount for the cyan toner image C2, "0" is set as the registration control amount for the magenta toner image M2, and the initial registration control amount Ra is set as the registration control amount for the black toner image K2. The registration control is then performed on the respective toner images.

Figure 26:
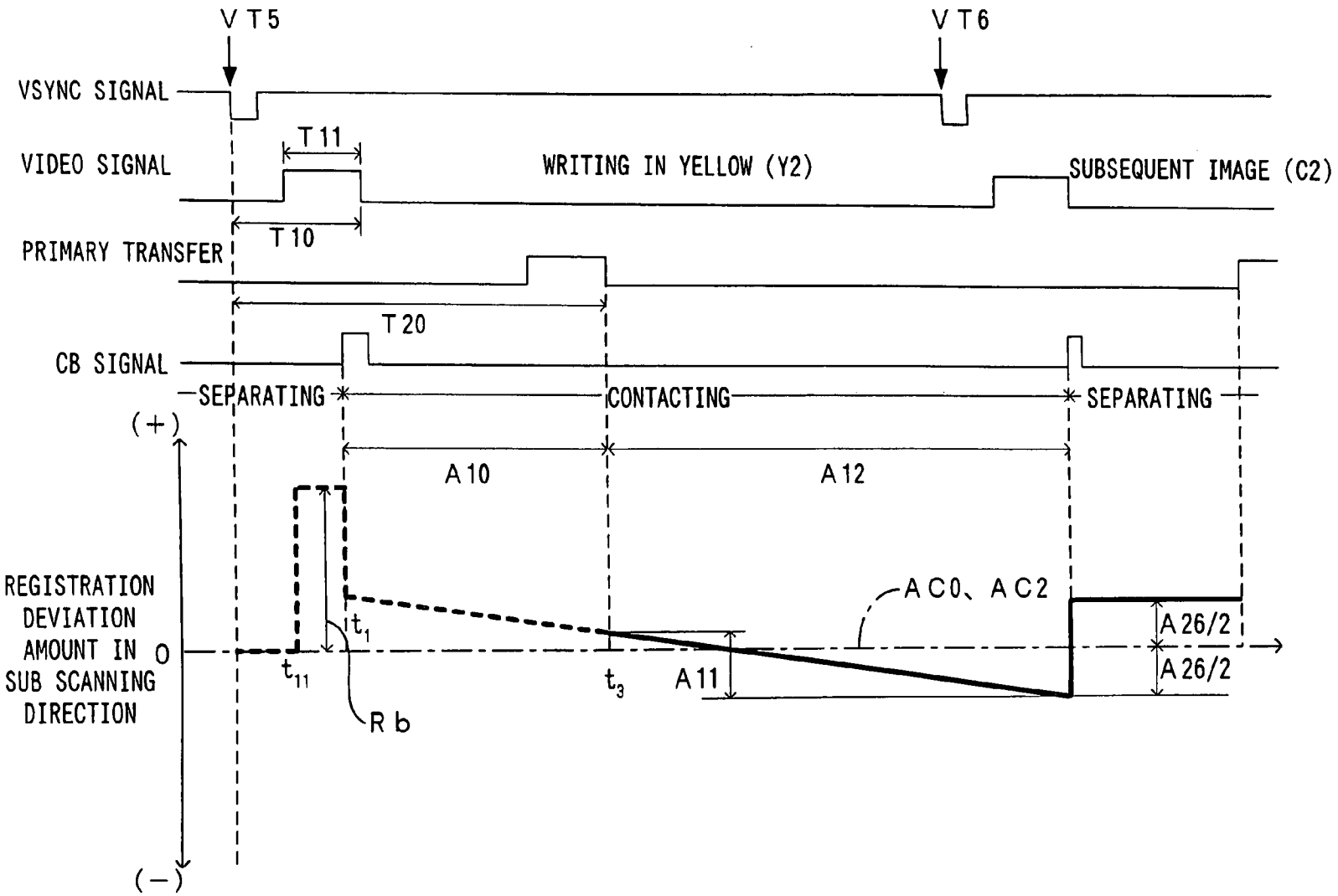
FIG. 26 is a drawing showing a content of registration control for transfer of a yellow toner image in the image forming apparatus shown in FIG. 16.

First, as to the yellow toner image Y2, since the initial registration control amount Rb is set as the registration control amount, as shown in FIG. 26, using the vertical synchronizing signal VSYNC which is outputted at the timing VT5 as a reference, the photosensitive member 21 is accelerated/decelerated under control at the timing t11 of the acceleration/deceleration period T11, whereby the latent image forming position for the yellow toner image is shifted by the control amount Rb from the reference latent image forming position toward the (+) side of the sub scanning direction. The latent image is thereafter visualized by the developer 23Y.

The CB signal rises from the L level to the H level at the timing t1, and the cleaner blade 491 which used to be away contacts the intermediate transfer belt 41B. Following this, a deviation (A26/2) is created on the transfer rear end side in the (+) direction with the registration deviation amount changing as expressed by the profile denoted at the thick solid line in FIG. 26 as the transfer of the yellow toner image Y2 is executed. However, the maximum deviation amount from the reference toner image (the magenta toner image M2) is largely reduced as compared with where the registration control is not performed (FIG. 19).

As described above, in this preferred embodiment, as the latent image forming position on the photosensitive member 21 is shifted by the registration control amount Rb from the reference latent image forming position in the sub scanning direction, the transfer start position of the second yellow toner image Y2 is adjusted. This matches the amplitude center AC2 for the yellow color with the amplitude center AC0 for the magenta color which is the reference toner color. Hence, it is possible to suppress the deviation amount from the reference toner image (the magenta toner image M2) within the range of (A26/2).

Figure 27:
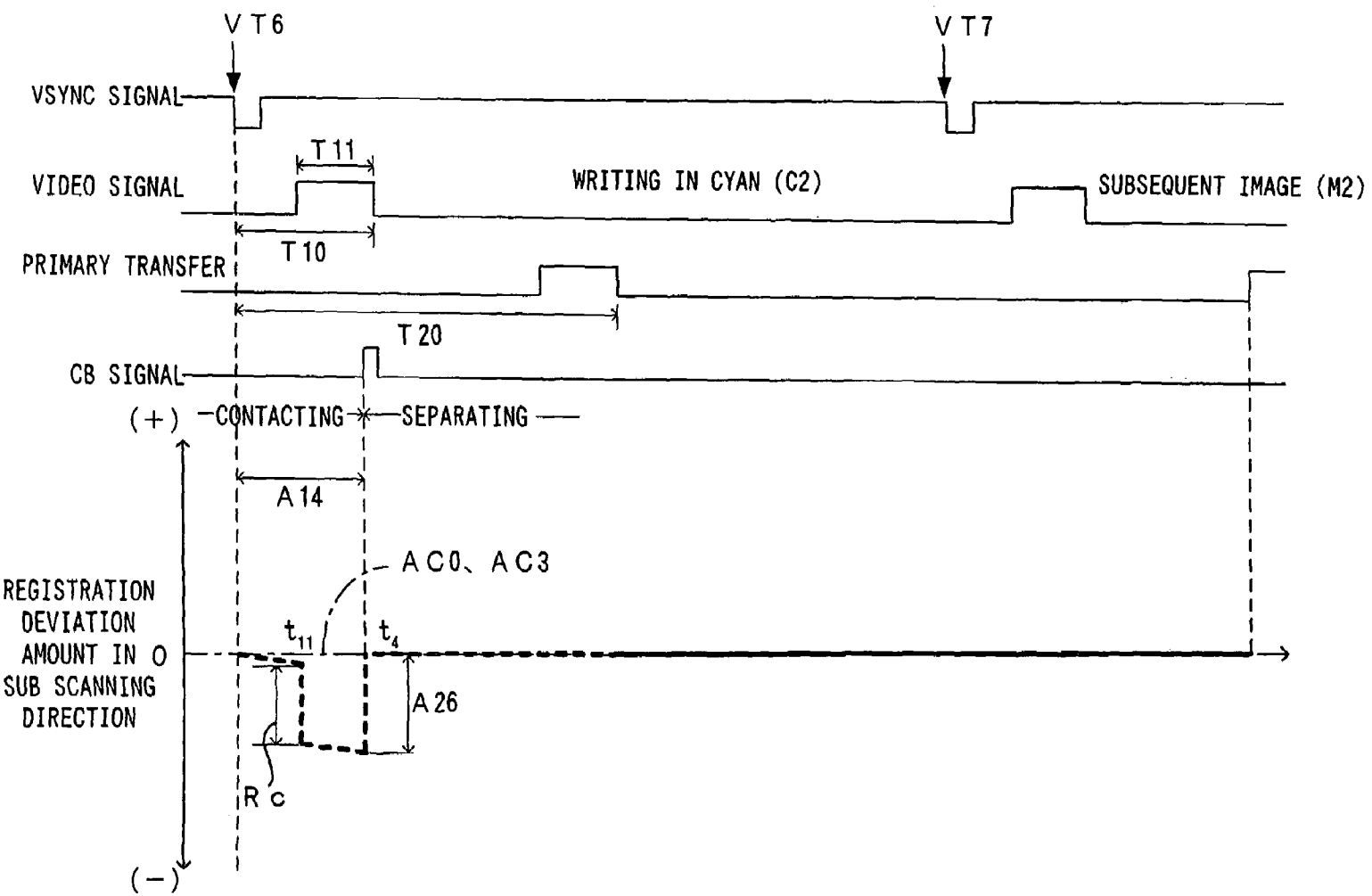
FIG. 27 is a drawing showing a content of registration control for transfer of a cyan toner image in the image forming apparatus shown in FIG. 16.

The image create/transfer processing of the cyan toner image C2 is executed following the second yellow toner image Y2, for which the initial registration control amount Rc is set as the registration control amount for the cyan toner image C2. Hence, as shown in FIG. 27, using the vertical synchronizing signal VSYNC which is outputted at the timing VT6 as a reference, at the timing t11 of the acceleration/deceleration period T11, the surface velocity of the photosensitive member 21 and the surface velocity V of the intermediate transfer belt 41B are slowed down temporarily, thereby reducing the amount of rotation of the photosensitive member 21 and the amount of travelling of the intermediate transfer belt 41B by the registration control amount Rc more as compared to where these rotate at a constant speed (the reference toner image, namely, the magenta toner image). In consequence, the latent image forming position on the photosensitive member 21 is shifted by the registration control amount Rc from the reference latent image forming position in the sub scanning direction.

Following this, the developer 23C visualizes the latent image which is formed on the photosensitive member 21 as described above, and the resulting cyan toner image C2 is primarily transferred onto the intermediate transfer belt 41B. Hence, the registration deviation amount (A26) due to contacting and leaving of the cleaner blade 491 coincides with the shift amount Rc of the toner image C2 on the photosensitive member 21, which in turn matches the transfer start position of the cyan toner image C2 with the reference transfer start position.

Further, since the CB signal rises from the L level to the H level at the timing t4 which comes before the start of the primary transfer of the cyan toner image C2 onto the intermediate transfer belt 41B and since the cleaner blade 491 which used to contact the intermediate transfer belt 41B moves away from the intermediate transfer belt 41B, a registration deviation is not created during the primary transfer. Because of this, the transfer rear end position of the cyan toner image C2 coincides with the transfer rear end position.

As described above, in this preferred embodiment, as the photosensitive member 21 and the intermediate transfer belt 41B are accelerated/decelerated under control based on the registration control amount Rc, the amplitude center AC3 for the cyan color is matched with the amplitude center AC0 for the magenta color which is the reference toner color. Hence, it is possible to suppress a deviation amount from the reference toner image (the magenta toner image M2) to zero.

The image create/transfer processing of the magenta toner image M2 is executed following the cyan toner image C2, during which neither the cleaner blade 491 nor the secondary transfer roller 48 ever abut or move away and the transfer start position and the transfer rear end position of the magenta toner image M2 coincide respectively with the reference transfer start position and the transfer rear end position.

As the toner images Y2, C2 and M2 in the three colors are completed, the primary transfer in the last toner color, i.e., for the black toner image K2 is executed. During this primary transfer, as in the case of the first black toner image K1, as the latent image forming position on the photosensitive member 21 is shifted by the registration control amount Rb in the sub scanning direction, the amplitude center AC1 for the black color is matched with the amplitude center AC0 for the magenta color which is the reference toner color.

Hence, there is a deviation (A32/2) on the transfer start side from the reference toner image in the (+) direction and a deviation (A32/2) on the transfer rear end side from the reference toner image in the (−) direction. Therefore, a maximum deviation amount is half that where the registration control is not performed (FIGS. 17 and 18).

In this manner, as to the second sheet as well, for all toner colors, the surface velocity of the photosensitive member 21 and the surface velocity of the intermediate transfer belt 41B are accelerated/decelerated in synchronization under control based on the registration control amounts for the respective toner colors in such a manner that the amplitude center of registration deviations in the sub scanning direction for the respective toner colors match with each other during the transfer processing, whereby the transfer start positions of the toner images are corrected. In short, with respect to the three colors of yellow (Y), cyan (C) and black (K) among the four toner colors, the transfer start positions of the toner images are corrected based on the registration control amounts. As a result, the cyan toner image C2 is registered completely to the magenta toner image M2 which is the reference toner image, and although the yellow toner image Y2 and the black toner image K2 may not be registered completely to the reference toner image, registration deviation amounts of the yellow toner image Y2 and the black toner image K2 are suppressed to minimum, which makes it possible to form a high-quality image.

Meanwhile, when the flag F2 is set up, the initial registration control amount Rc is set as the registration control amount for a yellow toner image Yn, "0" is set as the registration control amount for a cyan toner image Cn and a magenta toner image Mn, and the initial registration control amount Ra is set as the registration control amount for a black toner image Kn. The registration control is thereafter executed for each toner image.

Figure 28:
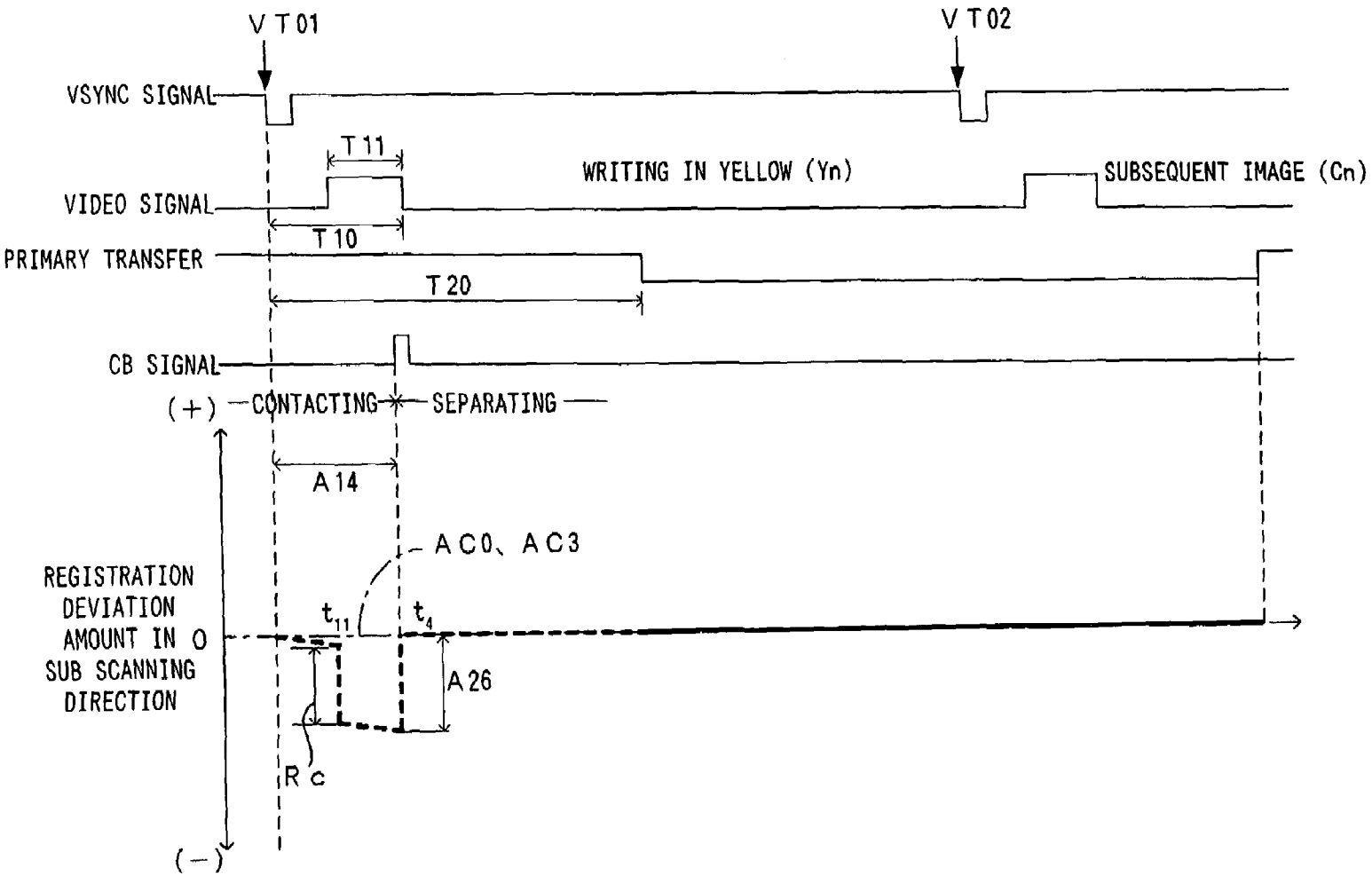
FIG. 28 is a drawing showing a content of registration control for transfer of a yellow toner image in the image forming apparatus shown in FIG. 16.

First, as to the yellow toner image Yn, since the initial registration control amount Rc is set as the registration control amount, as shown in FIG. 28, using the vertical synchronizing signal VSYNC which is outputted at the timing VT01 as a reference, at the timing t11 of the acceleration/deceleration period T11, the surface velocity of the photosensitive member 21 and the surface velocity V of the intermediate transfer belt 41B are slowed down temporarily, thereby reducing the amount of rotation of the photosensitive member 21 and the amount of travelling of the intermediate transfer belt 41B by the registration control amount Rc more as compared to where these rotate at a constant speed (that is, as compared to the reference toner image, namely, the magenta toner image). In consequence, the latent image forming position on the photosensitive member 21 is shifted by the registration control amount Rc from the reference latent image forming position in the sub scanning direction.

The latent image which is formed on the photosensitive member 21 as described above is thereafter visualized by the developer 23Y, and the resulting yellow toner image Yn is primarily transferred onto the intermediate transfer belt 41B. Hence, the registration deviation amount (A26) due to contacting and leaving of the cleaner blade 491 coincides with the shift amount Rc of the toner image Yn on the photosensitive member 21, which in turn matches the transfer start position of the yellow toner image Yn with the reference transfer start position.

Further, since the CB signal rises from the L level to the H level at the timing t4 which comes before the start of the primary transfer of the yellow toner image Yn onto the intermediate transfer belt 41B and since the cleaner blade 491 which used to contact the intermediate transfer belt 41B is away from the intermediate transfer belt 41B, a registration deviation is not created during the primary transfer. Because of this, the transfer rear end position of the yellow toner image Yn coincides with the transfer rear end position.

As described above, in this preferred embodiment, as the photosensitive member 21 and the intermediate transfer belt 41B are accelerated/decelerated under control based on the registration control amount Rc, the amplitude center AC4 for the yellow color is matched with the amplitude center AC0 for the magenta color which is the reference toner color. Hence, it is possible to suppress a deviation amount from the reference toner image (the magenta toner image Mn) to zero.

The image create/transfer processing is executed for the cyan toner image Cn and the magenta toner image Mn serially following the yellow toner image Yn. During this image create/transfer processing, neither the cleaner blade 491 nor the secondary transfer roller 48 ever abut or move away, the amplitude center for the two toner colors coincide with each other, and the transfer start positions and the transfer rear end positions of the toner images Cn and Mn coincide respectively with the reference transfer start position and the transfer rear end position.

As the toner images Yn, Cn and Mn in the three colors are completed, the primary transfer in the last toner color, i.e., for the black toner image Kn is executed. During this primary transfer, similarly to the first and the second printing sequences, the photosensitive member 21 and the intermediate transfer belt 41B are accelerated/decelerated under control based on the registration control amount Rc, and therefore, the amplitude center AC1 for the black color is matched with the amplitude center AC0 for the magenta color which is the reference toner color. Hence, there is a deviation (A32/2) on the transfer start side from the reference toner image in the (+) direction and a deviation (A32/2) on the transfer rear end side from the reference toner image in the (−) direction. Therefore, a maximum deviation amount is half that where the registration control is not performed (FIGS. 17 and 18).

Thus, for color printing after idling as well, the transfer start positions of the toner images in the two colors of yellow and black out of the four toner colors are corrected based on the registration control amounts. In other words, as to all toner colors, the photosensitive member 21 and the intermediate transfer belt 41B are accelerated/decelerated under control based on the registration control amount Rc for the respective toner colors in such a manner that the amplitude center of registration deviations in the sub scanning direction for the respective toner colors match with each other during the transfer processing, whereby the transfer start positions of the toner images are corrected. This as a result allows to completely register the yellow toner image Yn, the cyan toner image Cn and the magenta toner image (the reference toner image) Mn to each other and to suppress a registration deviation amount of the black toner image Kn to minimum although the black toner image Kn may not be registered completely to the reference toner image, which in turn makes it possible to form a high-quality image.

B-6. Functions and Effects

As described above, the second preferred embodiment promises the following functions and effects. First, since the abutting means (the secondary transfer roller 48, the cleaner blade 491, etc.) is allowed to contact and move away from the intermediate transfer belt 41B which is a transfer medium while the image create/transfer processing is repeated, the intermediate transfer belt 41B and the power transmission members 91 are elastically deformed as described earlier, which serves as a main cause of a registration deviation. However, it is possible to suppress a registration deviation to minimum by calculating registration control amounts which are necessary to correct registration deviations in accordance with the printing sequence state and thereafter correcting transfer start positions for toner images in at least one or more toner colors out of the four toner colors based on the calculated registration control amounts. More precisely, in this preferred embodiment, with respect to the black, the yellow and the cyan colors, the amplitude center AC1, AC2 (or AC4) and AC3 of registration deviations in the sub scanning direction during the image create/transfer processing in the respective toner colors are matched with the amplitude center AC0 for the magenta color which is the reference toner color, and hence, registration deviations among all toner colors are suppressed to minimum and a high-quality color image is obtained.

One of the functions and effects according to this preferred embodiment which is to be particularly noted is that this preferred embodiment requires to calculate the registration control amount Rc which is for a situation that the abutting means, such as the cleaner blade 491, moves away from the intermediate transfer belt 41B before the primary transfer is started after the reference signal (the vertical synchronizing signal VSYNC) for the image create/transfer processing is outputted, to thereby effectively suppress registration deviations of the second cyan image and the like based on the calculated registration control amount Rc.

Further, while an approach to deal with a registration deviation which is created as the cleaner blade 491 contacts as described above may be to increase the Young's modulus of the intermediate transfer belt 41B so that contact-induced stretching upon the contact is suppressed and hence the amount of the deviation is suppressed, this approach imposes a limitation on material which can be used as the belt and accordingly increases a cost. In addition, as this is not directly applicable to apparatuses which have been already designed and manufactured, the apparatuses have to be improved. In contrast, since this preferred embodiment permits to suppress registration deviations and enhance an image quality independently of the apparatus structure, this preferred embodiment is a more versatile technique.

In addition, although the second preferred embodiment has been described above on the premise that both the intermediate transfer belt 41B and the power transmission members 91 are elastically deformed, the invention according to the second preferred embodiment realizes the functions and effects above even when such elastic deformation is not created by a load change, as the power transmission members 91 are formed by a highly rigid material, such as metal and a ceramic material.

C. Third Preferred Embodiment

In the first and the second preferred embodiments described above, for the purpose of adjusting a transfer start position in accordance with a registration control amount, the photosensitive member 21 and the transfer medium (the intermediate transfer drum 41D, the intermediate transfer belt 41B) are controlled at a variable speed in synchronization with each other and a latent image forming position on the photosensitive member 21 is shifted in the sub scanning direction in accordance with the registration control amount. A method of shifting the latent image forming position on the photosensitive member 21 may be to control the exposure timing, instead of driving the photosensitive member and the transfer medium under control as described above. Alternatively, the drive-control of photosensitive member/transfer medium may be combined with the exposure timing control, which is a third preferred embodiment that will be described below with reference to FIGS. 29 through 32.

Figure 29:
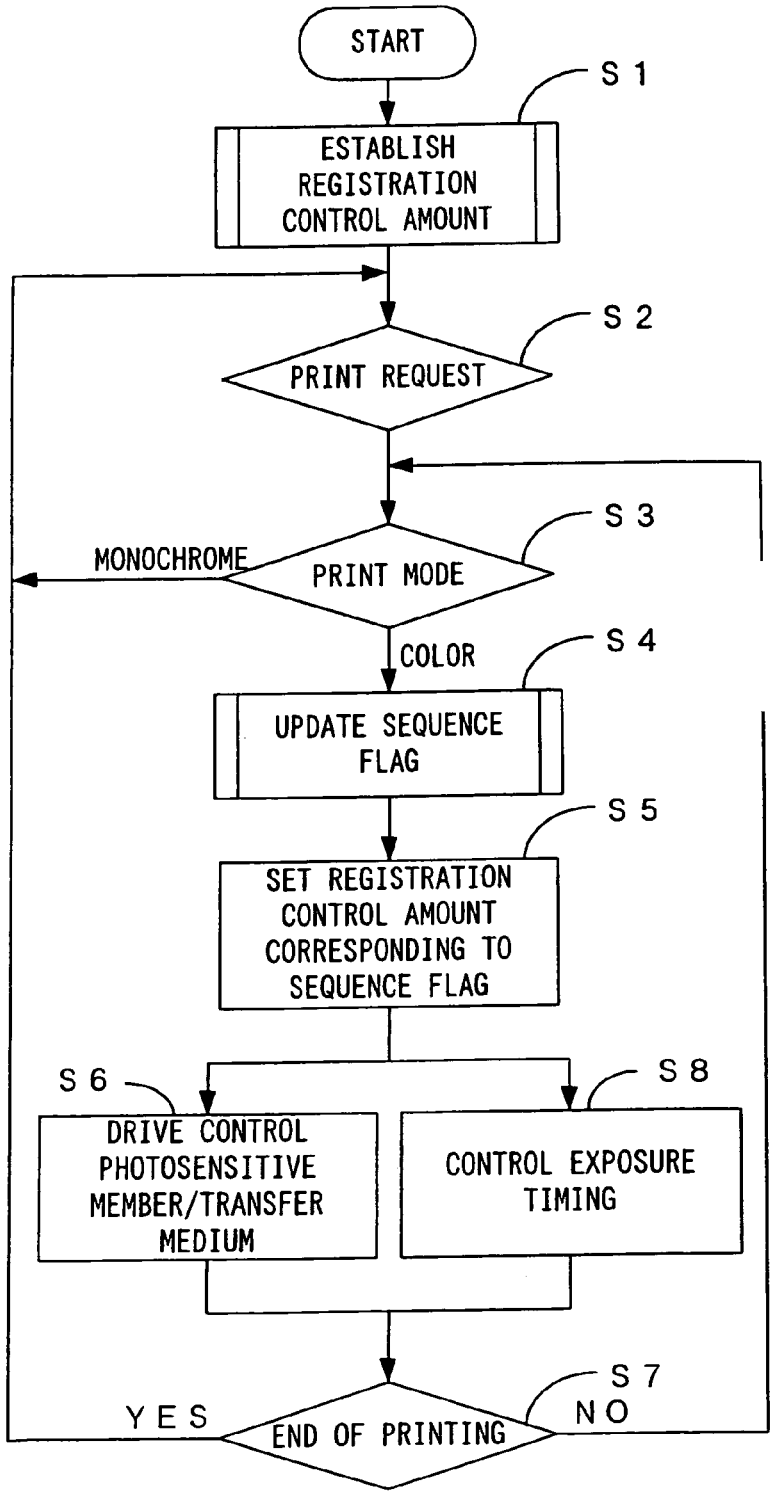
FIG. 29 is a flow chart showing operations in the image forming apparatus according to the second preferred embodiment of the present invention.

FIG. 29 is a flow chart showing operations in the image forming apparatus according to the third preferred embodiment of the present invention. In the third preferred embodiment, after a registration control amount corresponding to each sequence flag is set up in a manner similar to those in the first and the second preferred embodiments (Step S4), the photosensitive member 21 and the transfer medium are controlled at a variable speed during the variable speed period T11 (Step S6), while an exposure start timing is advanced or delayed so that a latent image forming position on the photosensitive member 21 is shifted in the sub scanning direction (Step S8).

To combine the drive-control of photosensitive member/transfer medium (Step S6) with the exposure timing control (Step S8) is effective when a registration control amount is relatively large. This is because as a registration control amount is relatively large during the image create/transfer processing of the yellow toner image Y2, the cyan toner image C2 or the like or during the image create/transfer processing of a yellow toner image Yn in the second preferred embodiment, for example, if only the drive-control of photosensitive member/transfer medium is used to correct a registration deviation, it is necessary to set the rotation speed of the photosensitive member 21 and a rate of change in belt velocity V large to be commensurate with the relatively large registration control amount, which degrades the accuracy of the drive-control of photosensitive member/transfer medium and increases a motor load.

Figure 30:
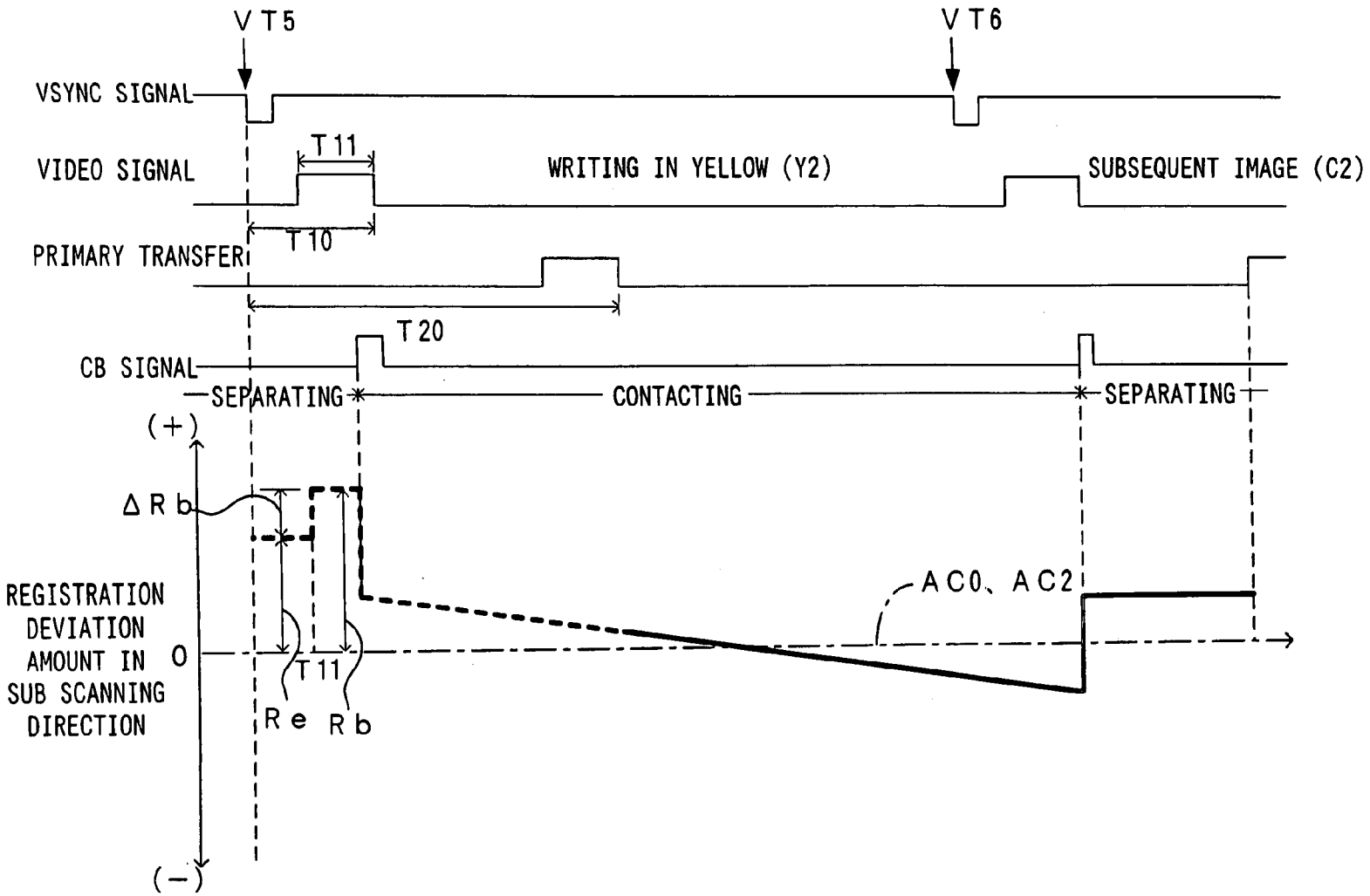
FIG. 30 is a drawing showing a content of registration control for transfer of a yellow toner image in the image forming apparatus shown in FIG. 29.

In contrast, for the image create/transfer processing of the yellow toner image Y2 in the second preferred embodiment, as shown in FIG. 30, with the exposure timing control executed so as to set up a deviation of one dot line, i.e., a line interval Re, along (+) side in the sub scanning direction, it is possible to suppress the amount of shifting of a latent image forming position due to the drive-control of photosensitive member/transfer medium to $\Delta Rb$ (<Rb).

Figure 31:
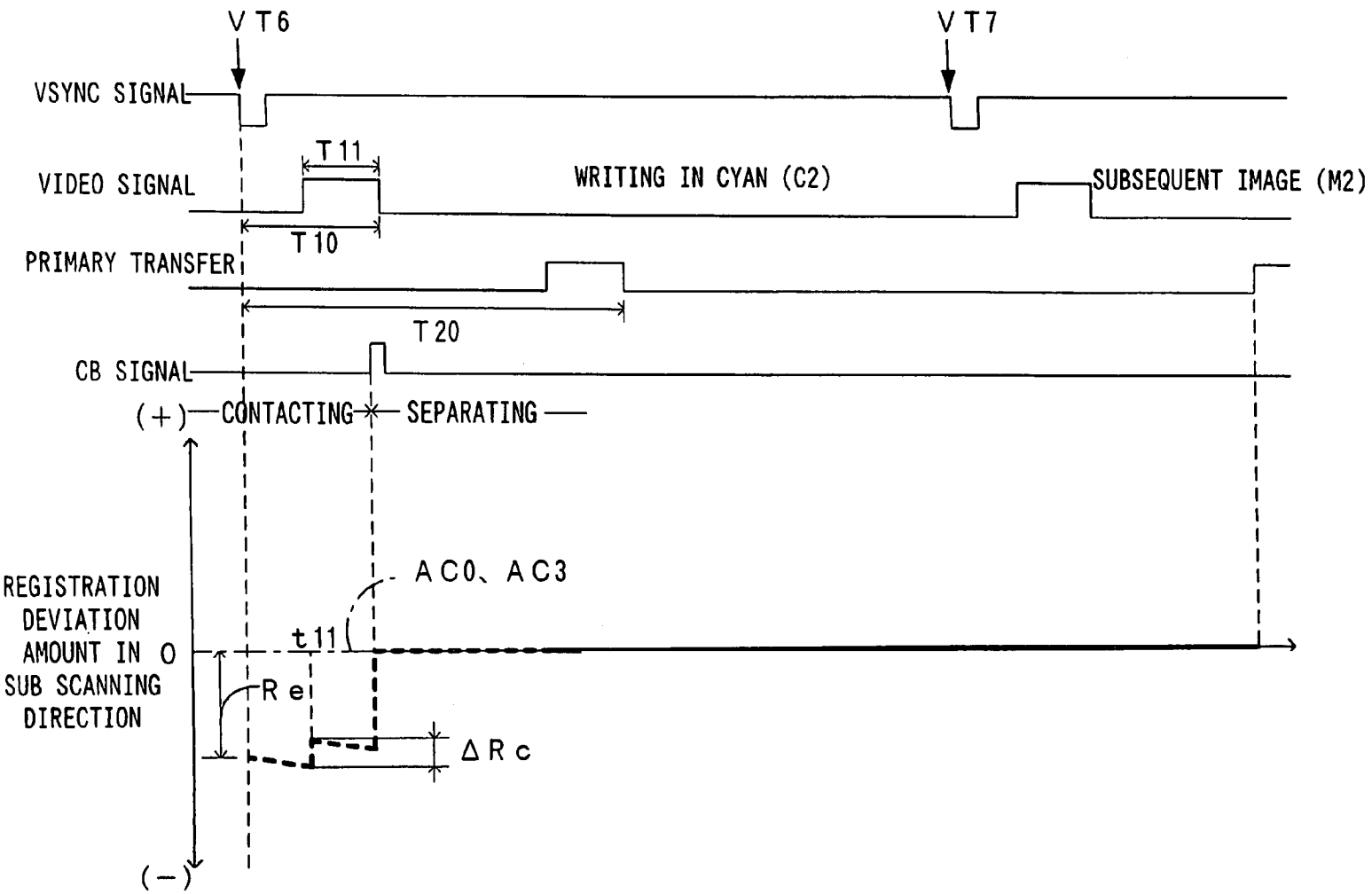
FIG. 31 is a drawing showing a content of registration control for transfer of a cyan toner image in the image forming apparatus shown in FIG. 29.

Further, for the image create/transfer processing of the cyan toner image C2 in the second preferred embodiment, as shown in FIG. 31, with the exposure timing control executed so as to set up a deviation of one dot line, i.e., the line interval Re, along (−) side in the sub scanning direction, it is possible to suppress the amount of shifting of the latent image forming position due to the drive-control of photosensitive member/transfer medium to $\Delta Rc$ (<Rc).

Figure 32:
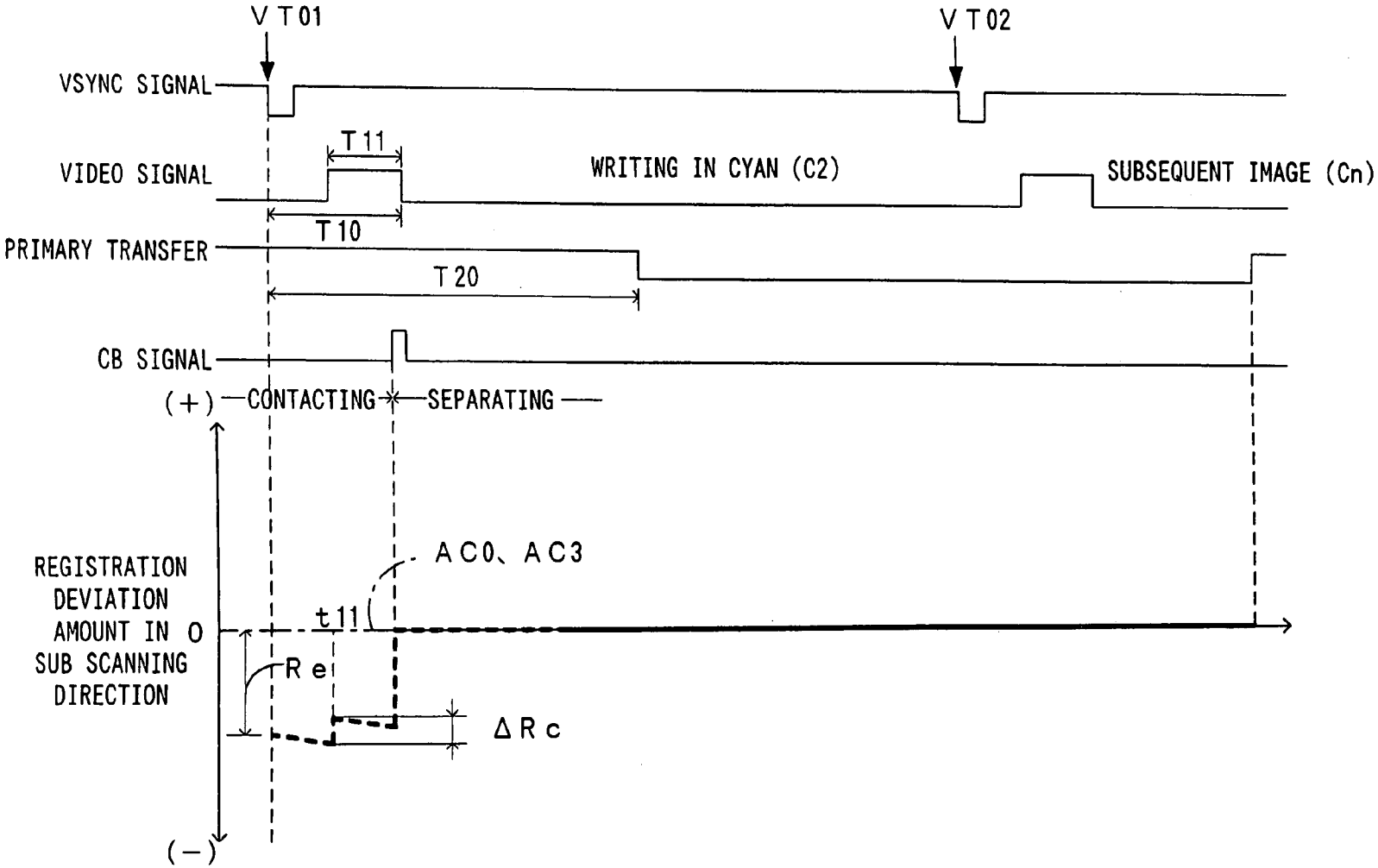
FIG. 32 is a drawing showing a content of registration control for transfer of a yellow toner image in the image forming apparatus shown in FIG. 29.

Moreover, for the image create/transfer processing of a yellow toner image Yn in the second preferred embodiment, as shown in FIG. 32, with the exposure timing control executed so as to set up a deviation of one dot line, i.e., the line interval Re, along (−) side in the sub scanning direction, it is possible to suppress the amount of shifting of the latent image forming position due to the drive-control of photosensitive member/transfer medium to $\Delta Rc$ (<Rc). Hence, it is possible to prevent an excessive load upon the motor which drives the intermediate transfer belt 41B into rotation, and hence, to highly accurately drive the photosensitive member and the transfer medium under control.

While the third preferred embodiment requires to execute the exposure timing control such that the latent image forming positions on the photosensitive member 21 are shifted by the line interval Re in the sub scanning direction (Step S8), when a registration control amount is large, the exposure timing control may be executed to shift by more than one dot lines.

In addition, while the third preferred embodiment requires to combine the exposure timing control with the drive-control of photosensitive member/transfer medium for the purpose of registration control, the latent image forming positions on the photosensitive member 21 may be shifted in accordance with a registration control amount.

D. Fourth Preferred Embodiment

In the preferred embodiments described above, the registration control amount establish processing (Step S1) is executed after the power source of the apparatus is turned on so that the three types of the registration control amounts Ra, Rb and Rc are automatically established and stored in the memory 125 which serves as the memory means, and the updating of sequence flags (Step S4) is executed so that a sequence flag which corresponds to the printing sequence is updated and established and a registration control amount which corresponds to the printing sequence are set up. Instead, the three types of the registration control amounts Ra, Rb and Rc which are calculated through the registration control amount establish processing (Step S1) may be stored in a table format which corresponds to the printing sequences.

In other words, while there are the three sequence flags F0, F1 and F2 each corresponding to each one of the three printing sequences, as shown in Table 1, the sequence flags may be stored in the memory 125 so that the sequence flags are correlated to registration control amounts which correspond to the printing sequences. In this case, as a sequence flag which corresponds to the printing sequence is set up through the updating of sequence flags (Step S4), registration control amounts which correspond to this sequence flag are all read from the table in the memory 125, and the transfer start positions for toner images in at least one or more toner colors out of the four toner colors are thereafter corrected based on the registration control amounts, whereby similar effects to those according to the preferred embodiments described above are obtained.

E. Fifth Preferred Embodiment

Figure 33:
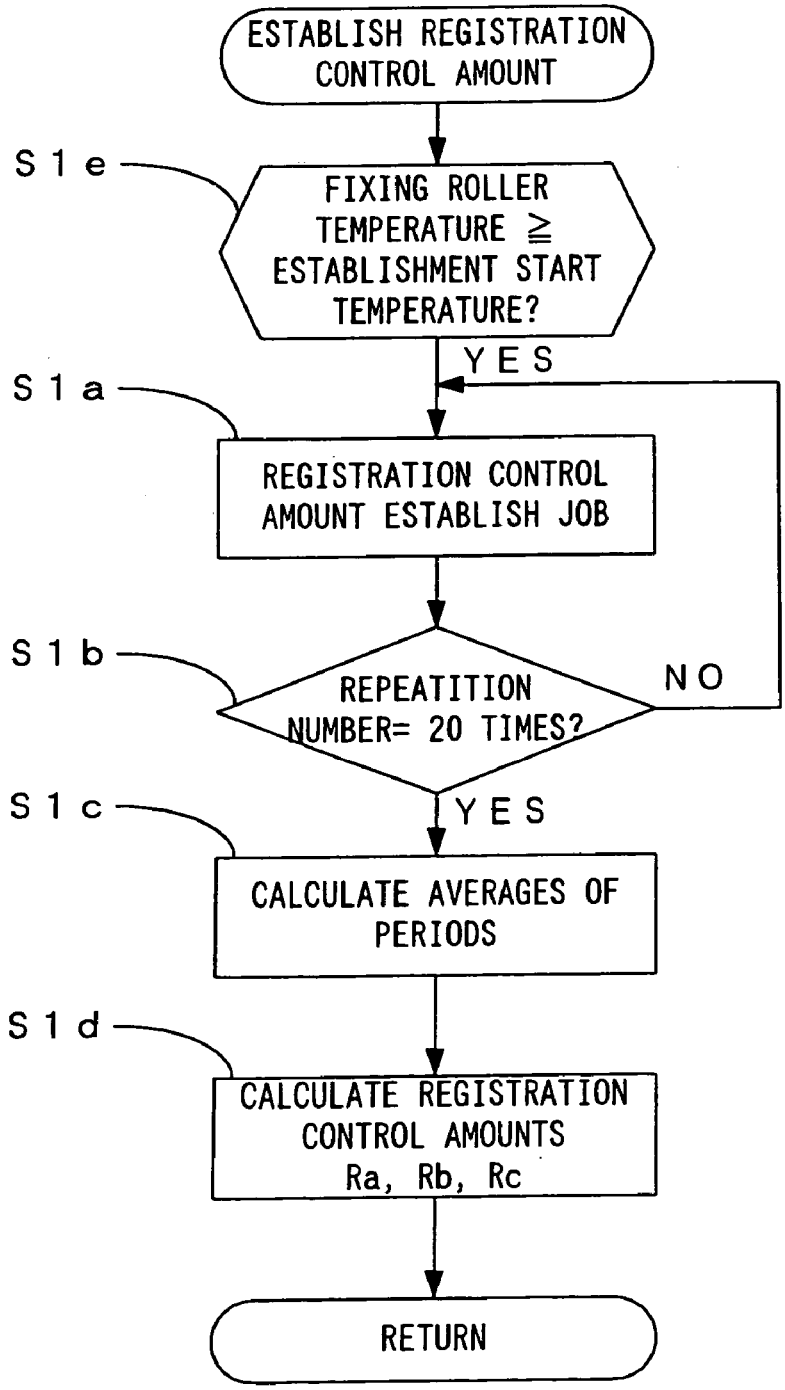
FIG. 33 is a flow chart showing operations in an image forming apparatus according to a fifth preferred embodiment of the present invention.

FIG. 33 is a flow chart showing operations in an image forming apparatus according to a fifth preferred embodiment of the present invention. The image forming apparatus according to the fifth preferred embodiment is largely different from those according to the first and the second preferred embodiments in that the fifth preferred embodiment additionally uses a start condition for the registration control amount establish processing. That is, while the registration control amount establish job is executed immediately after the power source of the apparatus is turned on in the first and the second preferred embodiments, in the fifth preferred embodiment, at a step S1*e*, the CPU 121 receives an output (a temperature of a fixing roller) from the temperature sensor 51 and judges whether the fixing roller temperature exceeds a predetermined establishment start temperature TP0, and the registration control amount establish job is started under the condition that the fixing roller temperature exceeds the establishment start temperature. The reason is as described below.

Figure 34:
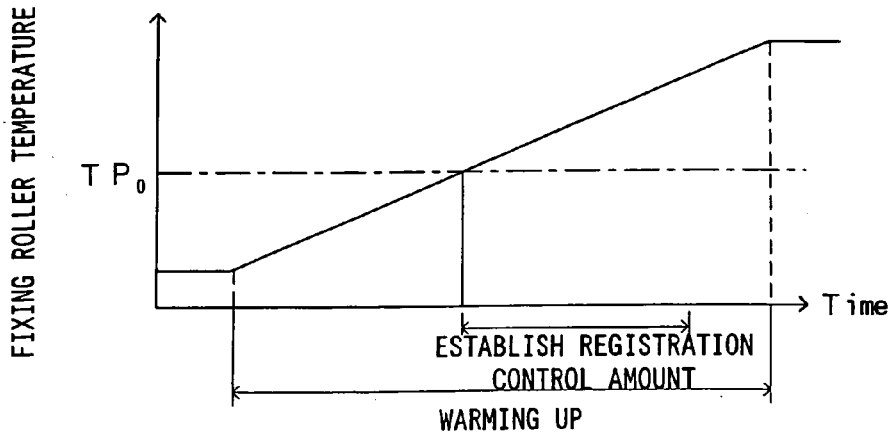
FIG. 34 is a graph showing an establishment start condition regarding a registration control amount in the image forming apparatuses shown in FIG. 1 or 16.

In this type of image forming apparatus, as shown in FIG. 34, a fixing roller temperature of the fixing unit prior to turning on of the power source is low, and as the power source is turned on, warming up is started. As one operation during the warming up, the fixing roller is heated, and the warming up completes when the fixing roller reaches a predetermined fixing temperature so that it is possible to start creating an image. Hence, if the registration control amount establish processing is completed during the warming up, the image create processing can start immediately after the warming up completes. For this reason, it is desirable to complete the registration control amount establish processing (Step S1) during the warming up.

Now, if the registration control amount establish processing (Step S1) is executed right after the warming up starts, that is, upon turning on of the power source of the apparatus as in the second preferred embodiment, it is possible to complete the registration control amount establish processing (Step S1) without fail before the warming up completes. However, this does not allow the fixing roller temperature to increase sufficiently so that the registration control amount establish processing (Step S1) is executed in a condition which is far from an environment around the apparatus during actual printing, and therefore, it is sometimes impossible to obtain accurate registration control amounts.

Noting this, the registration control amount establish processing may be started after the fixing roller temperature increases to the predetermined establishment start temperature TP0 and a condition becomes close to that in an apparatus environment during actual printing as in the fifth preferred embodiment, it is possible to more accurately obtain registration control amounts. For establishing the establishment start temperature TP0, it is preferable to complete the registration control amount establish processing before the warming up completes even if the registration control amount establish processing was started when this establishment start temperature was reached. With the establishment start temperature TP0 selectively set as such, it is possible to more accurately obtain registration control amounts in a condition close to that in actual printing without degrading the performance of the apparatus.

F. Sixth Preferred Embodiment

While the registration control amounts Ra, Rb and Rc are automatically established through the registration control amount establish processing (Step S1) after turning on of the power source of the apparatus and stored in the memory 125 in the first and the second preferred embodiments, execution of the registration control amount establish processing after every turning on of the power source of the apparatus is not necessarily essential. Rather, a condition for executing the registration control amount establish step may be set up freely, e.g., so as to execute during continuous printing as described below.

In this type of image forming apparatus, as an instruction to form an image is fed to the main controller 11 from the external apparatus, the main controller 11 converts the image create instruction into a plurality pieces of job data and supplies the data pieces one after another to the engine controller 12. For example, when the external apparatus sends an image create instruction demanding to print five pages of an A4-size document to the main controller 11, in the image forming apparatus according to this preferred embodiment, the main controller 11 converts the image create instruction into three pieces of job data as described below which are in a format which is suitable to instruct the engine part E to operate.

(1) Job to print two pages of the A4-size document;

(2) Job to print two pages of the A4-size document; and (3) Job to print one page of the A4-size document.

The registration control amount establish step may be executed between these jobs. In this manner, the registration control amount establish step may be executed after forming one color image but before forming the next color image.

Alternatively, the registration control amount establish step may be executed when a predetermined period has elapsed since the power source of the apparatus was turned on, when printing has been executed for a predetermined number of sheets since the power source of the apparatus was turned on, when the jobs have been repeated for a predetermined number of times, or at other timings. In this manner, timing to execute the registration control amount establish step may be determined based on an operation state of the apparatus.

G. Seventh Preferred Embodiment

Although the registration control amount establish step is executed while the apparatus is in operation in order to obtain registration control amounts in the preferred embodiments described above, an alternative may be to obtain registration control amounts in advance and store in the memory means such as the memory 126 and other memory instead of executing the registration control amount establish step. For example, the memory means may be built in the transfer unit 4, the transfer unit 4 alone may be driven during assembling of the transfer unit 4 to thereby obtain registration control amounts and store in the memory means of the transfer unit 4. Since this makes it possible to obtain registration control amounts without waiting for the other units, such as the image carrier unit 2 and the exposure unit 3, to be completed, an efficiency of assembling the entire apparatus improves.

Still alternatively, registration control amounts may be found upon assembling of the entire image forming apparatus and stored in the memory 126. In this manner, it is possible to obtain a result which reflects influences of the other units except for the transfer unit 4 over registration control amounts, and hence, to obtain more accurate registration control amounts than where registration control amounts are obtained using only the transfer unit 4.

H. Eighth Preferred Embodiment

The transfer medium, such as the intermediate transfer drum 41D and the intermediate transfer belt 41B, and portions around the same are susceptible to an influence of an internal environment, such as a temperature and a humidity level, of the apparatus. Hence, as a temperature and a humidity level inside the apparatus are measured and registration control amounts are corrected based on the measurements, it is possible to perform more accurate correction of registration and obtain a high-quality image.

In addition, while a cover of the apparatus needs be opened for the purpose of replacing consumables, maintenance of the apparatus, etc., a temperature and a humidity level inside the apparatus largely change in some cases as the cover is opened. Noting this, the temperature and the humidity inside the apparatus may be measured using a temperature/humidity sensor or the like and registration control amounts may be corrected as described above, alternatively, the registration control amount establish step may be executed after determining that correction of registration control amounts is necessary based on information which indicates that the cover is open.

Further, a factor which influences the temperature and the humidity inside the apparatus may be setting of an energy save mode (sleep mode). This is because this mode stops the fixing unit or controls the fixing unit into a low temperature other than during the print processing. Since there is a high possibility that the temperature decreases upon return from the energy save mode because of this, based on information which is indicative of the return from the energy save mode, the registration control amount establish step may be executed immediately after the return or a predetermined period of time. Such information is generally called "the status of the apparatus" based on which timing to execute the registration control amount establish step may be determined so that registration control amounts which match with an internal environment of the apparatus are identified appropriately, and hence, a high-quality color image is obtained.

I. Ninth Preferred Embodiment

Figure 35:
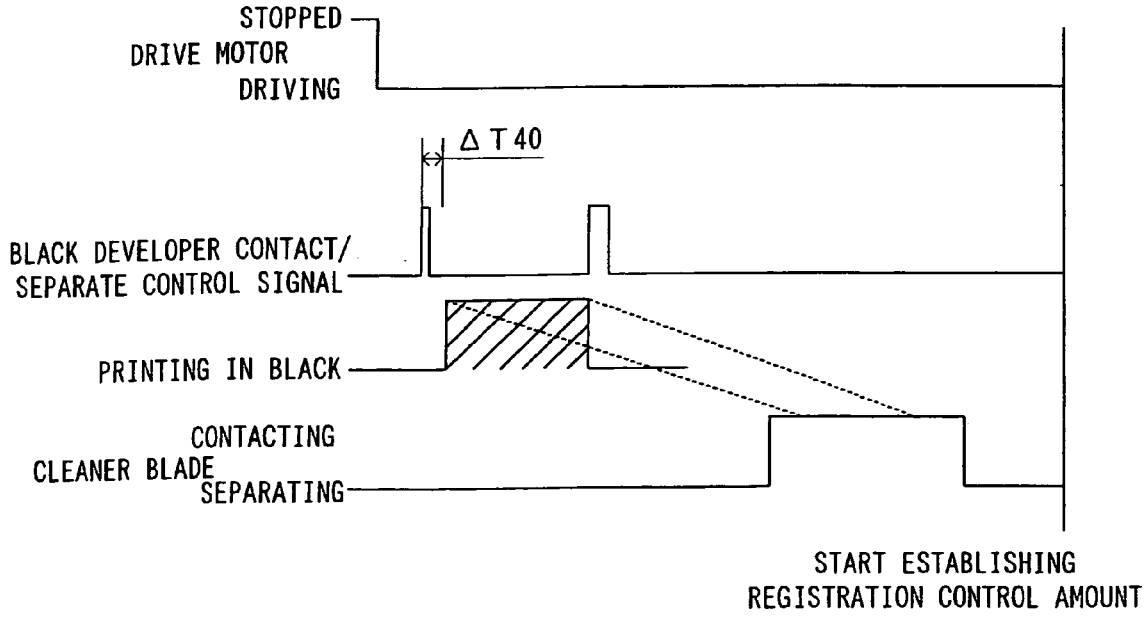
FIG. 35 is a timing chart showing an operation sequence in an image forming apparatus according to a ninth preferred embodiment of the present invention.

FIG. 35 is a timing chart showing of an operation sequence in an image forming apparatus according to a ninth preferred embodiment of the present invention. In the ninth preferred embodiment, prior to execution of the registration control amount establish processing (Step S1), black toner is supplied to the photosensitive member cleaner blade 24, to thereby prevent the following problem from occurring. That is, repetition of the registration control amount establish job with no toner at the photosensitive member cleaner blade 24 results in a burr of the photosensitive member cleaner blade 24. In addition, very large frictional force acts between the photosensitive member cleaner blade 24 and the photosensitive member 21, which imposes a large load upon the motor which drives and rotates the photosensitive member 21 so that the motor departs from a real printing condition and the controllability of the motor accordingly drops. However, a structure as described below according to the ninth preferred embodiment obviates these problems.

In the ninth preferred embodiment, as the power source of the apparatus is turned on, the drive source 81, which drives the photosensitive member 21 and the transfer medium (the intermediate transfer drum 41D or the intermediate transfer belt 41B) into rotation, is started to be driven. The electrifying bias and the primary transfer bias to the electrifying roller 22 are always set OFF condition.

Following this, a contact/separate control signal for the developer 23K for black rises from the L level to the H level, whereby the developer 23K for black contacts after a time lag of ΔT40. The time lag of ΔT40 is created because a cam mechanism is generally used to drive each developer to abut or leave the photosensitive member 21 in the image forming apparatus shown in FIG. 1 or 16. As the contact/separate control signal for the developer 23K for black rises from the L level to the H level once again, the black developer 23K moves away from the photosensitive member 21. While the black developer 23K stays abutting the photosensitive member 21, the black toner adheres to the photosensitive member 21 and printing in black is realized.

The black toner adhered to the photosensitive member 21 in this manner is removed by the photosensitive member cleaner blade 24 from the photosensitive member 21, and supply of the black toner to the photosensitive member cleaner blade 24 is completed. While the black toner is supplied to the photosensitive member cleaner blade 24 in the ninth preferred embodiment, other toner may be supplied instead of the black toner.

In addition, although black printing is executed as described above and the cleaner blade 491 is thereafter allowed to abut at predetermined timing for a certain period, this is for the following reason. In this preferred embodiment, although the primary transfer bias is OFF condition, a portion of, e.g., about 10% of the black toner on the photosensitive member 21 adheres to the transfer medium 41B, 41D. To remove the adhering toner from the transfer medium 41B, 41D, the cleaner blade 491 is allowed to abut on the transfer medium 41B, 41D at appropriate timing as mentioned above.

As described above, in the ninth preferred embodiment, the registration control amount establish processing (Step S1) is executed after toner is supplied to the photosensitive member cleaner blade 24 which remains abutting on the photosensitive member 21, a burr of the photosensitive member cleaner blade 24 is prevented while the registration control amount establish job is repeated, and frictional force between the photosensitive member cleaner blade 24 and the photosensitive member 21 is reduced. Since the registration control amount establish processing (Step S1) is executed in a condition close to that in actual printing, registration control amounts are calculated more accurately.

J. Tenth Preferred Embodiment

While the registration control is executed based on the registration control amounts Ra, Rb and Rc which are set at the beginning in the preferred embodiments described above, while a color image is being created, an operating environment such as a temperature and a humidity level inside the apparatus may change, which may cause the registration control amounts to deviate from optimal values. Noting this, in this preferred embodiment, the registration control amounts are corrected so as to optimize the registration control amounts. In the following, a description will be given on an example in relation to an application of the image forming apparatus according to the second preferred embodiment. Since the structure of the apparatus is common, a mechanical structure and an electrical structure of the apparatus will not be described here.

J-1. Operations

Figure 36:
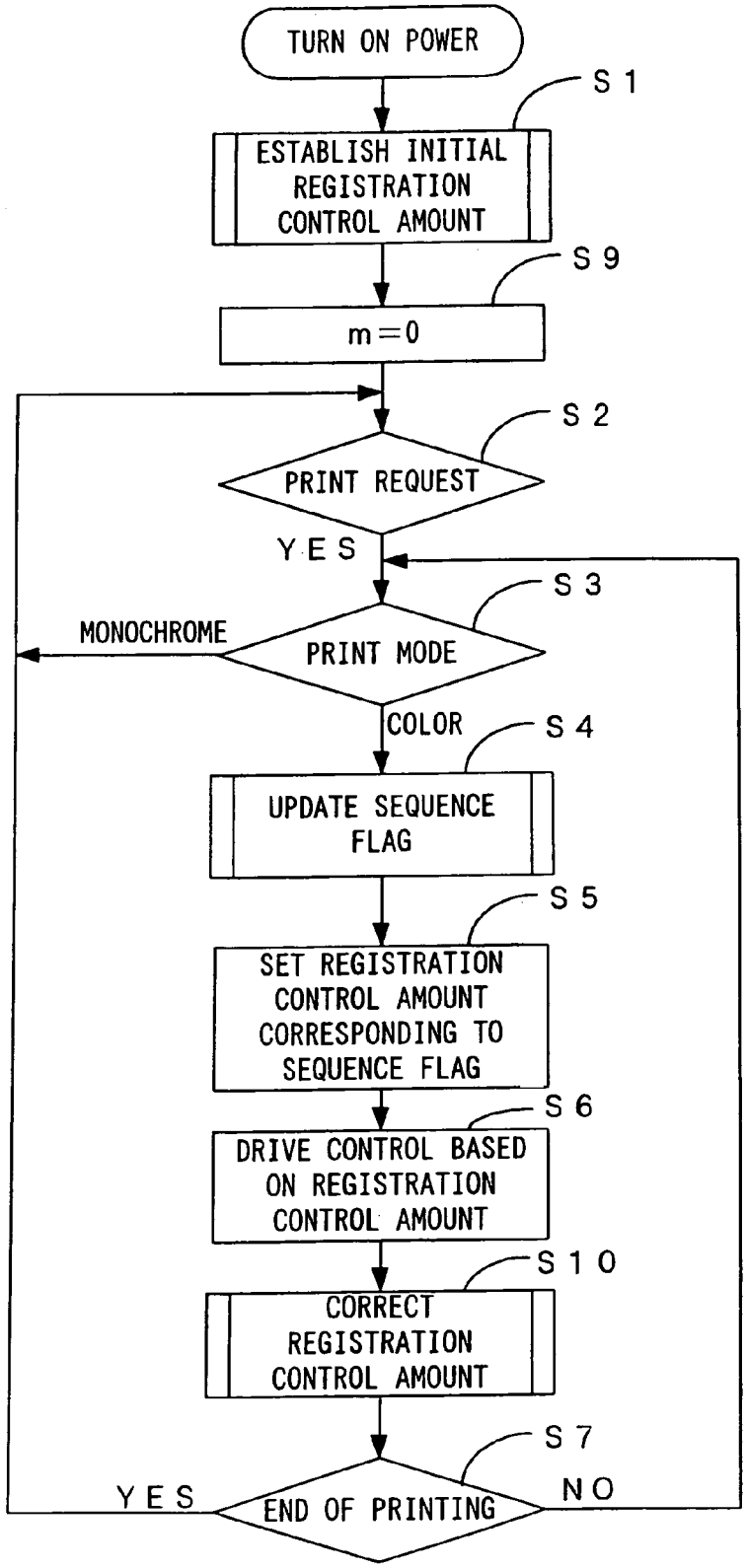
FIG. 36 is a flow chart showing operations in an image forming apparatus according to a tenth preferred embodiment of the present invention.

FIG. 36 is a flow chart showing operations in an image forming apparatus according to the tenth preferred embodiment of the present invention. In this image forming apparatus, as the power source of the apparatus is turned on, prior to actual image create processing, the registration control amount establish step (Step S1) is executed to automatically establish the three types of the registration control amounts, and the registration control amounts are stored in the memory 125 which serves as the memory means, in a manner similar to that described under the section "B-4. Initial Registration Control Amount Establish Processing" earlier.

As the three types of the initial registration control amounts Ra, Rb and Rc are established in this manner (Step S1), a count value m is cleared to "0" at a step S9. The count value m indicates the number of times that color images have been formed and functions as a weighting factor during registration control amount correction which will be under the section "J-2. Correction of Registration Control Amount" later. This will be described in detail in the same section. Of course, the steps S1 and S9 may be performed simultaneously or replaced with each other.

Next, the sequence waits for a print request from the external apparatus such as a host computer (Step S2). Upon receipt of the print request, whether the requested print mode is monochrome printing or color printing is judged (Step S3), and when it is judged that monochrome printing is requested, the sequence executes normal image create processing without registration control and returns to the step S2. On the other hand, when it is judged at the step S3 that color printing is requested, one of the three sequence flags F0, F1 and F2 which corresponds to a printing sequence state is selectively set (Step S4) as described in detail in the section "A-5. Updating of Sequence Flag" earlier.

After setting up a registration control amount corresponding to the sequence flag (Step S5), for the image create/transfer processing in each toner color, the photosensitive member 21 is accelerated/decelerated under control during a predetermined acceleration/deceleration period, whereby a latent image forming position is shifted by an amount equivalent to the registration control amount in the sub scanning direction with respect to a reference latent image forming position (Step S6). This causes transfer positions of toner images as well which are primarily transferred onto the intermediate transfer belt 41B to shift by the registration control amount in the sub scanning direction. Registration deviations are suppressed by correcting the transfer start positions in this manner. The details of this are as described in the section "B-5. Correction of Transfer Start Position" earlier.

As creation of a color image is completed while suppressing registration deviations based on the registration control amount in this manner, whether the printing has completed or not is determined at the step S7, following execution of the registration control amount correction (Step S10) which will be described in detail in the section "J-2. Correction of Registration Control Amount" next. When it is judged that the printing has completed, the sequence returns to the step S2 to wait for the next print request. On the other hand, when it is judged that the printing has not completed, the sequence returns to the step S3 to repeat similar processing to that described above.

J-2. Correction of Registration Control Amount

Figure 37:
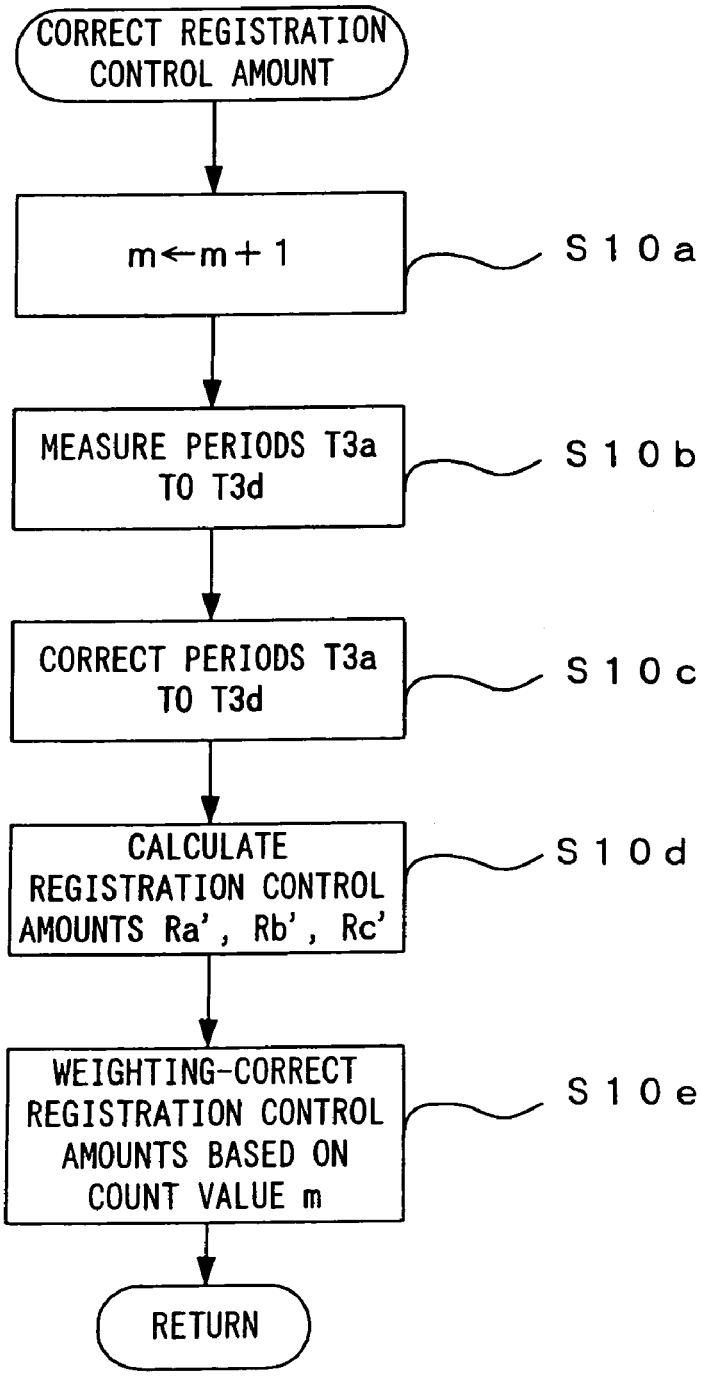
FIG. 37 is a flow chart showing registration control amount correction.

FIG. 37 is a flow chart showing the registration control amount correction. First, the following initial conditions are set up in advance based on the apparatus structure of and the operation sequence for the image forming apparatus according to this preferred embodiment, and stored in the memory 126. The initial conditions are:

B2: Abutting period of the cleaner blade

Figure 38:
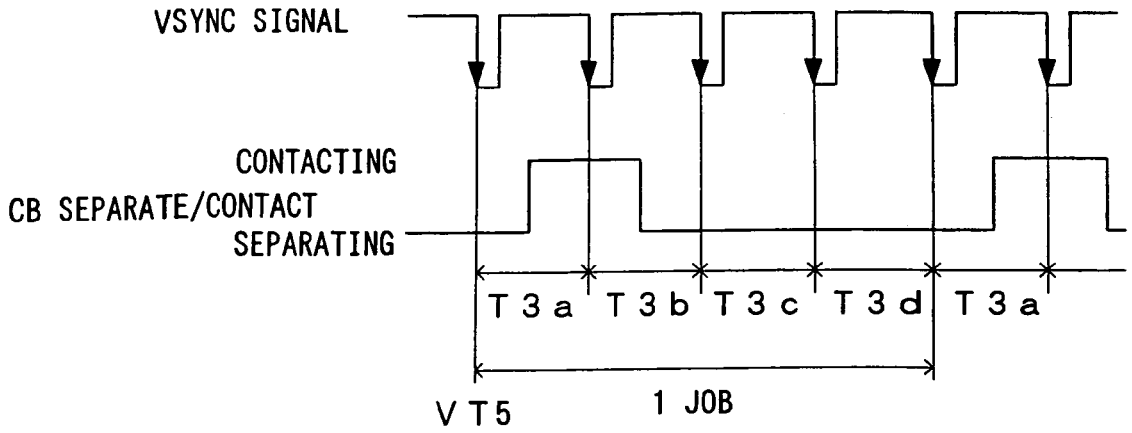
FIG. 38 is a timing chart showing a content of a registration control amount correction job.

B7: Time interval between contacting of the cleaner blade and the next VSYNC signal As the registration control amount correction is started, the count value m is incremented only "1" (Step S10*a*). Following this, as shown in FIG. 38, after forming a color image at least once or more based on the initial registration control amounts, periods T3*a* to T3*d* are each measured (Measurement: Step S10*b*) through four periods during the creation of the color image which come after the fifth VSYNC signal since the first VSYNC signal, i.e., through one job which is:

(1) Period T3*a* which corresponds to primary transfer of the second and subsequent yellow toner images;

(2) Period T3*b* which corresponds to primary transfer of the second and subsequent cyan toner images;

(3) Period T3*c* which corresponds to primary transfer of the second and subsequent magenta toner images; and (4) Period T3*d* which corresponds to primary transfer of the second and subsequent black toner images.

Thus, since the periods of the VSYNC signals which are measured during the printing contain correction components based on the initial registration control amounts, it is necessary to remove the components and calculate the registration control amounts. To cancel out the correction components, this preferred embodiment requires to correct the measured periods T3*a* to T3*d* in accordance with the following formulas:

$$T3a' = T3a + 0.001 \times SS1/A2$$

$$T3b' = T3b + 0.001 \times SS2/A2$$

$$T3c' = T3c + 0.001 \times SS3/A2$$

$$T3d' = T3d + 0.001 \times SS4/A2$$

Represented as SS1 through SS4 are registration control amounts in a job of measurement. More precisely, the registration control amounts SS1 to SS4 are respectively registration control amounts for primary transfer of the second and subsequent yellow toner images, the second and subsequent cyan toner images, the second and subsequent magenta toner images, and the second and subsequent black toner images.

As the periods T3*a*' to T3*d*' which reflect only the influence of the operating environment, the registration control amounts Ra', Rb' and Rc' in this job are calculated based on formulas described below (Intermediate Calculation: Step S10*d*).

<Registration Control Amount Ra'>

The cleaner blade 491 starts contacting in the middle of primary transfer of a black toner image onto the intermediate transfer belt 41B and remains abutting at the end of the primary transfer of the black toner image K1 of the A3 size, for instance, and therefore, a registration deviation amount B16 in the sub scanning direction is created. The registration deviation amount B16 is the sum of two stretching elements B8 and B14. That is, $$B16=B8+B14$$

The stretching B8 is contact-induced stretching which is created as the intermediate transfer belt 41B rotates with the cleaner blade 491 contacting the same, while the stretching B14 is instantaneous stretching upon contacting of the cleaner blade 491 with the intermediate transfer belt 41B (elasticity+slipping).

First, the stretching B8 will be discussed. While a periodical difference B1 is developed as the cleaner blade 491 contacts, the periodical difference B1 is calculated by the following formula:

$$B1=((T3a'+T3b')-(T3c'+T3+d'))\times A8/B2\times A2\times 1000$$

Since the cleaner blade 491 stays abutting only for the predetermined period A7 during the primary transfer of the black toner image, the contact-induced stretching B8 is:

$$B8=B1\times A7/A8$$

On the other hand, the instantaneous stretching B14 is the sum of stretching B3 which is created by the contact of the cleaner blade 491 and the sum B4 of the rigidity of the drive system and deformation of the gear. The stretching B3 is calculated as:

$$B3=B1\times A4/A5$$

Meanwhile, the stretching B4 is calculated as:

$$B4=(T3a'-(T3c'+T3d')/2)\times A2\times 1000-B5$$

wherein the symbol B5 denotes a periodical difference which is generated by stretching of the intermediate transfer belt 41B during the period T3*a*' and which is calculated by the following formula:

$$B5=B1\times B7/A8$$

Hence, the registration deviation amount B16 can be calculated based on these formulas. With the transfer start position shifted half this value in advance from the reference transfer start position in the sub scanning direction, a registration deviation of the black toner image is suppressed to minimum. Noting this, in this preferred embodiment, the registration control amount Ra' during the job is calculated by the following formula, as an intermediate registration control amount:

$$Ra=B16/2$$

<Registration Control Amount Rb'>

With respect to a yellow toner image is primarily transferred onto the intermediate transfer belt 41B after the primary transfer of the black toner image, since the cleaner blade contacts until the primary transfer of the second or later yellow toner image is started, a deviation amount B11 is created in the sub scanning direction. The deviation amount B11 is:

$$B11=B3+B4+B9$$

wherein the symbol B9 denotes stretching which is developed since the contact of the cleaner blade 491 until the start of the primary transfer of the second or later yellow toner image and which is calculated by the following formula:

$$B9=B1\times A10/A8$$

Further, there is also stretching B10 which is created as the cleaner blade 491 remains in contact with the intermediate transfer belt 41B even after the start of the primary transfer. Hence, a stretching amount B19 of the yellow image is:

$$B19=B11+B10$$

Meanwhile, contraction B15 is created as the cleaner blade 491 moves away from the intermediate transfer belt 41B immediately before the primary transfer completes. Hence, when the contraction B15 is larger than the stretching B10 of the belt during the primary transfer, the registration control amount Rb' is set as an intermediate registration control amount which is as follows:

$$Rb'=B19-B15/2$$

In the opposite case (B15<B10), the registration control amount Rb' is set as an intermediate registration control amount which is as follows:

$$Rb'=B19-B10/2$$

In this manner, it is possible to suppress a registration deviation of the yellow toner image to minimum.

<Registration Control Amount Rc'>

During primary transfer of a cyan toner image onto the intermediate transfer belt 41B following the primary transfer of the yellow toner image, the cleaner blade 491 remains abutting on the intermediate transfer belt 41B at the time of outputting of the VSYNC signal which is a reference for this primary transfer. The intermediate transfer belt 41B then rotates for the period A14 in this contacting condition until the primary transfer of the cyan toner image is started. Hence, stretching B13 is generated. That is, the stretching B13 is:

$$B13=B1\times A14/A8$$

As the cleaner blade 491 moves away from the intermediate transfer belt 41B, as described in the section "<Registration Control Amount Rb'>," contraction B12 (=B15) is created. Hence, although a registration deviation amount B18 (=B13−B12) is created at the start of the primary transfer of the cyan toner image, no deviation is created in the sub scanning direction during the primary transfer. In this preferred embodiment, since it is possible to suppress a registration deviation of the cyan toner image to zero as the transfer start position is shifted by this value (registration deviation amount B18) in advance in the sub scanning direction, the registration control amount Rc' is set as an intermediate registration control amount which is as follows:

$$Rc=B19$$

The description will be continued, referring back to FIG. 37. As the intermediate registration control amounts Ra', Rb' and Rc' are calculated in the manner described above, registration control amounts are corrected by weighting based on the count value m (Correction: Step S10*e*). That is, registration control amounts Ra", Rb" and Rc" are calculated based on the following formulas, and set instead of the registration control amounts Ra, Rb and Rc which are listed in Table 1, whereby the registration control amounts are optimized.

$$Ra''=((M-m)\times Ra+m\times Ra')/M$$

$$Rb''=((M-m)\times Rb+m\times Rb')/M$$

$$Rc''=((M-m)\times Rc+m\times Rc')/M$$

Represented by M is a data acquisition target value which is established in advance. The value M can be set freely, e.g., to "100."

J-3. Functions and Effects

As described above, this preferred embodiment promises the following further functions and effects in addition to the same functions and effects as those according to the second preferred embodiment, since this preferred embodiment requires to correct the registration control amounts above after creating a color image at least once or more than once.

First, although an operating environment, such as a temperature and a humidity level inside the apparatus, sometimes changes and registration control amounts accordingly deviate from optimal values while a color image is being created, since this preferred embodiment requires to execute the registration control amount correction (Step S10) and thereafter correct the registration control amounts, the registration control amounts are optimized in accordance with an operating environment and the like. Hence, it is possible to obtain a color image more stably than in the second preferred embodiment.

Although optimization of registration control amounts in accordance with an operating environment may be realized by properly repeating the registration control amount establish step (Step S1) at appropriate timing other than immediately after turning on of the power source of the apparatus, since the registration control amount establish step is relatively time-consuming and demands the print processing to be stopped, a throughput accordingly deteriorates. In contrast, in this preferred embodiment, registration control amounts are corrected and optimized while printing, and therefore, it is possible to correct registration control amounts and form a high-quality image while maintaining a high throughput.

Further, since weighting correction is executed based on the count value m which is indicative of the number of times that color images have been formed, when the count value m in the registration control amount correction (Step S10) is relatively small, that is, when color images have been formed only a few times since turning on of the power source, the proportion of the initial registration control amounts is large. The proportion of the intermediate registration control amount gradually increases as the count value m increases. At last, the intermediate registration control amounts themselves are set as the registration control amounts. Such weighting correction allows the registration control amounts to be corrected gradually as the count value m increases, i.e., as color images are formed more times. As a result, the registration control amounts are corrected in an excellent manner. This is because registration control amounts are corrected by weighting in accordance with the number of times that color images have been formed which is closely related with an increase in temperature, and hence, correction reflecting the increased temperature is realized in this preferred embodiment, while optimal values of registration control amounts usually shift from initial registration control amounts as an internal temperature, which is one factor in an operating environment, gradually increases as color images are formed more times.

Of course, the intermediate registration control amounts Ra', Rb' and Rc' which correspond to each job may be determined as post-correction registration control amounts without considering the initial registration control amounts Ra, Rb and Rc at all and set instead of the registration control amounts Ra, Rb and Rc in Table 1, so as to optimize the registration control amounts. This simplifies the registration control amount correction, which in turn reduces a calculation load upon the CPU 121 which performs the calculation above, and hence, permits smooth control.

Further, it is desirable to utilize a break between one print job and another print job to reduce a calculation load upon the CPU 121. This is because the CPU 121 processes a relatively small amount of data during job breaks. Hence, measuring periods of the VSYINC signal during printing and executing correction based on the measured periods T3*a* through T3*d* between print jobs, it is possible to perform the registration control amount correction while effectively using the CPU 121 without applying an excessive load upon the CPU 121.

An effective method of reducing a calculation load upon the CPU 121 is to execute the calculation-requiring processing out of the registration control amount correction (Steps S10*c* through S10*e*) in synchronization with density adjustment processing. The reason is as described below.

During execution of continuous printing to print on a number of sheets, since there is usually no break between print jobs, the method above can not be applied. However, in this type of image forming apparatus, for the purpose of suppressing a change in image density attributed to fatigue and a change with time of the photosensitive member and the developers, a change in temperature and humidity around the apparatus, etc., density adjustment processing is executed which stabilizes an image density by adjusting at appropriate timing density controlling factors, such as the electrifying bias, the developing bias and the exposure amount, which influence an image density of a toner image. Since there is a period that the CPU 121 is under a relatively small load during the density adjustment processing, with the correction executed in synchronization with the density adjustment processing, it is possible to perform the registration control amount correction while effectively using the CPU 121 without applying an excessive load upon the CPU 121.

Further, while this preferred embodiment above requires to execute the registration control amount correction (Step S10) to correct registration control amounts every time one color image is formed, the registration control amount correction (Step S10) may be executed every time the number of times that color images have been formed becomes equal to or larger than a predetermined threshold value. Although an operation state of the apparatus is identified by calculating the number of times that color images have been formed (the count value m) since establishment of the initial registration control amounts (Step S1) until execution of the registration control amount correction in this manner, an index value which represents the operation state of the apparatus may be, other than the number of times that color images have been formed, the number of printed sheets, the amount of rotation of the photosensitive member 21, the amount of rotation of the intermediate transfer belt 41B, or the like.

Alternatively, the registration control amount establish step (Step S1) may be newly executed when the index value described above becomes equal to or larger than the predetermined threshold value, or registration control amounts at that point may be set as the initial registration control amounts once again. In this manner, even when the apparatus is used over a long period of time, it is possible to regularly update the initial registration control amounts to optimal values and form a high-quality color image stably.

A further reason why registration control amounts are necessary is an operating environment of the apparatus, e.g., a temperature. Noting this, a temperature sensor (detecting means) may be disposed inside the apparatus, to monitor a temperature inside the apparatus and execute the registration control amount correction (Step S10) only when the monitored temperature exceeds a predetermined threshold value. Of course, a humidity sensor (detecting means) may be disposed instead, so that a humidity level is used instead of or in addition to a temperature, as a start condition for the registration control amount correction.

Further, while a cover of the apparatus needs be opened for the purpose of replacing consumables, maintenance of the apparatus, etc., a temperature and a humidity level inside the apparatus largely change in some cases as the cover is opened. The temperature and the humidity inside the apparatus may be measured using a temperature/humidity sensor or the like and registration control amounts may be corrected as described above, alternatively, the registration control amount correction may be executed after determining that correction of registration control amounts is necessary based on information which indicates that the cover is open.

Further, a factor which influences the temperature and the humidity inside the apparatus may be setting of an energy save mode (sleep mode). This is because this mode stops the fixing unit or controls the fixing unit into a low temperature other than during the print processing. Since there is a high possibility that the temperature decreases upon return from the energy save mode because of this, based on information which is indicative of the return from the energy save mode, the registration control amount establish step may be executed immediately after the return or a predetermined period of time. Such information is generally called "the status of the apparatus" based on which timing to execute the registration control amount correction may be determined so that registration control amounts which match with an internal environment of the apparatus are identified appropriately, and hence, a high-quality color image is obtained.

K. Eleventh Preferred Embodiment

While the first to the tenth preferred embodiments described above aim at eliminating registration deviations which are created as the abutting means contacts or moves away from the transfer medium, a cause of registration deviations is not limited to this. Registration deviations are generated because of a cause as described below as well. That is, in this type of image forming apparatus, for example, the image forming apparatus shown in FIG. 1 or 16, as described above, as the vertical synchronizing signal VSYNC is outputted from the vertical synchronization reading sensor 40, using this as a reference, a light beam sweeps over the photosensitive member 21 in the main scanning direction, which is approximately perpendicular to the sub scanning direction, based on an image signal which is fed from the external apparatus such as a host computer, and electrostatic latent images which correspond to the image signal are formed on the photosensitive member 21.

In such an image forming apparatus, the scan timing of the light beam is often asynchronous to the vertical synchronizing signal VSYNC, which may generate a synchronization error between the vertical synchronizing signal VSYNC and the scan timing. If this occurs, transfer positions on the transfer medium shift by an amount equivalent to the synchronization error. Synchronization errors are different between the different toner colors, and therefore, toner images in the different toner colors deviate from each other, i.e., registration deviations are created, which in turn degrades an image quality.

To solve these problems, an eleventh preferred embodiment uses a configuration as described below. The eleventh preferred embodiment will now be described with reference to FIGS. 39 and 40.

Figure 39:
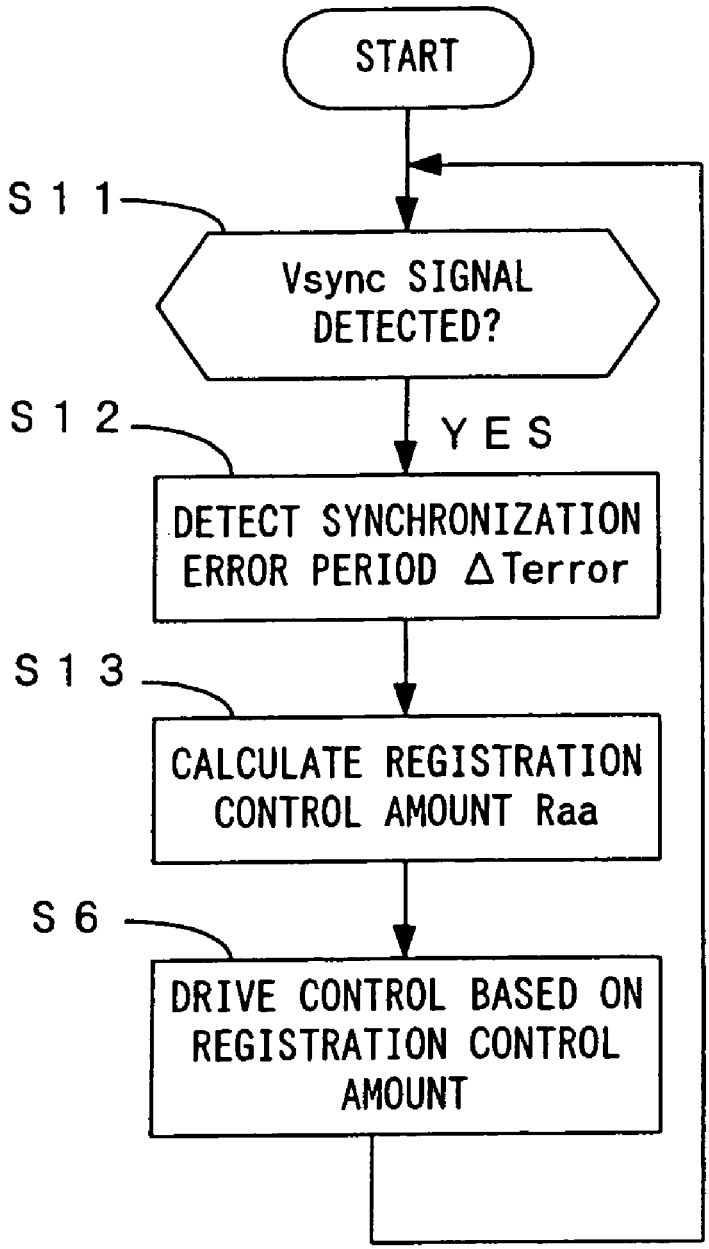
FIG. 39 is a flow chart showing operations in an image forming apparatus according to an eleventh preferred embodiment of the present invention.

FIG. 39 is a flow chart showing operations in an image forming apparatus according to the eleventh preferred embodiment of the present invention. In the image forming apparatus shown in FIG. 1 or 16, every time the vertical synchronizing signal VSYNC is outputted from the vertical synchronization reading sensor 40 to the CPU 121 (Step S11), the CPU 121 executes steps S12, S13 and S6 which will be described below.

Figure 40:
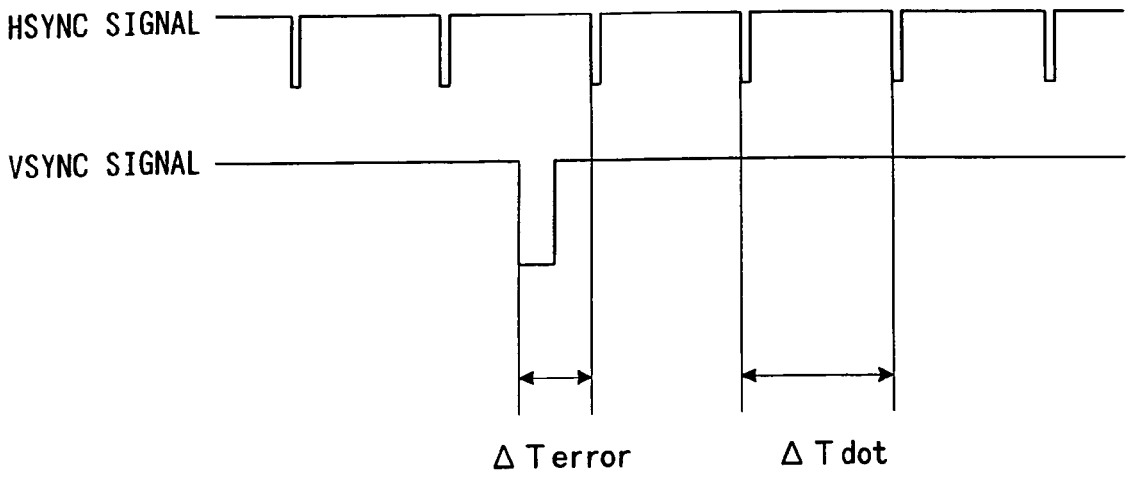
FIG. 40 is a drawing showing a relationship between a vertical synchronizing signal and a horizontal synchronizing signal.

First, at the step S12, a synchronization error period ΔTerror is detected which is a difference between the vertical synchronizing signal VSYNC and the horizontal synchronizing signal HSYNC which is outputted from the horizontal synchronization reading sensor 36 (FIG. 40). A value of the synchronization error period ΔTerror varies from zero to the maximum of one period ΔTdot of the horizontal synchronizing signal HSYNC.

At the next step S13, a registration control amount Raa which is necessary to correct a registration deviation due to the synchronization error period ΔTerror is calculated from the following formula:

$$Raa = W \times \Delta T\text{error}/\Delta T\text{dot}$$

where W denotes a gap between adjacent scanning lines in the sub scanning direction. For instance, where a resolution in the sub scanning direction is 600 dpi, the scanning line gap W is 42.3 μm.

Following this, for the image create/transfer processing in each toner color, the photosensitive member 21 is accelerated/decelerated under control during a predetermined acceleration/deceleration period, whereby a latent image forming position is shifted by an amount equivalent to the registration control amount Raa in the sub scanning direction with respect to a reference latent image forming position (Step S6). This causes transfer positions of toner images which are primarily transferred onto the transfer medium 41B, 41D to shift by an amount equivalent to the registration control amount in the sub scanning direction. Registration deviations due to synchronization errors are suppressed by correcting transfer start positions in this manner.

As described above, in this preferred embodiment, since the speeds of the photosensitive member 21 and the transfer medium are accelerated/decelerated under control in accordance with the synchronization error period ΔTerror which is between the vertical synchronizing signal VSYNC and the horizontal synchronizing signal HSYNC (the scan timing), it is possible to shift positions at which toner images are formed on the photosensitive member 21 in the sub scanning direction, and hence, correct the transfer start positions of the toner images on the transfer medium. The correction allows to suppress registration deviations which are created because of the lack of synchronicity between the vertical synchronizing signal VSYNC and the horizontal synchronizing signal HSYNC (the scan timing) and to form a high-quality image.

L. Twelfth Preferred Embodiment

As described above, among registration deviations which are created in this type of image forming apparatus are (1) a registration deviation which is created as the abutting means contacts or moves away from the transfer medium 41B, 41D and (2) a registration deviation which is created because of the lack of synchronicity between the vertical synchronizing signal VSYNC and the scan timing of the laser light L. Hence, it is desirable to overcome these two registration deviations at the same time, for the purpose of further improving the quality of an image. In an image forming apparatus according to the twelfth preferred embodiment, therefore, an image is formed in the following operation sequence so that these two registration deviations are overcome at the same time and an image of an even higher quality is formed.

Figure 41:
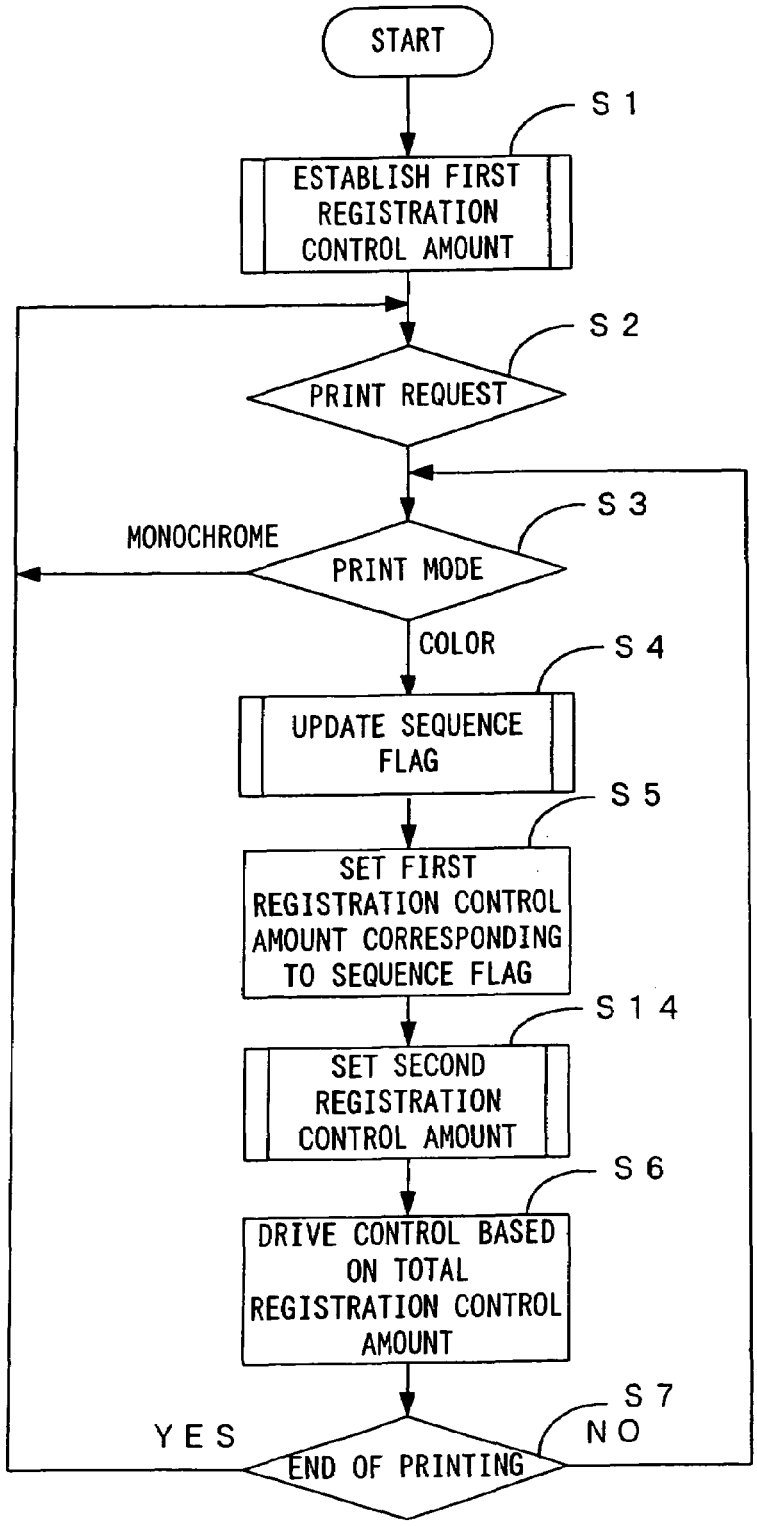
FIG. 41 is a flow chart showing the operations in the image forming apparatus according to the eleventh preferred embodiment of the present invention.

FIG. 41 is a flow chart showing operations in the image forming apparatus according to the eleventh preferred embodiment. This preferred embodiment is a combination of the first or the second preferred embodiment and the eleventh preferred embodiment. That is, in this image forming apparatus, as the power source of the apparatus is turned on, prior to actual image create processing, the registration control amount establish processing (Step S1), which has been described in detail under the sections "A-4. Initial Registration Control Amount Establish Processing" and "B-4. Initial Registration Control Amount Establish Processing" earlier, is executed to automatically establish the three types of the registration control amounts Ra, Rb and Rc, and these registration control amounts are stored as initial registration control amounts in the memory 125 which serves as the memory means. These initial registration control amounts will be referred to as "first registration control amounts" in the following.

As the first registration control amounts Ra to Rc are established (Step S1), the sequence waits for an image signal from the external apparatus such as a host computer, namely, a print request (Step S2). As the print request is received, whether the requested print mode is monochrome printing or color printing is judged (Step S3), and when it is judged that the requested print mode is monochrome printing, the sequence executes normal image create processing without registration control and returns to the step S2. On the other hand, when it is judged at the step S3 that color printing is requested, one of the three sequence flags F0, F1 and F2 which corresponds to a printing sequence state is selectively set (Step S4) as described in detail in the section "A-5. Updating of Sequence Flag" earlier.

Figure 42:
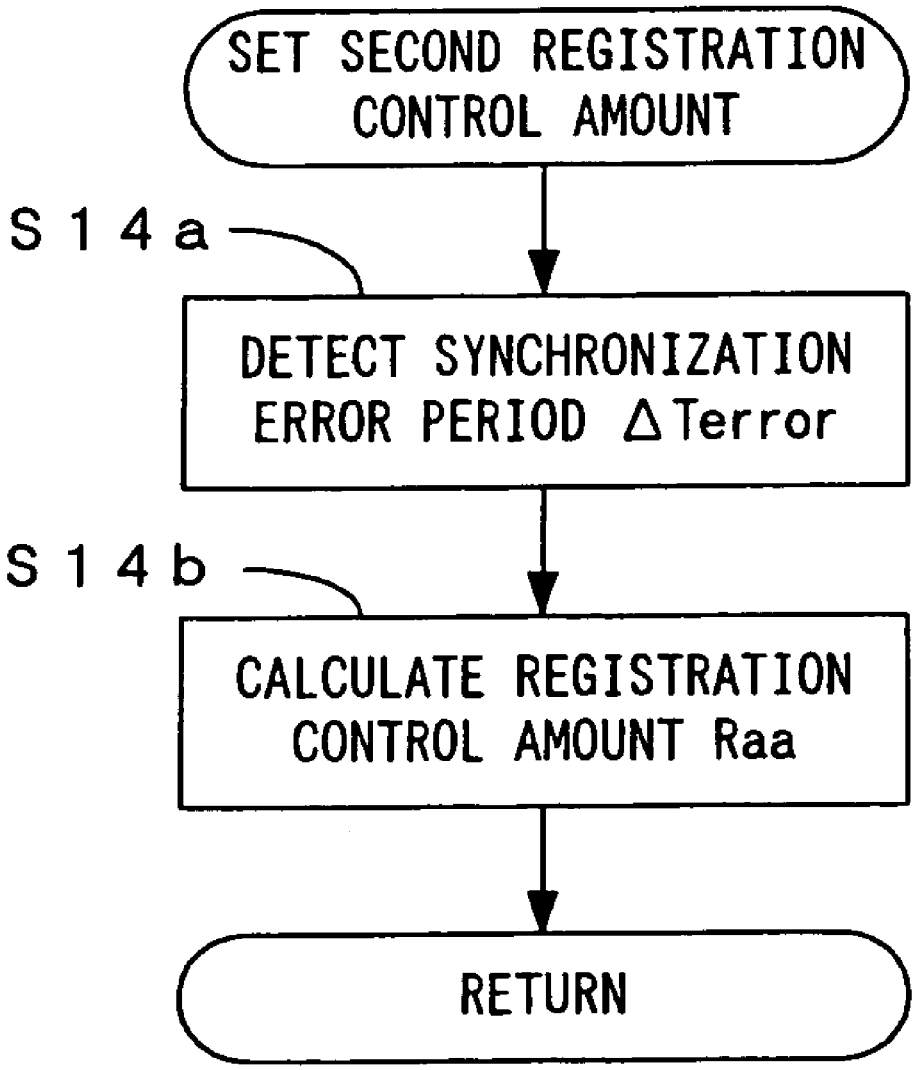
FIG. 42 is a flow chart showing an operation for setting a second registration control amount.

After setting up a first registration control amount corresponding to the sequence flag (Step S5), a step S14 is executed to thereby set up a registration control amount Raa which is for correcting a registration deviation which is attributed to the asynchronous control. More precisely, as shown in FIG. 42, first, at a step S14*a*, the synchronization error period ΔTerror is detected which is a difference between the vertical synchronizing signal VSYNC and the horizontal synchronizing signal HSYNC which is outputted from the horizontal synchronization reading sensor 36 (FIG. 40). A value of the synchronization error period ΔTerror varies from zero to the maximum of one period ΔTdot of the horizontal synchronizing signal HSYNC.

At the next step S14*b*, the second registration control amount Raa which is necessary to correct a registration deviation due to the synchronization error period ΔTerror is calculated from the following formula:

$$Raa = W \times \Delta T\text{error}/\Delta T\text{dot}$$

where W denotes a gap between adjacent scanning lines in the sub scanning direction. For instance, where a resolution in the sub scanning direction is 600 dpi, the scanning line gap W is 42.3 μm. The registration control amount Raa will be referred to as a "second registration control amount" in the following.

As the first and the second registration control amounts are calculated in this manner, after adding up these registration control amounts and accordingly calculating a total registration control amount, for the image create/transfer processing in each toner image, the photosensitive member 21 is accelerated/decelerated under control during a predetermined acceleration/deceleration period, whereby a latent image forming position is shifted by an amount equivalent to the registration control amount in the sub scanning direction with respect to a reference latent image forming position (Step S6). This also causes the transfer positions of toner images which are primarily transferred onto the transfer medium 41B, 41D to shift by the registration control amount in the sub scanning direction. Registration deviations are suppressed by correcting the transfer start positions in this manner.

As creation of a color image is completed while suppressing registration deviations based on the registration control amount in this manner, whether the printing has completed or not is determined at the step S7. When it is judged that the printing has completed, the sequence returns to the step S2 to wait for the next print request. On the other hand, when it is judged that the printing has not completed, the sequence returns to the step S3 to repeat similar processing to that described above.

As described above, this preferred embodiment requires to calculate a first registration control amount which is necessary to correct registration deviations in accordance with the printing sequence state and a second registration control amount which is necessary to correct registration deviations due to the asynchronous control, and thereafter correct transfer start positions of toner images for the respective toner colors based on a total registration control amount which is obtained by adding up these registration control amounts. Hence, it is possible to suppress the two types of registration deviations described above at the same time and obtain a color image of an even higher quality.

While the first and the second registration control amounts are added up to calculate the total registration control amount based on which the variable speed control is performed in the twelfth preferred embodiment, variable speed control based on the first registration control amount and variable speed control based on the second registration control amount may be performed separately from each other to adjust the transfer start positions by the total registration control amount as a whole.

In addition, although the twelfth preferred embodiment requires to execute the registration control amount establish step (Step S1) after turning on of the power source of the apparatus so that the three types of the first registration control amounts Ra, Rb and Rc are automatically established and stored in the memory 125 which serves as the memory means, and to execute the updating of the sequence flags (Step S4) so that a sequence flag which corresponds to a printing sequence is updated and set and a first registration control amount which corresponds to the printing sequence is established, the three types of the first registration control amounts Ra, Rb and Rc may be stored in advance in a table format which corresponds to the printing sequences. This eliminates the necessity of the registration control amount establish processing.

In other words, although the sequence flags F0, F1 and F2 are set each corresponding to each one of the three printing sequences, as shown in Table 1, the sequence flags may be stored in advance in the memory 125 so that the sequence flags are correlated to the first registration control amounts which correspond to the printing sequences. In this case, as a sequence flag which corresponds to the printing sequence is set up through the updating of sequence flags (Step S4), first registration control amounts which correspond to this sequence flag are all read from the table in the memory 125, and the transfer start positions for toner images in the respective toner colors are thereafter corrected based on total registration control amounts which are the sum of the first registration control amounts and the second registration control amounts which are calculated through the second registration control amount establish processing (Step S14), whereby similar effects to those according to the preferred embodiments described above are obtained.

M. Thirteenth Preferred Embodiment

In the twelfth preferred embodiment described above, the registration control amounts Ra, Rb and Rc which are set up first are used as first registration control amounts and a second registration control amount is added to the first registration control amounts to calculate a total registration control amount, and the registration control is executed based on the total registration control amount. However, while a color image is being created, an operating environment such as a temperature and a humidity level inside the apparatus may change, which causes registration control amounts to deviate from optimal values. Noting this, in a thirteenth preferred embodiment, first registration control amounts are corrected so as to optimize a total registration control amount.

Figure 43:
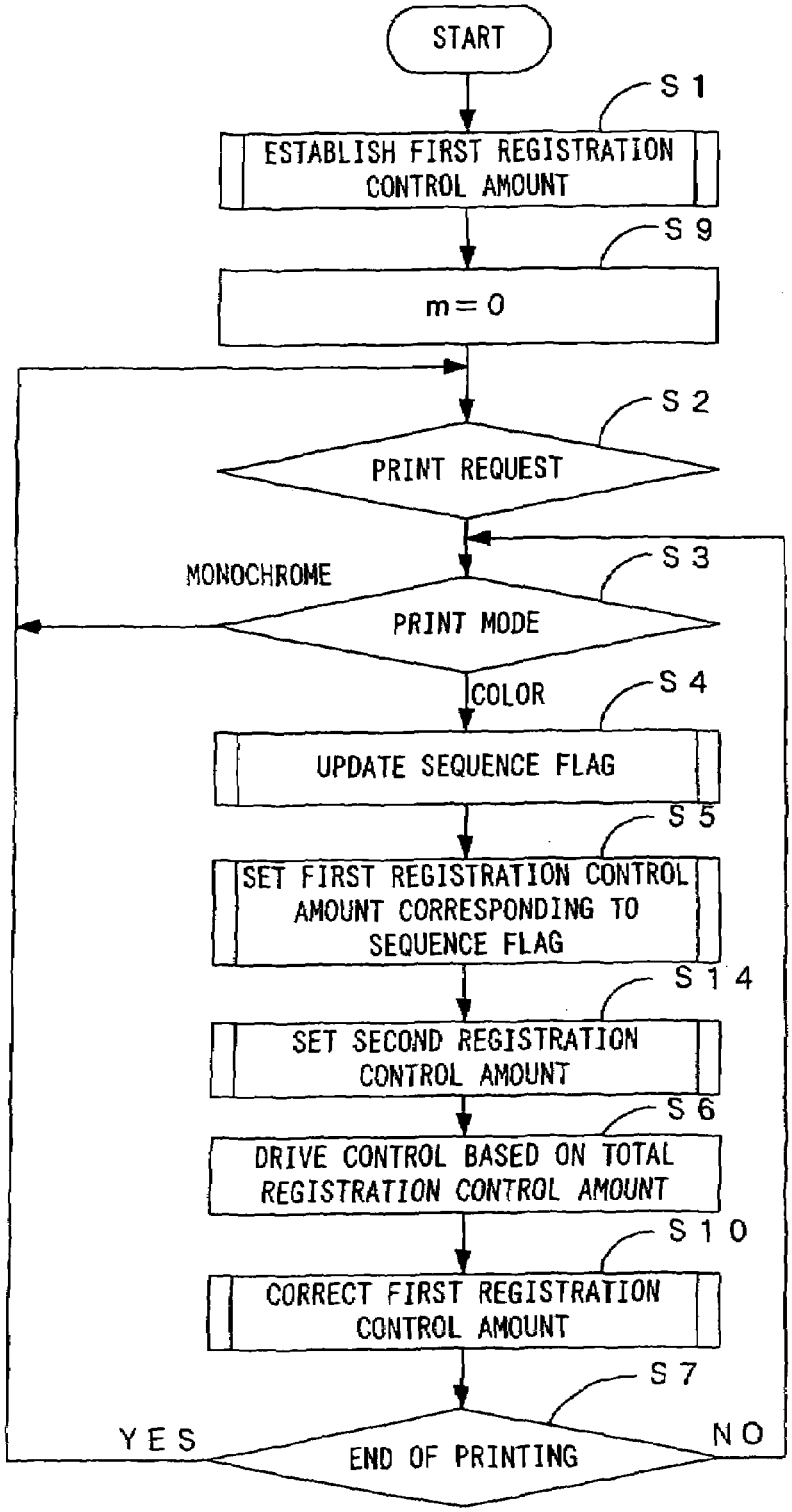
FIG. 43 is a flow chart showing operations in an image forming apparatus according to a thirteenth preferred embodiment of the present invention.

FIG. 43 is a flow chart showing operations in an image forming apparatus according to the thirteenth preferred embodiment. In this image forming apparatus, as the power source of the apparatus is turned on, prior to actual image create processing, the registration control amount establish step (Step S1) is executed to automatically establish the three types of the registration control amounts and store as first registration control amounts in the memory 125 which serves as the memory means, in a manner similar to that described under the section "B-4. Initial Registration Control Amount Establish Processing" earlier. Following this, the count value m is cleared to "0" at the step S9.

As the first registration control amounts Ra to Rc are established (Step S1) and the count value m is cleared, the sequence waits for an image signal from the external apparatus such as a host computer, namely, a print request (Step S2). As the print request is received, whether the requested print mode is monochrome printing or color printing is judged (Step S3), and when it is judged that the requested print mode is monochrome printing, the sequence executes normal image create processing without registration control and returns to the step S2. On the other hand, when it is judged at the step S3 that color printing is requested, one of the three sequence flags F0, F1 and F2 which corresponds to a printing sequence state is selectively set (Step S4) as described in detail in the section "A-5. Updating of Sequence Flag" earlier.

After setting up a first registration control amount corresponding to the sequence flag (Step S5), the step S14 is executed to thereby set up the registration control amount Raa which is for correcting a registration deviation which is attributed to the asynchronous control. The second registration control amount establish processing have been already described in detail in the section "L. Twelfth Preferred Embodiment" above and will not be described again.

As the first and the second registration control amounts are calculated in this manner, after adding up these registration control amounts and accordingly calculating a total registration control amount, for the image create/transfer processing in each toner image, the photosensitive member 21 is accelerated/decelerated under control during a predetermined acceleration/deceleration period, whereby a latent image forming position is shifted by an amount equivalent to the registration control amount in the sub scanning direction with respect to a reference latent image forming position (Step S6). This also causes transfer positions of toner images which are primarily transferred onto the intermediate transfer belt 41B to shift by the registration control amount in the sub scanning direction. Registration deviations are suppressed by correcting the transfer start positions in this manner.

As creation of a color image is completed while suppressing registration deviations based on the registration control amount in this manner, whether the printing has completed or not is determined at the step S7, following execution of the registration control amount correction (Step S10) which has been described in detail in the section "J-2. Correction of Registration Control Amount" earlier. When it is judged that the printing has completed, the sequence returns to the step S2 to wait for the next print request. On the other hand, when it is judged that the printing has not completed, the sequence returns to the step S3 to repeat similar processing to the above.

As described above, the thirteenth preferred embodiment promises the following further functions and effects in addition to the same functions and effects as those according to the twelfth preferred embodiment. That is, although an operating environment, such as a temperature and a humidity level inside the apparatus, sometimes changes and registration control amounts accordingly deviate from optimal values while a color image is being created, since this preferred embodiment requires to execute the registration control amount correction (Step S10) and thereafter correct registration control amounts, the registration control amounts are optimized in accordance with an operating environment and the like. Hence, it is possible to obtain a color image more stably than in the twelfth preferred embodiment. Moreover, similar functions and effects to those described in the section "J-3. Functions and Effects" are obtained as functions and effects of the registration control amount correction (Step S10).

N. Fourteenth Preferred Embodiment

Next, the drive control of the photosensitive member 21 and the transfer medium 41B, 41D (Step S6) will be described with reference to FIG. 44.

Figure 44:
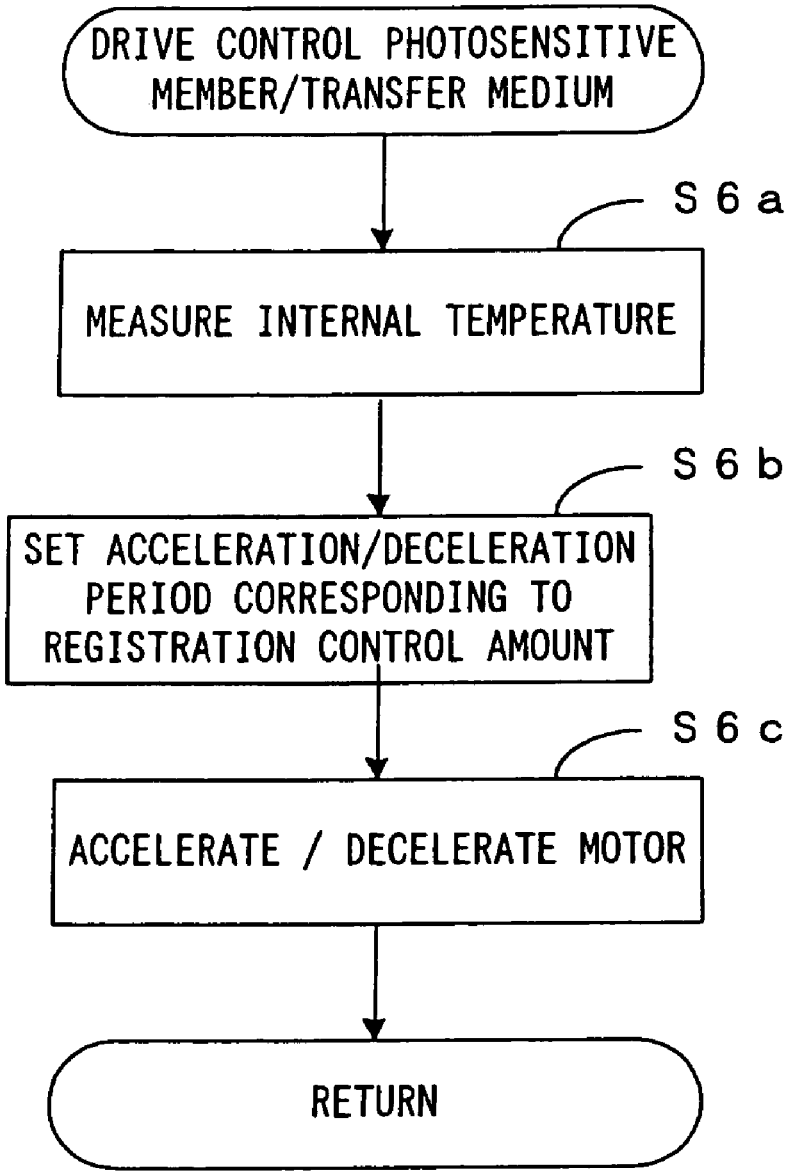
FIG. 44 is a flow chart showing a preferred embodiment of an operation for drive control of a photosensitive member and a transfer medium in the present invention.

FIG. 44 is a flow chart showing a drive control operation of the photosensitive member and the transfer medium. In a fourteenth preferred embodiment, prior to the drive control of the photosensitive member and the transfer medium (Step S6), registration control amounts are established, and for the image create/transfer processing in the respective toner images, the photosensitive member 21 is accelerated/decelerated under control during a predetermined acceleration/deceleration period, whereby latent image forming positions are shifted by the registration control amounts in the sub scanning direction with respect to a reference latent image forming position. More precisely, the shifting is realized in the following manner.

Using a known temperature sensor, a temperature in the vicinity of the photosensitive member 21 or the transfer unit 4, particularly, the primary transfer region TR1 is measured (Step S6*a*). An acceleration/deceleration period which corresponds to a registration control amount and an internal temperature of the apparatus is read from the memory 126 and set as an acceleration/deceleration period ΔTUDV (Step S6*b*). In this preferred embodiment, a temperature environment inside the apparatus is classified among three categories of a low temperature environment, a normal temperature environment and a high temperature environment based on the internal temperature of the apparatus, and as shown in Table 2, registration control amounts and acceleration/deceleration periods ΔTUDV for the motor, which is the drive source for the photosensitive member/transfer medium driving part 41*a*, are associated with each other corresponding to the respective temperature environments and stored in the memory 126 in advance as correction information.

TABLE 2

| | ACCELERATION/DECELERATION PERIOD (msec) | | | |
|---|---|---|---|---|
| REGISTRATION CONTROL AMOUNT (μm) | LOW TEMPERATURE ENVIRONMENT (LL) | ROOM TEMPERATURE ENVIRONMENT (NN) | HIGH TEMPERATURE ENVIRONMENT (HH) | SET MULTIPLIER |
| −43 | 62 | 52 | 40 | −31 |
| −42 | 60 | 50 | 39 | −31 |
| −41 | 57 | 47 | 38 | −31 |
| . . . | . . . | . . . | . . . | . . . |
| −1 | 1 | 1 | 0 | −31 |
| 0 | 0 | 0 | 0 | 0 |
| 1 | 1 | 1 | 0 | 31 |
| . . . | . . . | . . . | . . . | . . . |
| 41 | 56 | 47 | 37 | 31 |
| 42 | 59 | 49 | 39 | 31 |
| 43 | 62 | 52 | 40 | 31 |

In Table 2, "SET MULTIPLIER" is a multiplier which is indicative of a maximum acceleration/deceleration amount ΔV during the associated acceleration/deceleration period ΔTUDV, and those in negative mean to decelerate the photosensitive member 21 and the transfer medium 41B, 41D which are in rotation at a constant speed (first driving speed) Vcons (See FIG. 45) while those in positive mean to accelerate the photosensitive member 21 and the transfer medium 41B, 41D. Except for when the registration control amount is zero, the absolute values of the set multiplier are all "31" so as to accelerate/decelerate approximately zero point some percent from the speed Vcons. However, the set multiplier values are not limited to this but may be determined freely. In addition, the set multiplier values may be different from each other in accordance with the registration control amount, the temperature environment, etc.

After the acceleration/deceleration period ΔTUDV corresponding to the registration control amount is set as described above, as shown in FIG. 45, for primary transfer of each toner image, the CPU 121 changes a clock signal to the photosensitive member/transfer medium drive control circuit 122 to thereby accelerate/decelerate the motor which is the drive source for the photosensitive member/transfer medium driving part 41*a*, during the predetermined acceleration/deceleration period for the photosensitive member 21 (Step S6*c*). Since the "acceleration/deceleration period" is, as described above, a period during which the VIDEO signal stays at the H level and the exposure processing is suspended, the photosensitive member 21 remains driven at the same predetermined first driving speed Vcons while latent images are being formed, and therefore, it is possible to prevent the latent images from getting disturbed. While primary transfer of the immediately preceding toner image is still continuing during the acceleration/deceleration period in some cases, in this preferred embodiment, since the transfer medium 41B, 41D is driven under control in synchronization with the photosensitive member 21, a toner image which is primarily transferred in parallel with the acceleration/deceleration control of the photosensitive member 21 and the transfer medium 41B, 41D is not disturbed.

Meanwhile, accelerating/decelerating the motor under control, the photosensitive member 21 and the transfer medium 41B, 41D which are in rotation at the constant speed (first driving speed) Vcons are temporarily accelerated/decelerated by ΔV during the acceleration/deceleration period ΔTUDV to rotate at a second driving speed (=Vcons+ΔV). This shifts latent image forming positions by an amount equivalent to the registration control amount in the sub scanning direction with respect to a reference latent image forming position (a predetermined position at which latent images are to be formed). In consequence, transfer positions of toner images which are primarily transferred onto the transfer medium 41B, 41D are shifted by the registration control amount in the sub scanning direction.

As described above, in the fourteenth preferred embodiment, the motor is controlled by the so-called external clock method which requires to change the clock signal which is supplied to the photosensitive member/transfer medium drive control circuit 122 from the CPU 121 and accordingly accelerate/decelerate the motor which is the drive source for the photosensitive member/transfer medium driving part 41*a*. Hence, it is possible to control the motor with excellent controllability. This is because with the external clock method, it is possible to control the motor with any desired control waveform (acceleration/deceleration pattern) by changing the clock signal which is supplied from the CPU 121.

Further, in this preferred embodiment, registration control amounts are correlated with the acceleration/deceleration period ΔTUDV for the motor which is the drive source for the photosensitive member/transfer medium driving part 41*a*, and these are stored in advance as the correction information in a table format in the memory 126 as shown in Table 2. Hence, it is possible to optimally set or change when necessary the correction information in the table depending on differences between the individual apparatuses, an environment around the apparatuses, etc., which in turn allows to mitigate an influence due to the differences between the individual apparatuses, etc.

Further, in this preferred embodiment, since the registration control amount and the acceleration/deceleration period ΔTUDV for the motor are set for each temperature environment, even when a temperature inside the apparatus changes, the acceleration/deceleration period ΔTUDV which corresponds to the temperature change is obtained, and therefore, it is possible to suppress registration deviations and form a high-quality image in any temperature environment. Although the foregoing considers only a temperature environment, in view of other environment factor, considering humidity as well, for example, the registration control amount and the acceleration/deceleration period ΔTUDV for the motor may be set for each environment factor.

Further, there are advantageous functions and effects over a conventional technique described below. In short, while among conventional technical solutions is correction of registration deviations by means of temporary acceleration/deceleration control of a transfer medium which rotates at a steady speed, since this approach demands to calculate a correction amount using a formula on the premise that a registration deviation and a correction amount are proportional to each other and to change the velocity of the transfer medium in accordance with the calculated correction amount, this approach has the following problem. This conventional technique is described in Japanese Patent Application Laid-Open Gazette No. 9-80853, for instance. According to the conventional technique, after calculation of a registration deviation LE, a speed correction amount P is calculated by the formula below:

$$P=(LE[\mu m]\times 10^{-3})/(VB[mm/s]\times TB'[ms]\times 10^{-3})$$

The transfer medium is accelerated/decelerated under control by the correction amount P from the steady speed VB only during a predetermined period TB'.

Figure 46:
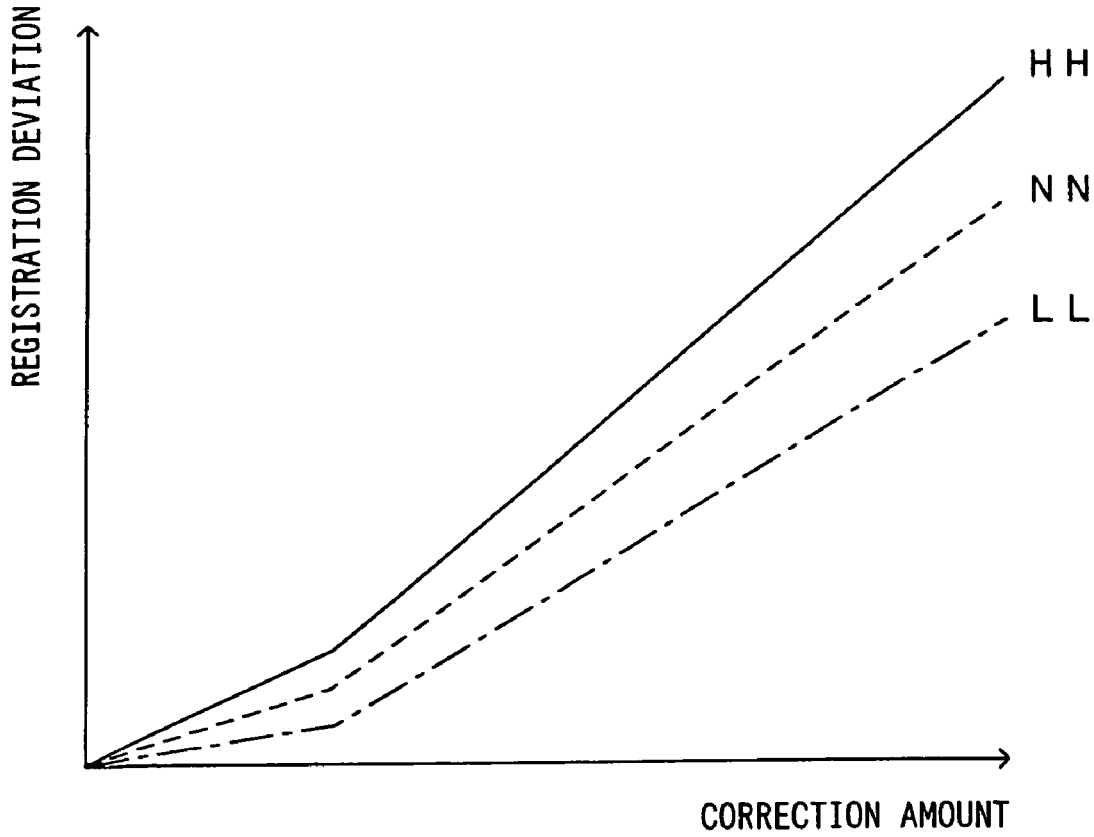
FIG. 46 is a graph showing a relationship between a correction amount and a registration deviation.

However, although the velocity of the transfer medium is changed on the premise that a registration deviation and the correction amount are proportional to each other according to the conventional technique above, a registration deviation and the correction amount are not proportional to each other in an actual apparatus but are in a non-linear relationship to each other, as shown in FIG. 46 for example. Because of this, with correction of the transfer medium based on the formula above, it is not possible to correct a registration deviation in a reliable manner, and therefore, it is not possible to obtain a high-quality image.

Further, the relationship between a registration deviation and the correction amount easily changes depending on an environment around the apparatus. There is a large difference between a low temperature environment (LL), a normal temperature environment (NN) or a high temperature environment (HH), as shown in FIG. 46 for instance. Hence, univocal calculation of the correction amount based on the formula above does not realize appropriate correction of a registration deviation in the presence of an apparatus environment change.

Further, when the correction amount P is to be calculated using the formula above, a relatively long calculation time is necessary. This therefore allows the following problem to arise remarkably in a case that the calculation above is performed followed by the acceleration/deceleration control of a transfer medium based on a result of the calculation in a limited period of time since a reference signal (which corresponds to "the vertical synchronizing signal" used in the present invention), for instance, is outputted until writing of latent images is started. That is, as the calculation takes time, the acceleration/deceleration period must be shortened, which demands rapid acceleration/deceleration. Since this leads to slipping or the like thereby failing to control the transfer medium as intended, it is not possible to accurately correct a registration deviation. In addition, as the calculation takes time depending on the structure of the apparatus, the operation sequences, etc., it becomes impossible even to set up a period for the acceleration/deceleration control. Thus, there are only limited image forming apparatuses to which the conventional technique above is applicable, which serves as one factor which lowers the freedom of the design of the apparatus.

In contrast, in the fourteenth preferred embodiment, since registration control amounts and the acceleration/deceleration period ΔTUDV are stored as the correction information in a table format in the memory 126, it is possible to quickly calculate the acceleration/deceleration period ΔTUDV which corresponds to a registration control amount (Step S6*b*). As a result, the identification time for identifying this period is shorter than where the period is calculated, which allows to effectively use the acceleration/deceleration period. That is, while a large portion of the acceleration/deceleration period is used for calculation in a case that the acceleration/deceleration period ΔTUDV is calculated as in the conventional technique above so that a period which can be actually used for acceleration/deceleration of the transfer medium 41B, 41D becomes short, in this preferred embodiment, since the identification time is shortened, a large portion of the acceleration/deceleration period can be used for the acceleration/deceleration control of the transfer medium 41B, 41D. In this manner, it is possible to suppress a restriction related to the identification time and enhance the freedom of the design of the apparatus.

Further, in this preferred embodiment, since the registration control amount and the acceleration/deceleration period ΔTUDV for the motor are set for each apparatus environment, even when an environment inside the apparatus, a temperature in particular changes, the acceleration/deceleration period ΔTUDV which corresponds to the change in apparatus environment is obtained, and therefore, it is possible to suppress registration deviations and form a high-quality image in any apparatus environment. Although the foregoing considers only an apparatus environment, in view of other environment factor, considering humidity as well, for example, the registration control amount and the acceleration/deceleration period ΔTUDV for the motor may be set for each environment factor.

O. Fifteenth Preferred Embodiment

Figure 45:
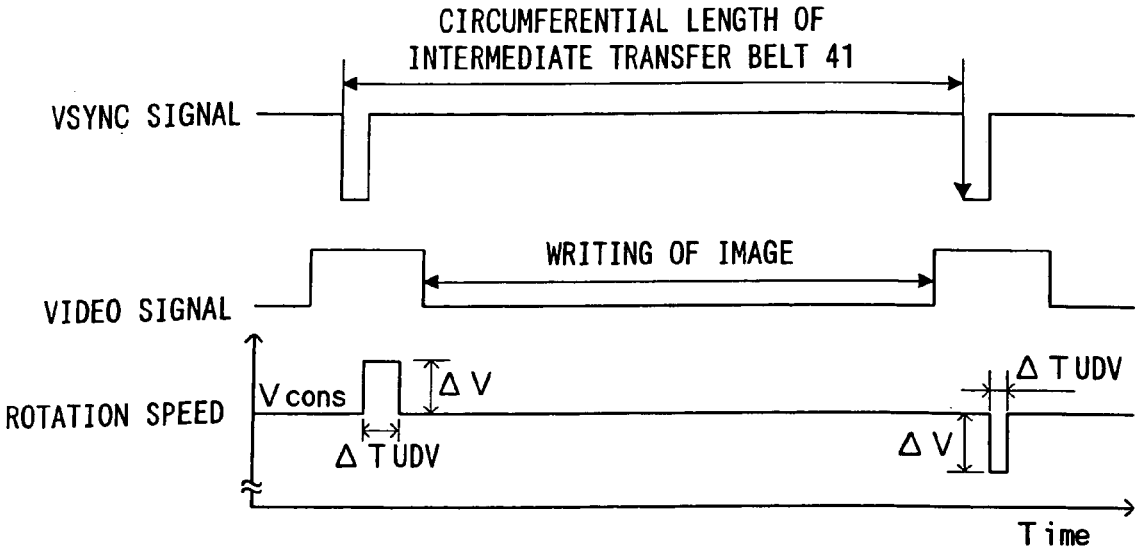
FIG. 45 is a drawing showing acceleration/deceleration control of a motor in an image forming apparatus in one aspect of the present invention.
Figure 47:
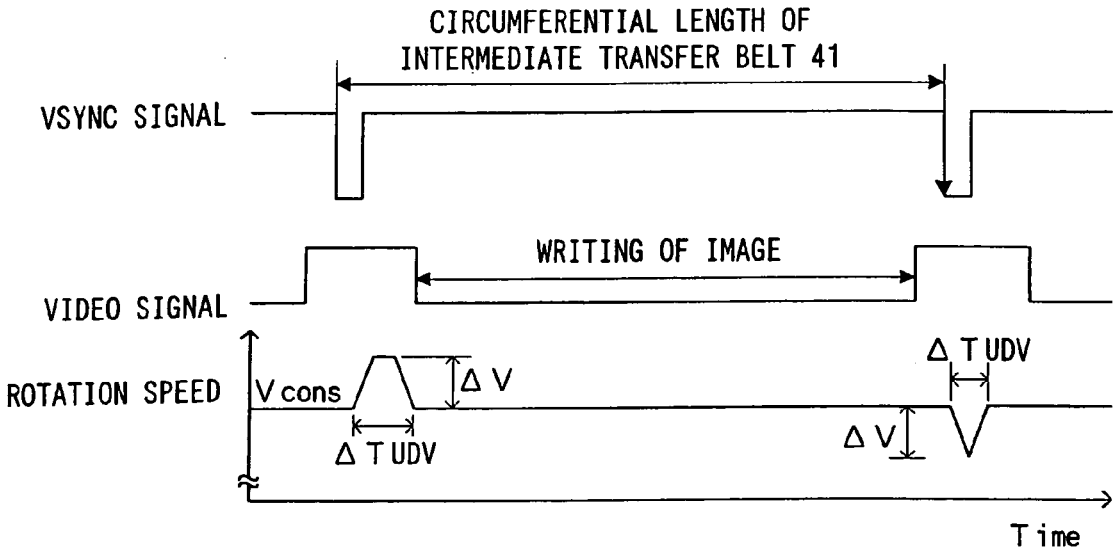
FIG. 47 is a drawing showing acceleration/deceleration control of a motor in an image forming apparatus in other aspect of the present invention.
Figure 48:
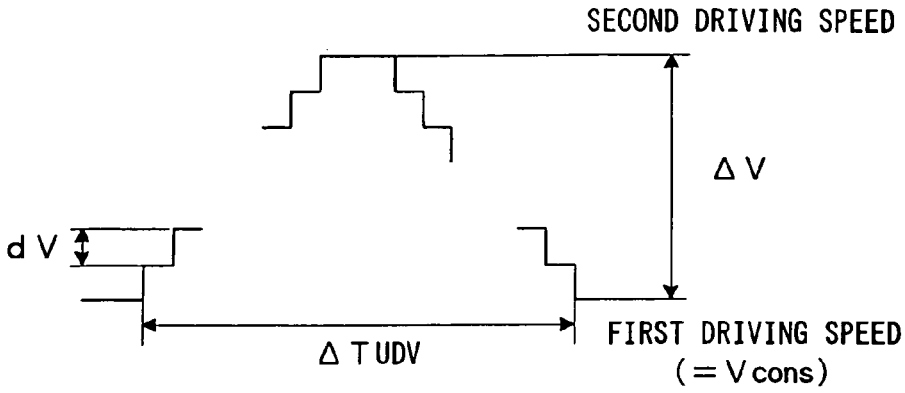
FIG. 48 is a drawing showing one example of an acceleration/deceleration pattern in FIG. 47.

In the fourteenth preferred embodiment described above, the motor is accelerated/decelerated under the control of a rectangular control waveform (acceleration/deceleration pattern) as shown in FIG. 45. While this achieves an effect that it is possible to correct a registration deviation by means of relatively simple acceleration/deceleration control, the motor may be accelerated/decelerated under the control of a trapezoidal or triangular control waveform (acceleration/deceleration pattern) as shown in FIG. 47, for instance. More precisely, as shown in FIG. 48, the driving speed may be controlled such that the driving speed increases (or slows down) by a fine amount dV in response to one drive pulse, reaches the second driving speed (=Vcons+ΔV) upon receipt of thirty one drive pulses, stays unchanged only for a certain period of time, and slows down (or increases) by the fine amount dV in response to one drive pulse to return to the first driving speed Vcons. Alternatively, as shown in FIG. 49, with a structure that the driving speed increases or slows down by the fine amount dV in response to two drive pulses, it is possible to accelerate/decelerate the driving speed more gradually than where the acceleration/deceleration pattern shown in FIG. 48 is used.

Figure 49:
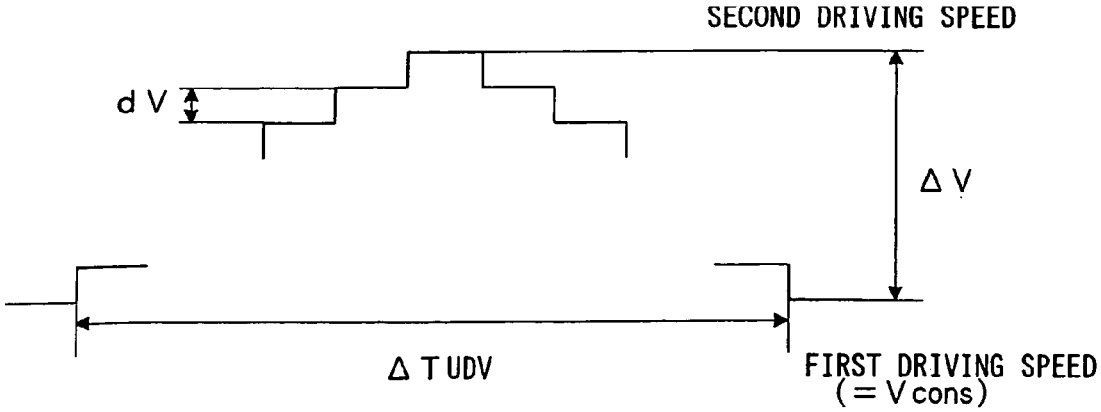
FIG. 49 is a drawing showing other example of an acceleration/deceleration pattern in FIG. 47.

As described above, since the fifteenth preferred embodiment achieves the acceleration/deceleration control of the photosensitive member 21 and the transfer medium 41B, 41D using the acceleration/deceleration pattern shown in FIG. 48 or 49, it is possible to drive the motor highly precisely at excellent controllability. In consequence, it is possible to precisely shift positions at which toner images are formed on the photosensitive member 21 and more accurately correct transfer start positions for toner images on the transfer medium 41B, 41D.

A plurality of acceleration/deceleration patterns may be prepared in advance, for the acceleration/deceleration control of the photosensitive member 21 and the transfer medium 41B, 41D using a rectangular, trapezoidal or triangular acceleration/deceleration pattern in accordance with a registration control amount. In other words, registration control amounts may be stored in correlation with acceleration/deceleration patterns.

P. Sixteenth Preferred Embodiment

In the first, the second and the tenth preferred embodiments described above, the registration control amount establish processing (Step S1) is executed to calculate registration deviation amounts between the toner colors and identify correction values for minimizing registration deviations, namely, registration control amounts. In real creation of a color image, the transfer start positions for toner images in at least one or more toner colors out of the plurality of toner colors are corrected based on the registration control amounts, whereby registration deviations are suppressed.

By the way, the registration control amount establish processing may be interrupted in some cases due to a cause (cause of interruption), such as a cover of the image forming apparatus getting opened and the power source of the apparatus getting turned off, in the middle of execution of the registration control amount establish processing. While one approach to deal with such a cause of interruption is to start the registration control amount establish processing from the beginning after the cause of interruption is removed, this approach demands relatively long time until it becomes ready to start creation of a color image. This leads to a problem that the performance of the apparatus deteriorates.

Noting this, a sixteenth preferred embodiment provides, by means of a structure as described below, an image forming apparatus and an image forming method with which it is possible to form a high-quality image while suppressing registration deviations yet ensuring excellent performance even despite an interruption of the registration control amount establish processing. In the following, an application of the present invention to the apparatus according to the tenth preferred embodiment will be described with reference to FIG. 50.

Figure 50:
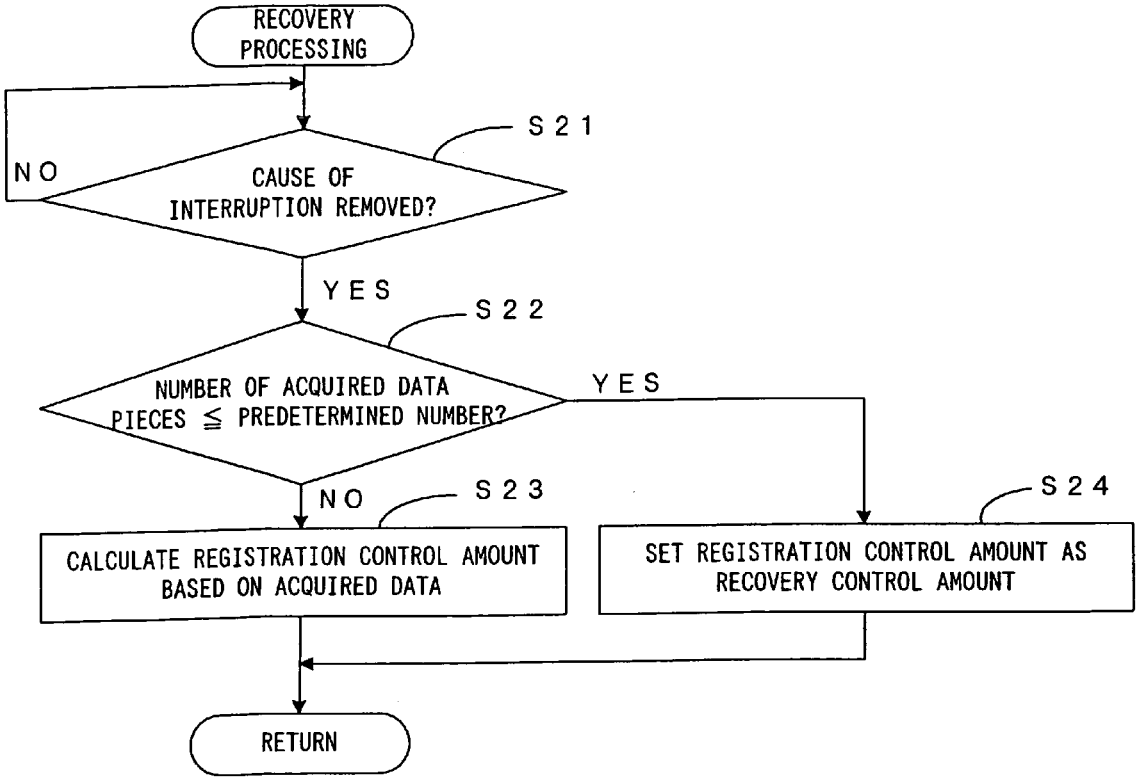
FIG. 50 is a flow chart showing a recovery operation in the image forming apparatus according to the present invention.

In the image forming apparatus described in the section "J. Tenth Preferred Embodiment" in detail earlier, although the registration control amount establish processing is interrupted in the presence of a cause of interruption, such as a cover of the apparatus getting opened and the power source of the apparatus getting turned off, the interruption is eliminated as the cause of interruption is removed later. In the sixteenth preferred embodiment, recovery processing as that shown in FIG. 50 is executed, thereby establishing the registration control amounts Ra, Rb and Rc. An image is thereafter formed as usual.

FIG. 50 is a flow chart showing a recovery operation in the image forming apparatus according to the present invention. In this image forming apparatus, recovery control amount data are entered in advance as a default value upon shipment from a factory, and fixedly set in the memory 126.

First, at a step S21, the sequence waits for the cause of interruption to be removed. As the cause of interruption is removed, whether the number of data pieces acquired since the start of the registration control amount establish processing until the interruption and stored in the memory 126 is equal to or smaller than a predetermined number is judged (Step S22). In this preferred embodiment, the periods T2*a* to T2*d* which are obtained through the registration control amount establish job since the start of the registration control amount establish processing until the interruption are stored in the memory 125. For instance, where the registration control amount establish job has been repeatedly executed fifteen times at the time of the interruption, sixty pieces of the periodical data in total (=four pieces×fifteen times) are stored in the memory 125.

Therefore, when the number of the acquired data pieces is found to exceed the predetermined number which is stored in the memory 126 as a result of comparison, the sequence proceeds to a step S23 to thereby calculate the average values T2*a*(av) to T2*d*(av) of the periodical data which have been acquired by the time of the interruption and to calculate the registration control amounts Ra, Rb and Rc in a similar manner to that described in the section "B-4. Initial Registration Control Amount Establish Processing" earlier (Step S23). When the number of acquired data pieces is relatively large, it is possible to highly precisely calculate registration control amounts even if the number of times to repeat the job is not yet to reach a predetermined value (which is twenty times in this preferred embodiment) and a predetermined number of data pieces have not been acquired yet. On the other hand, when the number of acquired data pieces is equal to or smaller than the predetermined number, the sequence proceeds to a step S24 to thereby read the recovery control amount from the memory 126 and match the registration control amounts with the recovery control amount.

As described above, in this preferred embodiment, upon elimination of the interruption because of removal of the cause of interruption to the registration control amount establish processing, normal image create processing immediately resumes to form a color image without executing the registration control amount establish processing once again. This allows to improve the performance of the apparatus than where the registration control amount establish processing is executed once again after the elimination of the interruption.

Further, although the registration control amount establish processing (step) is not executed once again after the elimination of the interruption, the registration control amounts have been calculated based on data already acquired prior to the interruption (Step S23) and the registration control amounts have been set as the recovery control amount (Step S24). Since the transfer start positions for toner images are corrected for the respective toner colors in accordance with the registration control amounts which are set up in this manner, even without re-execution of the registration control amount establish processing, it is possible to obtain a high-quality color image while suppressing registration deviations.

In addition, in this preferred embodiment above, a method of establishing registration control amounts is different depending on the number of acquired data pieces at the time of interruption. That is, when the number of acquired data pieces at the time of interruption is large enough to expect high accuracy of calculating registration control amounts, registration control amounts are calculated based on the data (Step S23), whereas when the number of acquired data pieces is small at the time of interruption so that accuracy of calculating registration control amounts somewhat drops, the recovery control amount is set as the registration control amounts (Step S24). In this manner, whenever during the registration control amount establish processing a cause of interruption arises, it is possible to appropriately set registration control amounts without executing the registration control amount establish processing once again immediately after elimination of the interruption.

Further, in the preferred embodiment above, since the registration control amount correction (Step S10) is executed after forming a color image at least once or more times while correcting registration deviations based on registration control amounts which are set up during the recovery processing, it is possible to obtain a color image more stably. The reason is because although the registration control amounts are set up through the recovery processing and the accuracy of the calculation of the registration control amounts could be slightly inferior to that for calculating registration control amounts by means of re-execution of the registration control amount establish processing, since the registration control amounts are corrected through execution of the registration control amount correction (Step S10), the registration control amounts can be optimized. Moreover, although an operating environment, such as a temperature and a humidity level inside the apparatus, sometimes changes and registration control amounts accordingly deviate from optimal values while a color image is being created, since this preferred embodiment requires to execute the registration control amount correction (Step S10) and thereafter correct registration control amounts, the registration control amounts are optimized in accordance with an operating environment and the like.

Further, while this preferred embodiment requires correction by weighting based on the count value m which denotes the number of times that color images are formed, since registration control amounts which are obtained through the recovery processing could be somewhat inferior in terms of accuracy of calculating registration control amounts to registration control amounts which are obtained through re-execution of the registration control amount establish processing, the amount of weight may be set differently between a case that there is interruption to the registration control amount establish processing and a case that there is no interruption. For instance, although the data acquisition target value M is set to uniformly "100" independently of whether there is interruption or not in the preferred embodiment above, the data acquisition target value M may be set to "50" if there is interruption so that intermediate registration control amounts may be weighted more in the presence of interruption.

Although the method of establishing registration control amounts is different depending on the number of acquired data pieces in this preferred embodiment above, registration control amounts may be calculated always based on acquired data regardless of the number of acquired data pieces (Step S23), or alternatively, registration control amounts may be set always as the recovery control amount (Step S24).

Further, while the recovery control amount is set fix in advance in the preferred embodiment above, the recovery control amount may be set up in the following manners.

Setup of Recovery Control Amount (1):

This is to update every time a registration control amount is calculated through execution of the registration control amount establish processing. In this fashion, the recovery control amount becomes the most recent registration control amount which is obtained through the registration control amount establish processing which is immediately before the interrupted registration control amount establish processing. This permits to store in the memory 126 a recovery control amount which corresponds to an operation state of the image forming apparatus, and hence, to obtain stable high-quality color images over a long period of time.

Setup of Recovery Control Amount (2):

A registration control amount which is obtained by executing the registration control amount establish processing at predetermined timing may be set as the recovery control amount. In this fashion, it is possible to highly precisely obtain the recovery control amount, update and store in the memory 126, and obtain stable high-quality color images over a long period of time.

For example, registration control amounts are different from each other depending on a difference between the individual transfer mediums 41B, 41D, a condition of assembling of the apparatuses and the like, and therefore, could be different between the individual apparatuses. Hence, the registration control amount establish processing may be executed prior to shipment of the assembled apparatuses so that a registration control amount which is obtained at this stage is stored in the memory 126 as the recovery control amount. For instance, the transfer unit 4 alone may be driven independently upon assembling of the transfer unit 4 to thereby identify a registration control amount and store this in the memory 126 as the recovery control amount. This makes it possible to calculate the registration control amount upon assembling of the transfer unit 4. Since it is possible to calculate the registration control amount without waiting for other units, such as the process unit 2 and the exposure unit 3, to be completed, an efficiency of assembling the entire apparatus improves. Alternatively, the registration control amount may be calculated upon assembling of the entire image forming apparatus and then stored in the memory 126 as the recovery control amount. This allows to obtain a result which reflects influences of the other units except for the transfer unit 4 over a registration control amount, and hence, to obtain a more accurate registration control amount than where a registration control amount is calculated using only the transfer unit 4.

Further, the registration control amount establish processing may be executed at the time of inspection of the apparatus by a service engineer, for instance, other than prior to shipment of the assembled apparatuses so that a registration control amount which is obtained at this stage is stored as the recovery control amount. Alternatively, the registration control amount establish processing may be executed in accordance with an operation state of the apparatus (e.g., the total number of printed pages, an operation time) so that a registration control amount which is obtained at this stage is stored as the recovery control amount.

Setup of Recovery Control Amount (3):

Since the registration control amount correction is executed after forming a color image at least once or more times based on a registration control amount and the registration control amount is then corrected in the preferred embodiments above, the recovery control amount may be updated to the newly corrected registration control amount.

In addition, although the registration control amount correction is executed in the preferred embodiments above, it is needless to mention that the present invention is also applicable to an image forming apparatus which does not execute the registration control amount correction as in the case of the first and the second preferred embodiments.

Q. Seventeenth Preferred Embodiment

In the first, the second and some other preferred embodiments described above, a registration deviation amount between the toner colors is calculated through execution of the registration control amount establish processing (Step S1). More particularly, the registration control amount establish job is repeated, and a registration control amount is calculated based on periodical data which are obtained through this. In real creation of a color image, transfer start positions for toner images in at least one or more toner colors out of the plurality of toner colors are corrected based on the registration control amount, whereby registration deviations are suppressed.

By the way, the tolerance of registration deviations is largely different between different types of businesses conducted by users, depending on factors such as an image type, etc. For instance, the tolerance of registration deviations is generally large for photograph images such as images of the nature and images of people, whereas in the case of an image in which a line deviation is a serious problem, such as a CAD drawing, or an image which uses a number of colored letters, even a slight registration deviation is often not tolerated, and thus, the tolerance of registration deviations is generally small.

Hence, when an image forming apparatus is structured such that a registration control amount is calculated at accuracy which matches with photograph images, i.e., middle or low accuracy, although an image satisfying a user's requirement is obtained from a photograph image, since a line deviation beyond a tolerable range may be created in a CAD drawing or the like, an image of a quality which satisfies a user's requirement may not be obtained in some cases.

On the other hand, where an image forming apparatus is structured such that a registration control amount is calculated at accuracy which matches with CAD drawings or the like, i.e., high accuracy, although a high-quality image can be obtained from a photograph image, a CAD drawing, etc., as it is necessary to increase the number of times to execute the registration control amount establish job to enhance the accuracy of a registration control amount, there is a problem that it takes time before the start of creation of a color image. There is a problem, particularly to a user who exclusively creates a photographic image, that although it is possible to form an image having a desired quality using a registration control amount of middle or low accuracy, since the registration control amount establish job is executed more than needed, the start of creation of a color image must wait. Due to this, various types of user requirements have not been flexibly met by an image forming apparatus which is structured such that after calculating a registration control amount through execution of the predetermined standardized registration control amount establish processing, a registration deviation is corrected always based on the calculated registration control amount.

Noting this, in a seventeenth preferred embodiment, the registration control amounts Ra, Rb and Rc can be changed separately from each other, and a program for changing a registration control amount (hereinafter referred to as a "control amount changing program") is executed if a registration deviation needs be suppressed further to obtain an image having a higher quality. Of course, where an image output of a sufficient quality is already obtainable with an automatically obtained registration control amount, it is not necessary to change the registration control amount, and therefore, printing may be continued without changing the registration control amount. With this configuration, an image forming apparatus and an image forming method are realized with which it is possible to appropriately suppress a registration deviation while flexibly responding to a user requirement. In the following, the seventeenth preferred embodiment of the present invention will be described with reference to FIGS. 51 through 54.

Figure 51:
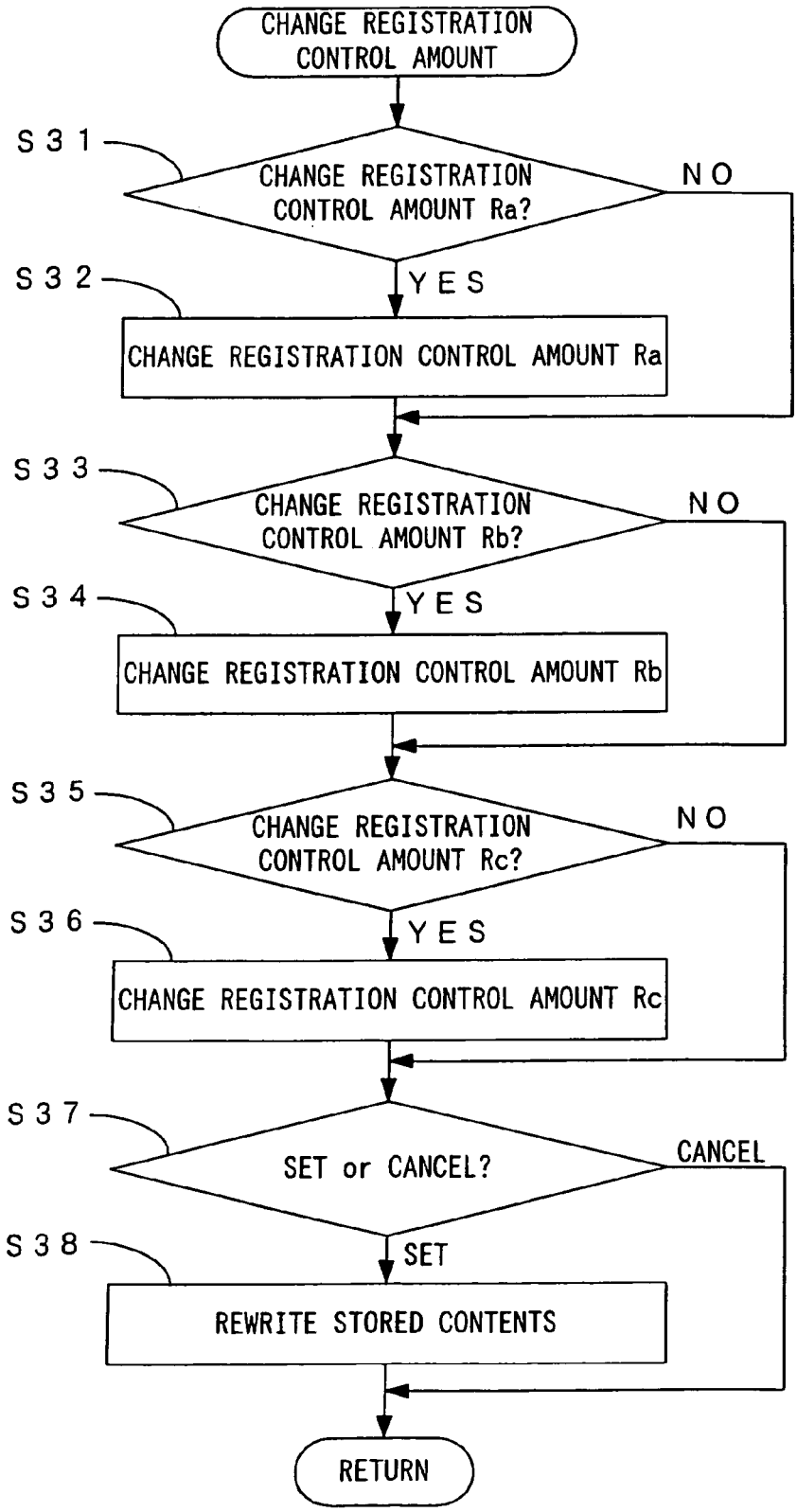
FIG. 51 is a flow chart showing an operation of changing a registration control amount in the image forming apparatus according to the present invention.
Figure 52:
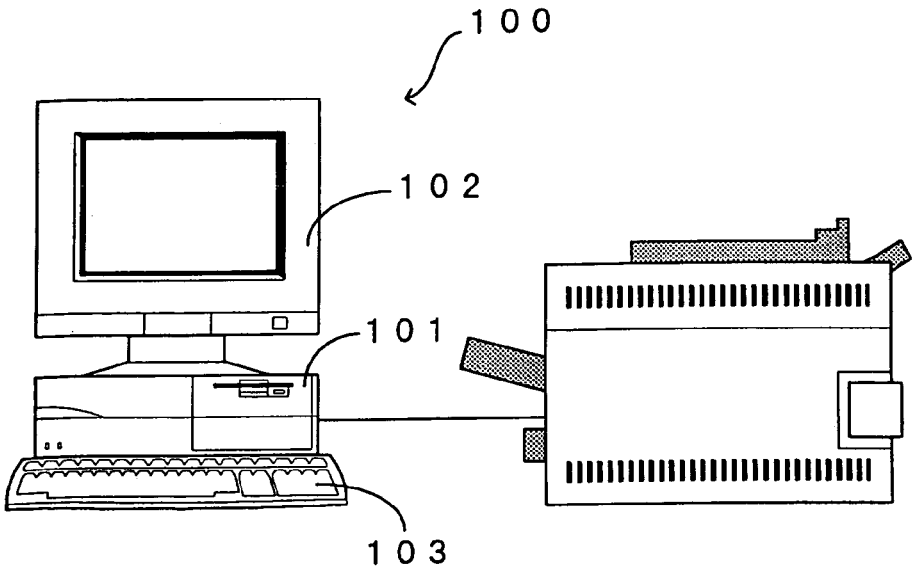
FIG. 52 is a schematic drawing of a connection between the image forming apparatus and an external apparatus.

FIG. 51 is a flow chart showing an operation of changing a registration control amount in the image forming apparatus according to the present invention. FIG. 52 is a schematic drawing showing a connection between the image forming apparatus shown in FIG. 1 or 16 and an external apparatus. This image forming apparatus, as described earlier, is electrically connected with an external apparatus 100 such as a host computer, and as a calculating part (not shown) of a main apparatus unit 101 of the external apparatus 100 executes the control amount changing program depending on a necessity, the registration control amounts Ra, Rb and Rc which are stored in the memory 125 of the image forming apparatus are changed in accordance with the flow chart in FIG. 51.

Figure 53:
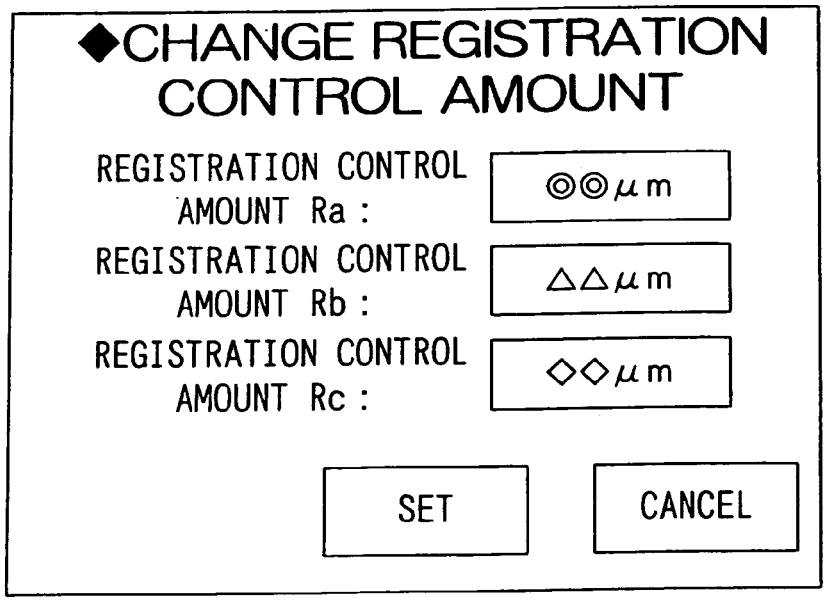
FIG. 53 is a schematic drawing showing one example of a screen which appears on a display of the external apparatus which is shown in FIG. 52.

As the external apparatus 100 executes the control amount changing program, a display 102 of the external apparatus 100 shows a screen for setting up a change to a registration control amount as that shown in FIG. 53, for instance. At steps S31 to S36, via a key board 103 or a mouse (not shown) of the external apparatus 100, post-change values of all or some of the registration control amounts Ra, Rb and Rc are entered. For example, when there is a line deviation beyond a tolerable range in a CAD drawing or the like, since it is possible to assume in which toner color a deviation has occurred to what degree by examining a corresponding printed image, the post-change values may be determined considering this.

As entry of the post-change values completes and a set button on the screen is selected at the step S37, the registration control amounts Ra, Rb and Rc displayed on the screen are supplied to the image forming apparatus from the external apparatus 100. With these received by the image forming apparatus, the contents stored in the memory 126 are written into these values (Step S38). On the other hand, when a cancel button on the screen is selected at the step S37, rewriting of the registration control amounts is stopped and the contents stored in the memory 125 are maintained as they are.

As described above, since the image forming apparatus according to this preferred embodiment allows all or some of the registration control amounts Ra, Rb and Rc, which are stored in the memory 125 of the image forming apparatus, to be rewritten, as the external apparatus 100 executes the control amount changing program depending on a necessity and the registration control amounts Ra, Rb and Rc are rewritten, a registration deviation is corrected more precisely.

Figure 54:
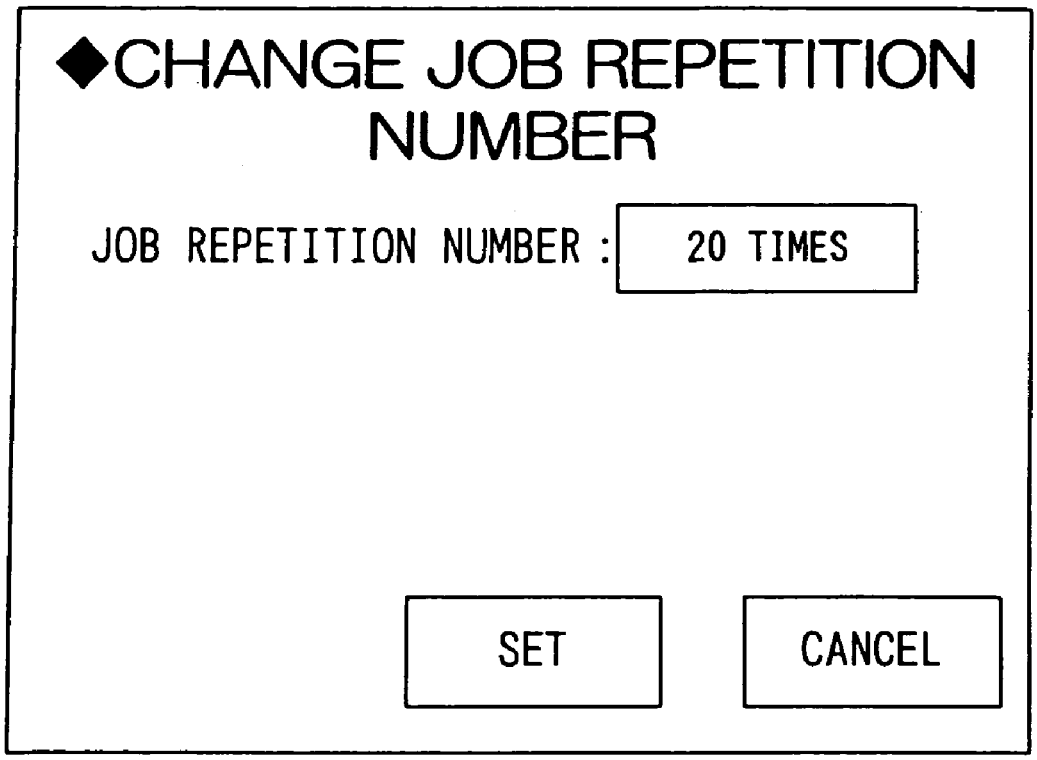
FIG. 54 is a schematic drawing showing other example of a screen which appears on a display of the external apparatus which is shown in FIG. 52.

While this preferred embodiment requires to directly enter changed values of the registration control amounts Ra, Rb and Rc to thereby change the registration control amounts, the registration control amounts Ra, Rb and Rc may be changed by changing the number of times to repeat the job, that is, the number of times to measure the periods, as shown in FIG. 54. For instance, with the repetition number set to "twenty times" so as to calculate registration control amounts at middle or low accuracy to deal with photograph images and the like at the stage of shipment of the image forming apparatus, and when the tolerance of registration deviations is small as in the case of a CAD drawing or the like, the number of times to repeat the job may be set high by running a number-of-times changing program. In this manner, the accuracy of registration control amounts which are obtained through the registration control amount establish processing increases, which in turn makes it possible to further suppress registration deviations.

Further, although the preferred embodiment above requires the external apparatus 100 to execute a program, such as the control amount changing program and the number-of-times changing program, and feed the image forming apparatus with the changed data (the registration control amounts, the repetition number, etc.), inputting means may be disposed which is for supplying the registration control amounts, the repetition number, etc. into the image forming apparatus so that the control amount changing program or the like is executed within the control unit 1 and the registration control amounts are accordingly changed. This makes it possible to independently change the registration control amounts even if the image forming apparatus is not electrically connected with the external apparatus.

Further, as to entry of changed values of the registration control amounts Ra, Rb and Rc, a changed value of the measurement number, etc., a user may directly enter or a service engineer may enter.

R. Eighteenth Preferred Embodiment

The first to the seventeenth preferred embodiments described above are all directed to an improvement of an image quality by means of suppression of registration deviations based on registration control amounts, that is, an operation mode which is customarily referred to as the "registration control mode." In the registration control mode, the abutting means (the secondary transfer roller 48 and the cleaning part 49) contacts and moves away from the transfer medium 41B, 41D while the image create/transfer processing is repeated, and therefore, registration deviations may be created in some cases. Noting this, transfer start positions are corrected based on a registration control amount, thereby suppressing registration deviations and enhancing an image quality. However, it is difficult to completely prevent registration deviations in the registration control mode. A registration priority mode therefore is considered which can completely prevent registration deviations.

The registration priority mode can be a mode which requires to perform idling for three rounds during creation of a color image and execute secondary transfer and cleaning during the idling without establishing registration control amounts or correcting transfer start positions based on a registration control amount, for instance. In the following, a printing operation in the registration priority mode will be described with reference to FIG. 56.

Figure 56:
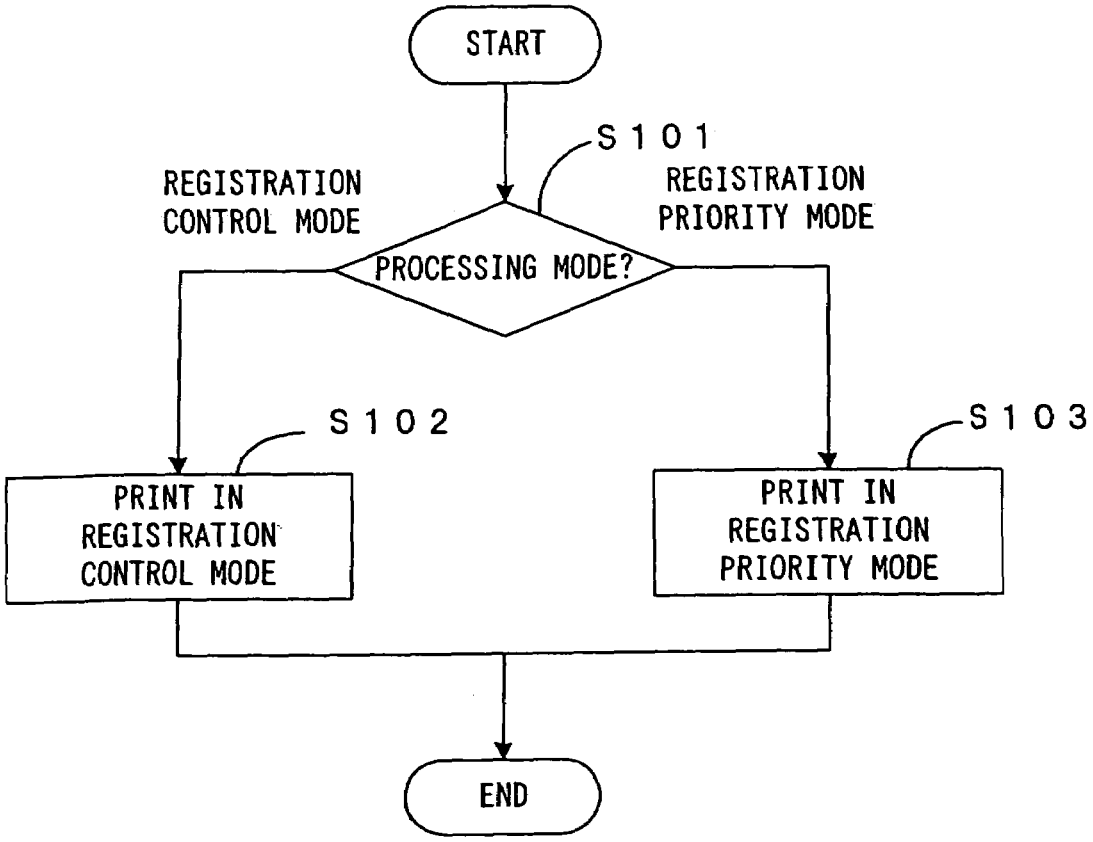
FIG. 56 is a timing chart for describing the registration priority mode in the image forming apparatuses shown in FIG. 1 or 16.

FIG. 56 is a timing chart for describing the registration priority mode in the image forming apparatus shown in FIG. 1 or 16. In an eighteenth preferred embodiment, after the power source of the apparatus getting turned on or the image forming apparatus is released from the sleep mode, as shown in FIG. 56, an intermediate transfer belt 41 rotates and the vertical synchronizing signal VSYNC is outputted intermittently from the vertical synchronization reading sensor 40. As the vertical synchronizing signal VSYNC is outputted at the timing VT1, using the vertical synchronizing signal VSYNC as a reference, the yellow toner image Y1 is formed on the photosensitive member 21 after a certain period of time and this toner image is primarily transferred onto the transfer medium such as the intermediate transfer drum 41D and the intermediate transfer belt 41B.

Further, while the primary transfer in the yellow color is still being executed, the next vertical synchronizing signal VSYNC is outputted at the timing VT2. Using this vertical synchronizing signal VSYNC as a reference, the image create/transfer processing in the cyan color is then executed. In a similar manner, the image create/transfer processing is executed in the magenta color and the black color. As a result, toner images in the four colors are laid one atop the other on the transfer medium, and a color image is formed.

In this preferred embodiment, the transfer medium is rotated idle three times following the image create/transfer processing in the black color which is the last toner color. The image create/transfer processing is not executed during this. After the transfer medium is rotated idle once, the secondary transfer roller 48 contacts the transfer medium with the sheet member S sandwiched in-between during the second rotation, and the color image is secondarily transferred onto the sheet member S fed from a cassette or the like (secondary transfer), concurrently with which the cleaning part 49 contacts the transfer medium so that the toner which remains on the surface of the belt is removed (cleaning). The transfer medium is thereafter rotated idle only once.

In this manner, since the secondary transfer roller 48 and the cleaning part 49 abut on the transfer medium after completion of the image create/transfer processing in the black color which is the last toner color, it is possible to execute the image create/transfer processing in all toner colors in a stable condition that the transfer medium does not have any elastic stretching or the like. In consequence, it is possible to prevent a registration deviation which is created due to elastic stretching or the like of the transfer medium without fail, and hence, form a high-quality color image.

Further, as the secondary transfer and the cleaning complete while the transfer medium is rotated idle three times as described above and as the secondary transfer roller 48 and the cleaning part 49 move away from the transfer medium, the next vertical synchronizing signal VSYNC is outputted from the vertical synchronization reading sensor 40 after the separation at the timing VT8. In response, the image create/transfer processing in the yellow color is executed for the second sheet in a similar manner to that described above. Further, the image create/transfer processing is executed in the cyan color, the magenta color and the black color as well, whereby the second color image is formed.

In this manner, according to this preferred embodiment, the image create/transfer processing is executed for the next toner image after the secondary transfer roller 48 and the cleaning part 49 move away from the transfer medium and the transfer medium returns to a stable condition, and therefore, it possible to suppress registration deviations in the second toner images as well without fail and form a high-quality color image.

While the foregoing has described the preferred embodiment above in relation to an example of continuously executing a first color image creating step for forming the first color image and a second color image creating step for forming the second color image, this is exactly the same when the third and subsequent color images are to be formed following the second color image. In other words, the image create/transfer processing in the last toner color during the first color image creating step for forming an n-th color image ($n \geqq 1$) corresponds to "first processing" in the present invention, while the image create/transfer processing in the first toner color during the second color image creating step for forming an (n+1)-th color image corresponds to "second processing" in the present invention. The transfer medium may be rotated idle three times between the first processing and the second processing, and the secondary transfer and the cleaning may be executed during the idling. The number of idle rotations is not limited to three, but may be four or larger.

By the way, comparison of the registration control mode with the registration priority mode identifies the following. That is, the registration control mode has a better processing efficiency and can realize a higher throughput than the above registration priority mode since the abutting means (the secondary transfer roller 48 and the cleaning part 49) contacts and moves away from the transfer medium during the repeated image create/transfer processing in the registration control mode. On the other hand, it is possible to prevent a registration deviation without fail and form a high-quality color image in the registration priority mode. Hence, while the registration control mode is superior in terms of throughput, the registration priority mode is superior in terms of image quality. In short, it is preferable to execute the registration control mode when a throughput is to be respected, whereas it is preferable to execute the registration priority mode when an image quality is to be respected.

Noting this, the registration control mode and the registration priority mode are executable in the eighteenth preferred embodiment, and as shown in FIG. 56, in which processing mode an image is to be formed is selected first at a step S101. Instead, a user may explicitly select and designate a processing mode, or the control unit 1 may automatically set up in accordance with the type of the sheet member S on which a color image is to be formed, etc.

When the registration control mode is selected, the sequence proceeds to a step S102 and creation of a color image is executed in accordance with the operation flows according to the first, the second and some other preferred embodiments. On the other hand, when the registration priority mode is selected, the sequence proceeds to a step S103 and creation of a color image is executed in accordance with an operation flow which is shown in FIG. 55.

In the eighteenth preferred embodiment, there are the registration control mode and the registration priority mode from which either one can be selected, and the control unit 1 controls the secondary transfer roller 48 and the cleaning part 49 to contact and move away from the transfer medium in the selected mode, and therefore, the mode is properly switched depending on an image quality, a processing time, etc., and a color image is formed.

Figure 55:
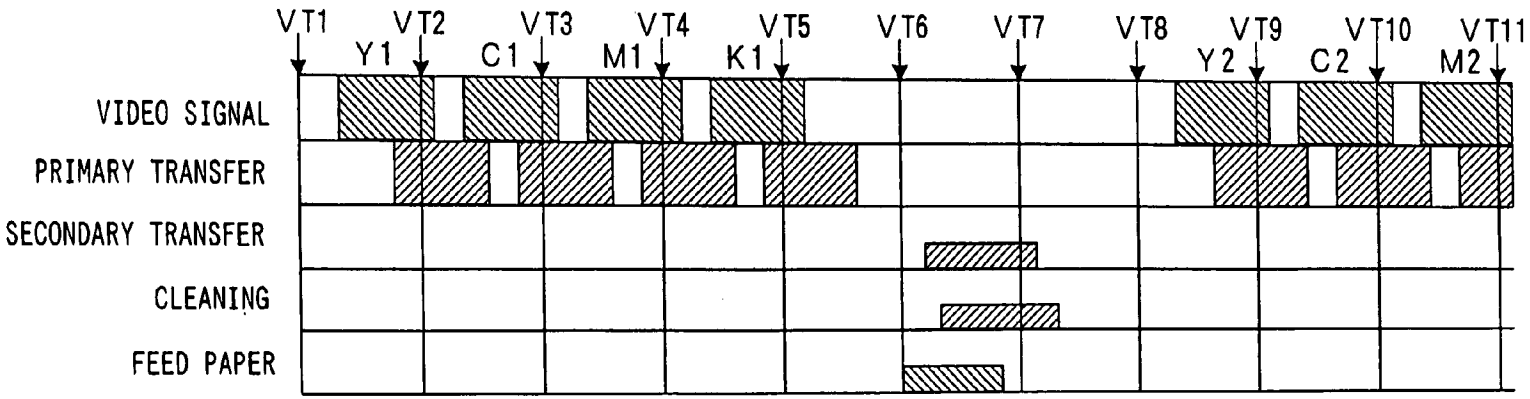
FIG. 55 is a timing chart showing a preferred embodiment of a registration priority mode.
Figure 57:
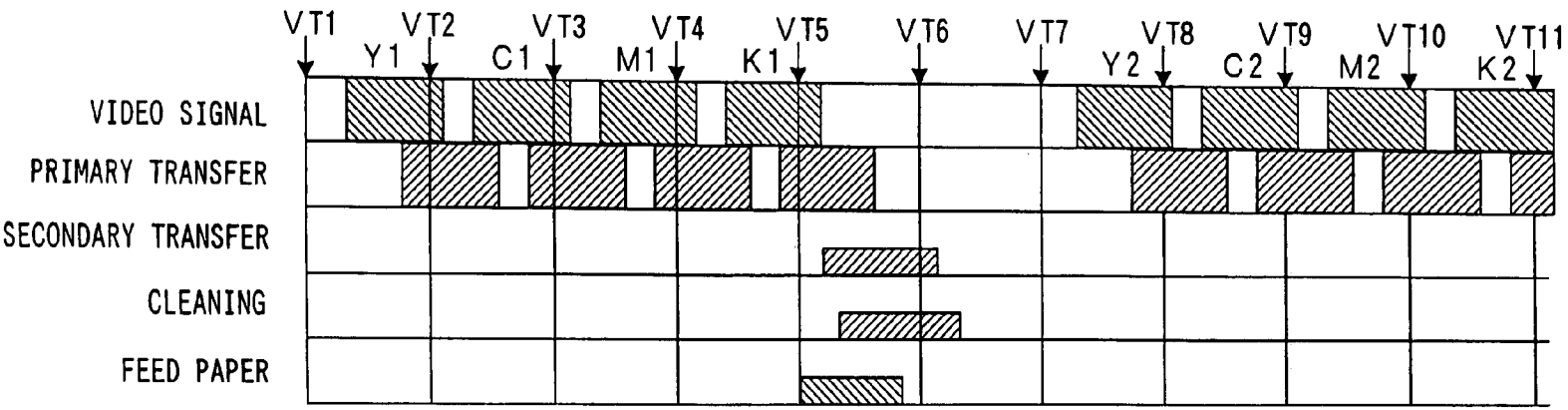
FIG. 57 is a timing chart showing other preferred embodiment of the registration priority mode.
Figure 58:
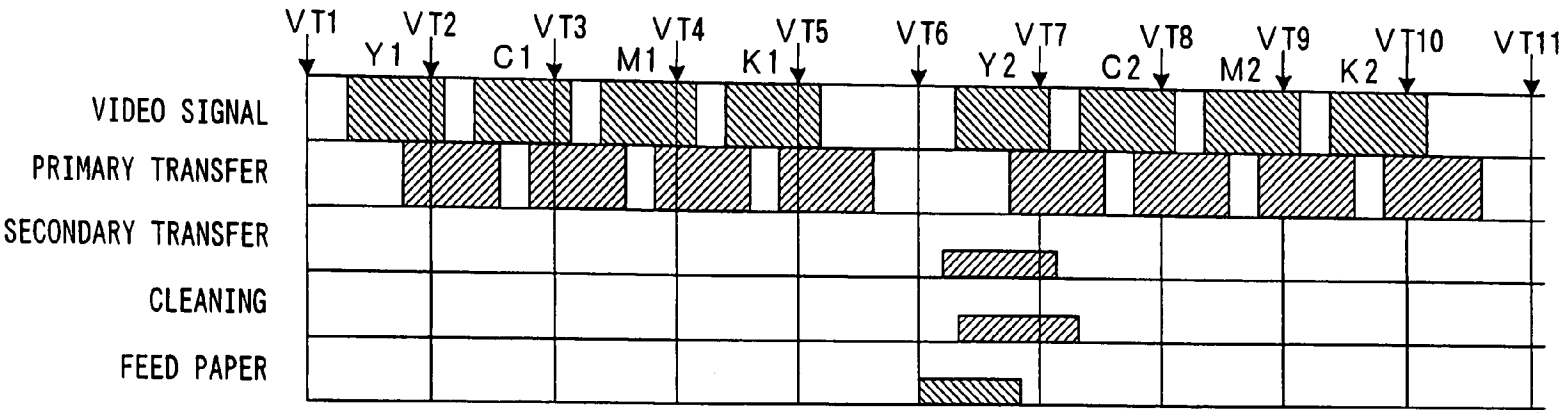
FIG. 58 is a timing chart showing still other preferred embodiment of the registration priority mode.

While the registration priority mode shown in FIG. 55 requires three or more idle rotations between the first processing and the second processing, a registration priority mode as that shown in FIG. 57 or a registration priority mode as that shown in FIG. 58 may be executed instead of this registration priority mode. In the registration priority mode shown in FIG. 57, there are two idle rotations between the first processing and the second processing, and the secondary transfer and the cleaning are executed during the idle rotations as shown in FIG. 57. Hence, since the second processing is started after the secondary transfer and the cleaning complete, it is possible to completely register the yellow, the cyan and the magenta toner images which constitute the (n+1)-th color image. Meanwhile, in the registration priority mode shown in FIG. 58, there is one idle rotation between the first processing and the second processing, and the secondary transfer and the cleaning are executed after completion of the first processing as shown in FIG. 58. Hence, it is possible to reliably prevent contact of the abutting means with the transfer medium during the primary transfer of the n-th black toner image and to completely register the black toner image to the reference toner image.

S. Others

The present invention is not limited to the preferred embodiments described above, but may be modified in various manners other than those described above to the extent not deviating from the intention of the present invention.

(1) Although the magenta color is the reference toner color and the amplitude center for the other toner colors (the yellow, the cyan and the black colors) are matched with the amplitude center for the magenta color in the preferred embodiments described above, other toner color except for the magenta color may be used as the reference toner color. However, since the four toner colors are used in the order of yellow (Y), cyan (C), magenta (M) and black (K) so that a magenta toner image is primarily transferred as the third toner image in these preferred embodiments, as described above, contact and separation of the abutting means (the secondary transfer roller 48, the cleaner blade 491, etc.) is least influencing over the magenta color, and therefore, the magenta color is desirable as the reference toner color. Alternatively, the amplitude center for all toner colors may be matched with each other at an appropriate position, e.g., the straight line AC00 ("a registration deviation amount in the sub scanning direction=k") as shown in FIG. 7 or 20, for instance, without using any reference toner color. In this case, transfer start positions for toner images in all toner colors are to be corrected.

(2) Although the amplitude center are matched with each other for all toner colors in the preferred embodiments described above, it is possible to improve an image quality by matching the amplitude center for at least two colors out of the four types of toner colors.

(3) Although the preferred embodiments described above require to classify into the three types of printing sequences and set the identification variables one for each one of the printing sequences, the number of classified printing sequences is not limited to this. As far as there are two or more classified sequences, it is possible to obtain similar functions and effects to those according to the preferred embodiments described above, that is, to eliminate the necessity to newly calculate a registration control amount every time the sequence changes, and hence, to achieve excellent controllability.

(4) In the preferred embodiments described above, a dynamotor, for instance, is used as the drive source which drives the transfer medium, such as the intermediate transfer drum 41D and the intermediate transfer belt 41B, into rotation and the dynamotor is accelerated/decelerated under control based on a registration control amount, whereby registration is controlled. In stead of a dynamotor, a pulse motor such as a stepping motor may be used, and pulse drive may be controlled based on a registration control amount, to thereby control registration.

(5) Although the single and same photosensitive member/transfer medium driving part (driving means) 41*a* controls both the photosensitive member 21 and the transfer medium (the intermediate transfer drum 41D, the intermediate transfer belt 41B, etc.) so that these two are driven in synchronization with each other in the preferred embodiments described above, a photosensitive member driving part for controlled driving of the photosensitive member 21 and a transfer medium driving part for controlled driving of the transfer medium may be used such that the "driving means" according to the present invention is realized with the photosensitive member driving part and the transfer medium driving part and the driving means drives the photosensitive member 21 and the transfer medium in synchronization with each other.

Further, in a case that a photosensitive member driving part and a transfer medium driving part are disposed separately from each other as described above, only the transfer medium may be controlled at a variable speed based on a registration control amount during a period in which an area of the transfer medium with no toner image formed remains located within the primary transfer region TR1 (i.e., a period in which primary transfer is not performed) while driving the photosensitive member 21 into rotation at a constant speed, to thereby adjust transfer start positions.

(6) While the image forming apparatuses according to the preferred embodiments described above are printers for printing, on a sheet member such as a copying paper, a transfer paper, a paper and a transparent sheet for an overhead projector, an image which is provided from an external apparatus such as a host computer through the interface 112, the present invention is applicable to electrophotographic color image forming apparatuses such as copying machines and facsimile machines, namely, image forming apparatuses in general which lay toner images in more than one toner colors over each other and accordingly form a color image.

(7) Although examples of the transfer medium are the intermediate transfer drum 41D and the intermediate transfer belt 41B in the preferred embodiments described above, the present invention is applicable to image forming apparatuses which use other transfer medium such as a transfer sheet, a reflection recording sheet and a transmission memory sheet, for instance.

INDUSTRIAL USE

As described above, the present invention is applicable to electrophotographic color image forming apparatuses such as printers, copying machines and facsimile machines, namely, image forming apparatuses in general which lay toner images in more than one toner colors over each other and accordingly form a color image, and suitable to form a high-quality image while eliminating or suppressing relative registration deviations among toner images in a plurality of colors which constitute a color image.

The invention claimed is:

1. An image forming apparatus which repeats image create/transfer processing, which is serial processing of forming a toner image on a photosensitive member while rotating said photosensitive member and a transfer medium in a sub scanning direction and thereafter transferring said toner image onto said transfer medium, for a plurality of toner colors which are different from each other, to thereby lay toner images in said respective toner colors over each other on said transfer medium and accordingly form a color image, characterized in correcting transfer start positions of toner image in at least one or more toner colors out of said plurality of toner colors based on a registration control amount which is necessary to correct relative registration deviations among toner images on said transfer medium, said apparatus comprising:

abutting means which temporarily contacts said transfer medium while said image create/transfer processing is repeated; and control means which corrects transfer start positions of toner images, using as said registration control amount a control amount which is necessary to correct relative registration deviations among toner images on said transfer medium which are created as said abutting means contacts and moves away from said transfer medium, wherein with respect to at least two or more toner colors out of said plurality of toner colors, said control means matches the amplitude center of registration deviations in said sub scanning direction for said respective toner colors with each other during said image create/transfer processing.

2. An image forming apparatus in accordance with claim 1, wherein with respect to all toner colors, said control means matches the amplitude center of registration deviations in said sub scanning direction for said respective toner colors with each other during said image create/transfer processing.

3. An image forming apparatus in accordance with claim 1, wherein using one of said plurality of toner colors, in which the amplitude center of registration deviations are to be matched with each other, as a reference toner color, said control means matches the amplitude center for the other toner colors with the amplitude center for said reference toner color.

4. An image forming apparatus in accordance with claim 3, wherein said abutting means is always away from said transfer medium while said image create/transfer processing is being executed on a toner image in said reference toner color.

5. An image forming apparatus in accordance with claim 3, wherein a toner color in which the amplitude is the smallest among the amplitudes for said respective toner colors is said reference toner color.

6. An image forming apparatus in accordance with claim 3, wherein four or more toner colors are prepared for creation of a color image, and a toner color in which said image create/transfer processing is executed for the third time is said reference toner color.

* * * * *

UNITED STATES PATENT AND TRADEMARK OFFICE

CERTIFICATE OF CORRECTION

PATENT NO. : 7,184,677 B2
APPLICATION NO. : 10/953057
DATED : February 27, 2007
INVENTOR(S) : Tanaka et al.

It is certified that error appears in the above-identified patent and that said Letters Patent is hereby corrected as shown below:

On the title page, Item (30), the Foreign Priority Data has been omitted. Item (30) should read:

-- [30] Foreign Application Priority Data

| | | |
|---|---|---|
| Nov. 11, 1999 | (JP) | 11-321727 |
| Dec. 14, 1999 | (JP) | 11-355136 |
| Dec. 14, 1999 | (JP) | 11-355137 |
| Feb. 02, 2000 | (JP) | 2000-25711 |
| Feb. 02, 2000 | (JP) | 2000-025712 |
| Feb. 02, 2000 | (JP) | 2000-025713 |
| Feb. 24, 2000 | (JP) | 2000-048033 |
| Sep. 29, 2000 | (JP) | 2000-298887 |
| Oct. 13, 2000 | (JP) | 2000-313545 |
| Oct. 13, 2000 | (JP) | 2000-313557 |
| Oct. 26, 2000 | (JP) | 2000-326938-- |

Signed and Sealed this

First Day of May, 2007

JON W. DUDAS
*Director of the United States Patent and Trademark Office*